US008879232B2

(12) United States Patent
Ziriax et al.

(10) Patent No.: US 8,879,232 B2
(45) Date of Patent: Nov. 4, 2014

(54) METHOD FOR PRODUCING ELECTROMUSCULAR INCAPACITATION

(75) Inventors: John Ziriax, Fredericksburg, VA (US); John D'Andrea, San Antonio, TX (US); James A. Comeaux, Converse, TX (US); Shin-Tsu Lu, San Antonio, TX (US); Shwu-Jen Lu, legal representative, San Antonio, TX (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 130 days.

(21) Appl. No.: 13/411,556

(22) Filed: Mar. 3, 2012

(65) Prior Publication Data

US 2012/0250210 A1 Oct. 4, 2012
US 2013/0083447 A2 Apr. 4, 2013

Related U.S. Application Data

(60) Provisional application No. 61/448,708, filed on Mar. 3, 2011.

(51) Int. Cl.
*H01T 23/00* (2006.01)
*H05C 1/00* (2006.01)

(52) U.S. Cl.
CPC ..... *H05C 1/00* (2013.01)
USPC ..... 361/232

(58) Field of Classification Search
USPC ..... 361/232
See application file for complete search history.

(56) References Cited

U.S. PATENT DOCUMENTS

| | | | | |
|---|---|---|---|---|
| 5,531,773 | A | 7/1996 | Lines | |
| 2001/0044272 | A1 * | 11/2001 | Berry et al. | 452/58 |
| 2006/0255775 | A1 | 11/2006 | Kramer et al. | |
| 2007/0167241 | A1 * | 7/2007 | Stethem et al. | 463/47.3 |
| 2008/0204965 | A1 * | 8/2008 | Brundula et al. | 361/232 |
| 2008/0228244 | A1 | 9/2008 | Pakhomov et al. | |
| 2009/0020002 | A1 * | 1/2009 | Williams et al. | 89/41.03 |
| 2009/0316326 | A1 * | 12/2009 | Chiles | 361/232 |

* cited by examiner

*Primary Examiner* — Jared Fureman
*Assistant Examiner* — Kevin J Comber
(74) *Attorney, Agent, or Firm* — Ning Yang; Albert Churilla

(57) ABSTRACT

A method and device to temporarily incapacitate a subject for a prolonged period by first applying to said subject a continuous pulsed electric waveform to incapacitate the subject, followed by applying a second intermittent pulsed electric waveform to the subject, which safely maintains the incapacitation of the subject with forced breathing.

25 Claims, 48 Drawing Sheets

*(a): Pounds of pull produced by each limb during a stimulation with an X26. The right front limb (top line) is closest to the most anterior electrode.*

*(B) Pounds of pull exerted by each limb during a stimulation with the inventive device. The right front limb (top line) is closest to the anterior electrode.*

METHOD FOR PRODUCING ELECTROMUSCULAR INCAPACITATION

CROSS-REFERENCE TO RELATED APPLICATION

This application claims the benefit of U.S. Provisional Application No. 61/448,708 filed Mar. 3, 2011, which is hereby incorporated in its entirety.

BACKGROUND OF THE INVENTION

The present invention relates generally to a non-lethal method to control and subdue a subject and, more specifically, to a device and method for delivering an electric waveform to a subject in order to induce a prolonged non-lethal electromuscular incapacitation (EMI) of the subject.

Electrical discharge weapons (EDW) have also become fairly common in recent years. A number of non-lethal electrical discharge weapons have been developed to subdue and control a subject. Numerous U.S. patents have issued for invention of such weapons and for their further improvement, including U.S. Pat. No. 3,523,538 issued to Shimzu on Aug. 11, 1970; U.S. Pat. No. 3,803,463 issued to Cover on Apr. 9, 1974; U.S. Pat. No. 4,253,132 issued to Cover on Feb. 24, 1981; U.S. Pat. No. 5,473,501 issued to Claypool on Dec. 5, 1995; U.S. Pat. No. 5,654,867 issued to Murray on Aug. 5, 1997; U.S. Pat. No. 5,698,815 issued to Ragner on Dec. 16, 1997, U.S. Pat. No. 6,053,088 issued to McNulty, Jr. on Apr. 25, 2000, U.S. Pat. No. 6,782,789 issued to McNulty, Jr. on Aug. 31, 2004, U.S. Pat. No. and U.S. Pat. No. 7,143,539 issued to Cerovic et al. on Dec. 5, 2006.

The TASER® X26 which is the dominant device in the area and is produced by TASER® International, and its sister devices all produce a similar bi-polar waveform whose shape is mimic the ringdown observed in a capacitor discharge through a transformer. The pulse repetition rate in 19 Hz with each pulse having approximately 125 micro-Coulombs, and a duration of roughly 125 micro-seconds. The duration of stimulation is either a constant (5 sec for the X26, 20 sec for the X-rep, or 30 sec for the X26c) for each activation of the trigger, or for the law-enforcement version of the X26 will stimulate continuously if the trigger is held in the on position.

These devices provide an effective but non-lethal form of force, which may be used in self-defense and in law enforcement as well as military operations. Generally, there are two types of non-lethal electrical discharge weapons: those designed for use in close proximity to another, and those having a relatively long range of 10 feet or more.

The close proximity weapons typically have two separated electrodes affixed to the weapon. The weapon must be moved toward a perpetrator so that the electrodes contact the target at two spaced-apart locations. Trained operators can apply the weapon electrodes with precision to the most responsive areas of the target anatomy.

The long range weapon usually provides two launchable, wire-tethered conductive darts, which are propelled at a fixed angle from each other by gun powder to a remote target some distance away. If the two darts contact the perpetrator, the discharge occurred through the wire tethers, and the darts will disable the target.

Each type of the non-lethal electrical discharge weapons has its respective advantages. For example, the close proximity weapon is more effective in situations where a perpetrator is already in contact with the weapon's user, such as in a surprise attack scenario or for a potential robbery victim who is within reach of a threatening perpetrator. On the other hand, where time and distance permit, a long range weapon can be very effective before a perpetrator gets too close to the user. However, how to precisely apply the long range weapon's contacts to more responsive areas of the target anatomy remains a serious design challenge, which needs to be addressed.

There are some weapons available that have both long range and close proximity capability. They have a dart cartridge and a pair of attached "feeler probes" with two switches permitting actuating one or the other. However, these weapons are only available if purchased with this dual function capability or as an after-market addition.

Notwithstanding the improvements made to the electrical stimulation (or stun) devices (ESD), there has been little improvement or change in the current EMI approach. The voltage and peak current is quite high in commercial ESDs. With increasing usage and deployment of ESDs, growing number incidents of electrical injuries related to the use of stun devices have been observed, and morbidities/mortalities linked to the usage of ESDs are also on the rise.

Electrical discharge produces a complex set of injuries including thermal burns, cell membrane damage and rupture, and macromolecule (protein and glycosaminoglycans) denaturation or alteration. The nature and extent of the injuries appears to be related, at least in part, to the strength and duration of the discharge, its anatomic location and path through the tissues of the body, and the characteristics of the current applied (i.e., AC, DC, mixed). The organ- and organism-level effects may include skin burns, skeletal muscle death, cardiac dysrhythmia, osteocyte and osteoblast death, blood vessel endothelium dysfunction, etc. Moreover, the application of electric currents to a live subject may cause acidosis, which is due to incomplete or inconsistent muscular contraction. Acidosis occurs when the body is incapable of properly clearing lactic acid build-up, and may lead to death in extreme cases. Some types of current (e.g., direct current, DC) can cause little or no injury at low levels, and increasing amounts of damage and disruption of muscle control at higher levels. However, notwithstanding the complex injuries that may be caused by the application of ESDs, there have been few reports of biologically-based studies that characterize specific responses to stun device stimuli or to health effects of a given stun device output with reference to nerves and muscle, both of which mediate the EMI response. Very little objective laboratory data are available describing the physiological effects of stun devices.

The most commonly used devices, TASER® produced by TASER® international (Scottsdale, Ariz.), can produce 50 kV open circuit voltage, and 3-15 amperes of peak current [1] with electrical pulse durations last between 4.5 to 30 seconds. In order to produce a widespread neural excitation, while maintaining a very low probability of producing undesired effects, the duration of the EMI stimulus is designed to be short (30-80 μs), resulting in a very small conducted charge in each pulse, at about 100 μC [2] [3] [4]. The maximum range of TASER® is 21 feet with operational ranges of 10-15 feet.

With increasing use of the electrical stimulation devices in military operations, improvements to many features of the ESDs are desirable, for example:

a. A longer range of operation (5-100 meters), which allows the user to achieve Human Electromuscular Incapacitation (HEMI) effects at greater stand-off distances, and thus increase protection of the user from the threats.
b. A longer duration of incapacitation (100-180 seconds), which provides sufficient time for the user to close in and take custody of an incapacitated subject if needed.

c. A self-contained projectile that is not tethered to an electrical generator and upon impact can apply the electrical charge, and pulsing current to incapacitate the subject without causing unnecessary injuries.

BRIEF DESCRIPTION OF THE DRAWINGS

FIG. 27. Swine 1958's arterial pressure, lung volume under TASER®-X26 stimulation from 0 to 2 minutes. Black trace is arterial pressure (upper curve, scale on left axis). Grey trace is inflow volume (lower curve, scale on right axis). Increase in inflow volume indicates inhalation and decrease inflow volume, exhalation. Shaded grey area indicates TASER®-X26 stimulation is on.

DETAILED DESCRIPTION OF THE INVENTION

Figure 1A:
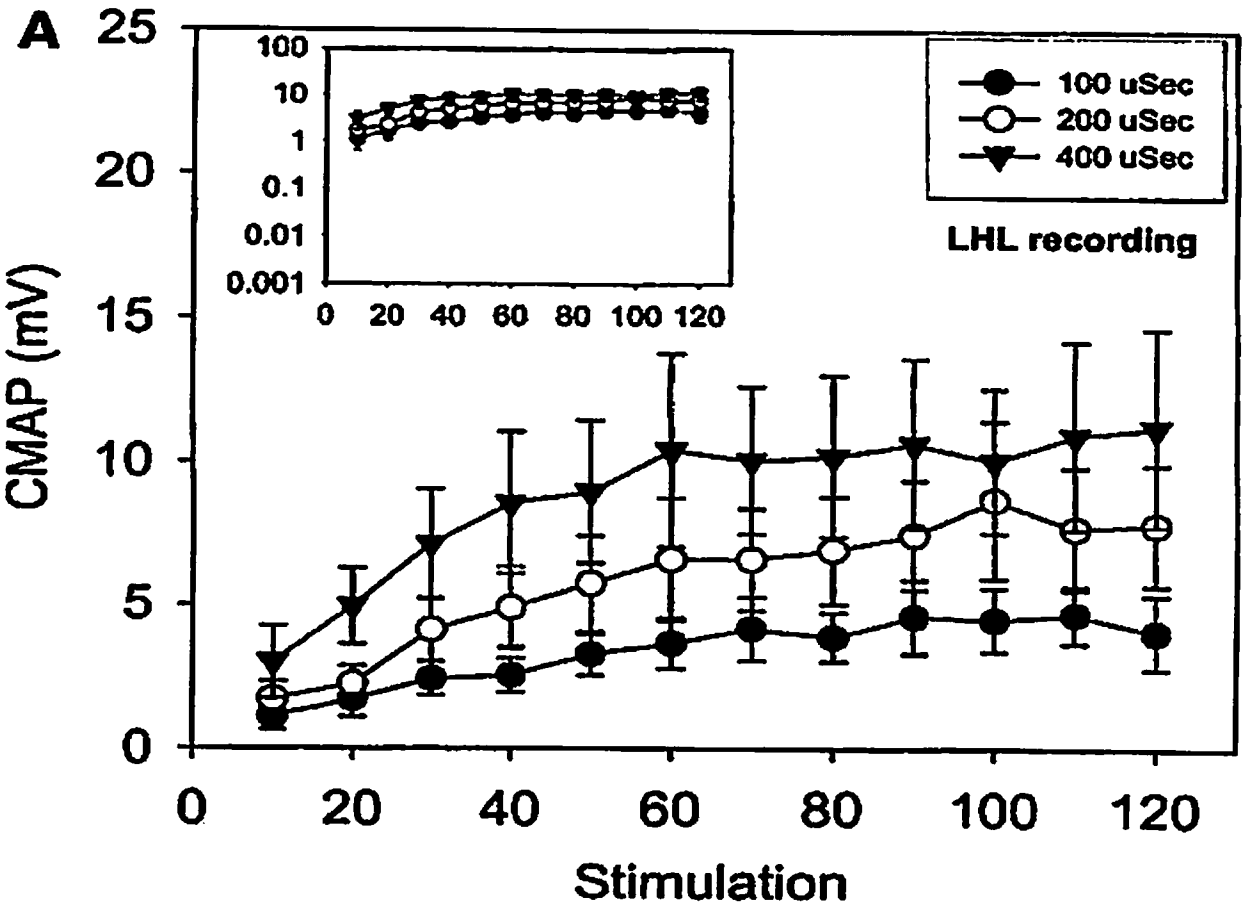
FIG. 1A-C. CAMPs amplitudes recorded in all three extremities during a simultaneous, direct stimulation of SN, and FN with electrical pulses of increase widths.

Human Electromuscular Incapacitation (HEMI) is a bioeffect caused by a high voltage charge, passing into the body. The electrical charge is carried as an ionic current through the body producing an intense throbbing sensation, and causes an involuntary contraction of skeletal muscles. When the charge is repeatedly pulsed at a sufficiently rapid rate, repeated muscle contractions occur, voluntary control of skeletal muscles is lost, the body loses posture and incapacitation occurs for the duration of the stimulus.

Spinal reflexes are graded behaviors that can result from stimulation of either cutaneous sensory fibers or sensory afferents in muscles and tendons. The strength of the stimulus and consequent degree of neural recruitment, as well as its repetition pattern, determine the amplitude of the response. A cumulative effect in the spinal neural circuitry determines the onset of complex reflex responses that produce whole body muscle activity.

While pain and loss of postural control effects from the use of Electro Stimulation Device are readily observable, the neuromuscular mechanisms linking exposure to the ESD and neuromuscular response have remained undetermined. A conducted charge of 100 μC is about 100 times of that needed to produce pain in human laboratory subjects, and well above the thresholds of motor reactions [6]. According to many sources [7] a shock of half a second duration from an ESD will usually cause intense pain and muscle contractions. Two to three seconds will typically prevent intentional muscle control during the passage of current, cause the subject become dazed, and drop to the ground. Thus, knowledge of bio-mechanism of the muscle incapacitation by electrical stimuli is the key to optimizing the effectiveness and safety of ESDs.

The uncoordinated muscular activity induced by an ESD is a generalized whole-body neuromuscular effect that prevents voluntary actions, and results in loss of postural control. This uncoordinated muscular activity can be assessed by measuring the amplitude of the electromyographic response or compound muscle action potential (CMAP) in muscles of the extremities of the body.

To examine whether EMI effect is a manifestation of multiple simultaneous spinal reflexes induced by stimulating multiple afferent nerves with electric pulses applied to a small anatomical region. 60 kg Yorkshire pigs was selected as the animal model because in this body size range, the pig's heart size to body weight ratio is equivalent to that in humans. The coronary artery anatomy also resembles that of humans. In addition to cardiovascular similarities, the cerebral cortex, spinal cord and peripheral nerves and the muscles, including the myofibrils, and sarcomeres are anatomically very similar to humans. Pig skeletal muscle cells are also more similar in physical size and electrical space constant to humans than other smaller lab animals.

Each pig was received in the animal care facility at least 48 hours ahead of each procedure, to permit health assessment of the animal prior to entering the protocol procedure. Each experiment was initiated with administration of a pre-anesthetic 10-15 min prior to induction of general endotracial anesthesia. A surgical plane of gas anesthesia induction is administered.

Depth of anesthesia was verified by loss of palpebral reflex (touching the eye to ensure the animal does not blink). A twitch monitor was used to monitor the depth of anesthesia, and ensure that electromotor response level remained constant during experiments and was consistent from one animal to the next. Isoflurane administration was titrated between 1% and 1.4% of inhaled gas. A Datex-Ohmeda monitor was used to record heart rate, respiration rate, EKG, body temperature, pulse oximetry, end-tidal C02, and blood pressure (non-invasive cuff). The corneas were protected with a layer of ophthalmic petrolatum or other suitable ointment. The animal was placed and secured in dorsal recumbence. During each experiment, vital signs were noted continuously in the manner stated above in 15 minutes intervals before the application of electrical signals, and 30 min intervals during the surface myography. The body temperature was maintained at 37° C. using a Bear-Hugger blanket (Arizant, Eden Prairie, Minn.).

Both mixed nerves containing sensory and motor nerves and pure sensory peripheral nerves were stimulated to compare the responses. A mixed nerve refers to a peripheral nerve containing both cutaneous sensory and motor nerve axons. Mixed nerve stimulated included the Femoral nerve (FN), the Saphenous nerve (SN), the Ulnar nerve (UN) and Intercostal nerves (INs). Femoral nerve (FN) is located just below the inguinal ligament in the proximal thigh and is adjacent to the Femoral Artery. It is a mixed nerve providing both sensory and motor axons to the hindlimb. For purposes of investigating the effects of ESD stimulation of a motor nerve, the FN distal was stimulated to the point of separation from the saphenous nerve at which point it contains mostly fibers to innervate hindlimb muscles. The Saphenous nerve (SN) is courses through the medial thigh, hindlimb and foot. The Ulnar nerve (UN) is a mixed motor and sensory nerve in the distal forelimb before it reaches the hoof. The UN controls the muscles in the distal forelimb below the knee and muscles in the forefoot. Intercostal nerves (INs) are positioned at the inferodorsal surface of the ribs and provide efferents and afferent innervation for intercostal muscles and sensory innervation of soft tissues in the region of the nerves' path.

Electrical pulses were generated by a function generator (DS345, Stanford Research Systems, Sunnyvale, Calif.) driving a bipolar power operational amplifier (Kepco BOP 200-1M, Flushing, N.Y.). Stainless steel bipolar surgical forceps electrodes were used to contact the gel. The electrical pulse thus was confined to the space between the bipolar electrodes. The amplifier case was grounded to the pig using a standard surgical grounding pad. Possible common mode current passing through the ground pad was monitored to ensure that it was too small to trigger reflexes.

To apply ESD pulses to a specific peripheral nerve. To minimize artifact caused by direct muscular stimulation by the ESD pulse the nerves are electrically isolated from skeletal muscle by inserting a sterile latex sheet between the nerve and surrounding tissue. This procedure eliminated direct muscular activation and secondary reflexes. A 1 cm thick layer of 4 M KCL conducting electrode gel was placed in the latex barrier around the nerve at the point selected for electrical stimulation. The bipolar electrodes were inserted into the surface of the conducting gel and maintained at a 4-5 mm distance from the nerve. This obviated harmful effects of electrochemical byproducts of electrode reactions. The electrodes were equidistant from the nerve, and oriented such that the electric field was applied parallel to the nerve.

Electrical pulses were used to stimulate a 1 cm partial thickness skin wound over the sternum at the level of 6th rib insertion. The wound oriented in a craniocaudad fashion and the electric field pulses were applied parallel to the wound. The CMAP activity was recorded, again, in all the pig's extremities.

The effect of electrical stimulus with various amplitudes, pulse durations, waveforms and frequencies and resulting EMI responses were measured to determine the dose-response functionality. Based on different stimuli/EMI response data, an optimum signal waveform was selected and was used to demonstrate that the spinal reflex can be shaped to produce EMI. To verify that the stimulated nerve is responsible for the motor reflexes, the nerve was blocked with 1% lidocaine. The lidocaine was injected adjacent to, but not directly into the nerve, at a point proximal to where the nerve was stimulated. In addition, the lidocaine was also infiltrated around the point of electrical stimulation. Thus, at some point, ~10 cc of 2% lidocaine hydrochloride (4 mg/kg (BW)) was injected intramuscularly beneath the stimulating electrode, to determine if it blocked the generalized responses.

A four channel 5 Gigahertz LeCroy digital oscilloscope (Chestnut Ridge, N.Y.) with 10× and 100× probes (10 Mega OM input impedance) was used to record ESD stimulus signals. A Faraday coil was used to monitor current output from stimulus or potential ground loops. To reduce CMAP stimulation artifact, the animal was well grounded using an electrocautery grounding pad. The skin was abraded to remove stratum corneum and 4 M KCl conducting gel was applied to increase the conductivity.

Transcutaneous compound muscle action potentials were measured with a Dantec CounterPoint III clinical electrophysiology system (Dantec, Denmark). Care was taken to standardize the position of the electrodes and the position of the animals. The CMAP recording electrodes were positioned to measure both extension and flexion muscle activity. The Dantec has high-impedance front-end FET amplifiers connected to a 12 bit A/D digitizer. The data analysis including noise filters are software preprogrammed.

Each experiment was repeated three to five times. The CMAP data was analyzed by measuring the steady state amplitude of the CMAP response to a specific input stimulus. The steady state CMAP amplitude at 20 Hz stimulation was the graphical average of 10 peaks of the CMAP recording. This graphical average was defined as the CMAP response.

The recording shown rib blockage by lidocaine completely removed muscular activity. The CMAP values measured in the hind limbs and left forelimbs shown decreased below the resting values.

Figure 1B:
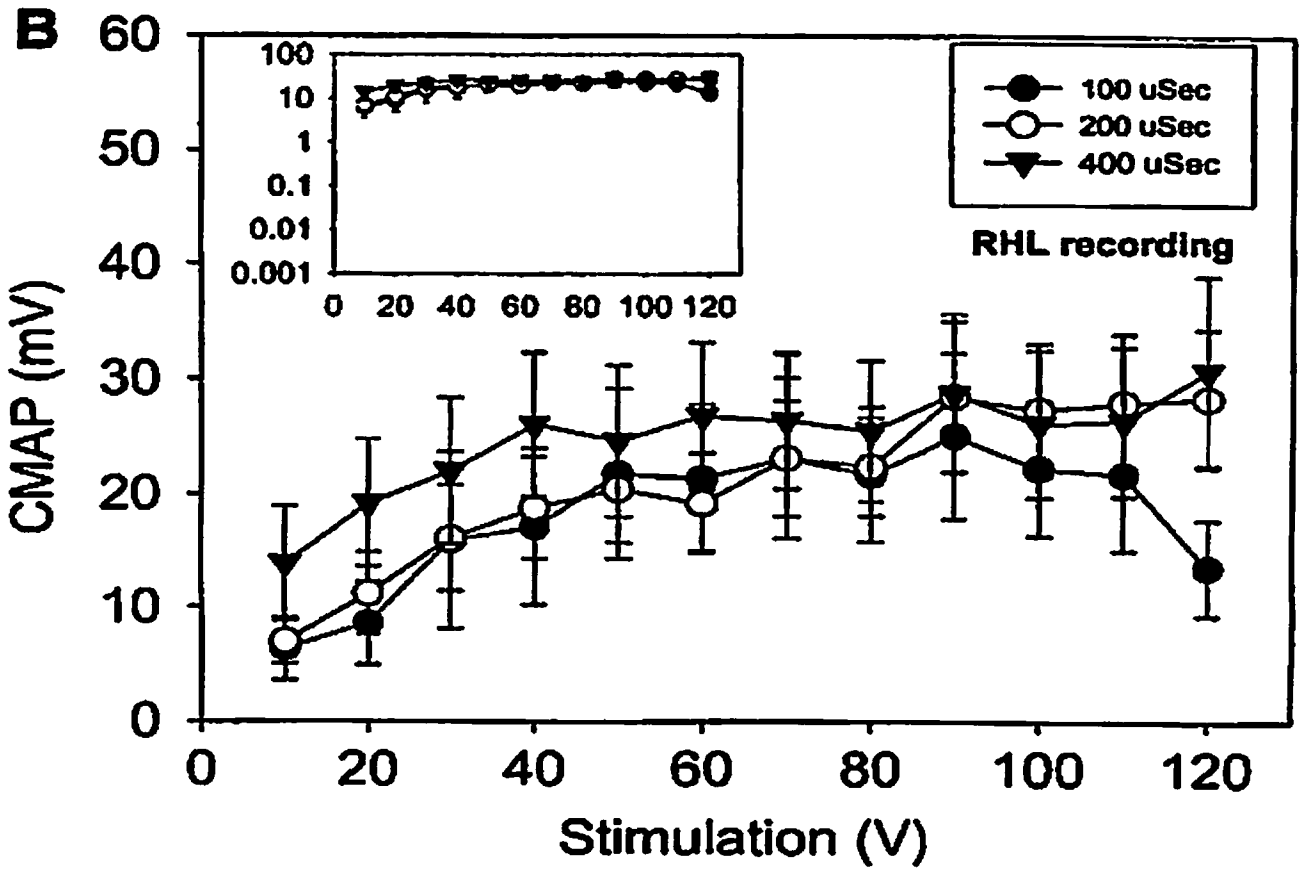
Figure 1C:
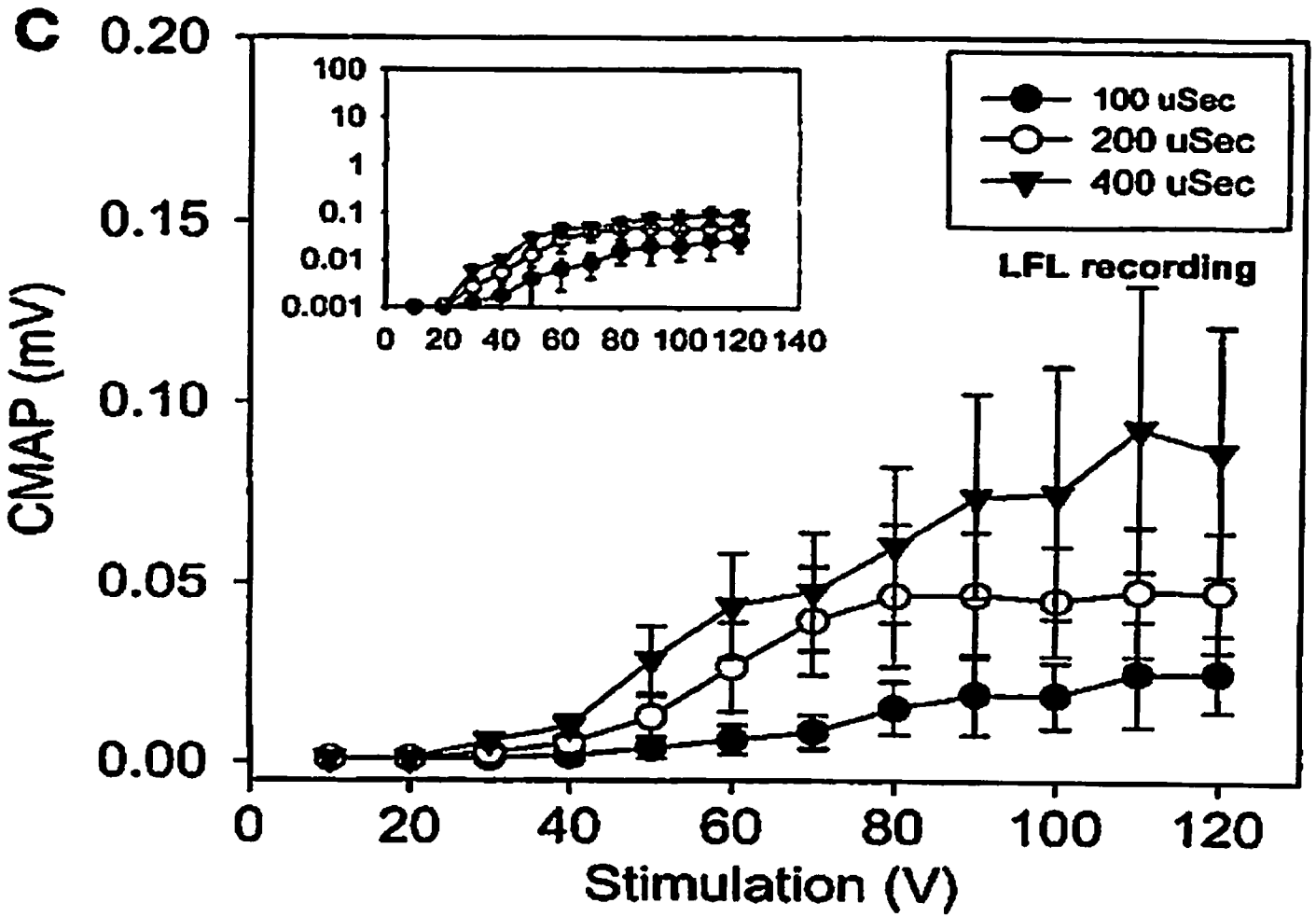

The CMAP signals in the three extremities monitored during a simultaneous, direct stimulation of SN and FN with electrical pulses widths of 100μ, 200μ, and 400μ are shown, FIG. 1A-C. All other parameters of the electrical stimuli were kept constant. The saturation of the CMAP response depends on the pulse width. The stimulation amplitude required to set a maximum CMAP response decreases to about 60 V for a pulse width of 200μ and to about 40 V for a pulse width of 400μ. Similar results were obtained for stimulations of saphenous, femoral, ulnar, and intercostal nerves (not shown).

The fact that peripheral CMAP responses to ESD stimulation in the torso could be abolished by blockage of nerves innervating the region is compelling evidence that peripheral nerve excitation is an essential mechanism of generalized EMI responses. Lidocaine injection will not alter the anatomical electrical field distribution. Therefore, the hindlimb CMAP response to TASER® X26 stimulation on the chest is not due to direct electrical field stimulation of hindlimb muscles. Rather, the hindlimb CMAP excitation was mediated by spinal reflexes.

One feature of typical stun devices or electrical stimulation devices (ESD) is the expectation of instantaneous and full incapacitation upon termination of the stimulation. In the prior art, the EMI stimulus was designed to elicit a fast target response, typically above the "let-go response", after which no further increases in incapacitation are possible, except lengthening the duration of the incapacitation while the circuit is maintained by repeated trigger pulls. In many cases, instantaneous full incapacitation may not be required or warranted, particularly in cases with vulnerable populations where full incapacitation would put the target at danger of falling, and sustaining an injury. In these cases, short and repeated periods of contact with an EMI stimulus may be preferable. Prolonged electromuscular stimulation may cause persistent contraction of respiratory muscles, resulting in injury or death of the subject due to suffocation.

The embodiments of the present method of nonlethal electromuscular incapacitation avoid injuries caused by prolong electromuscular stimulation of current ESDs. Longer incapacitation is safely achieved via applications of a two-phase electromuscular stimulation, which comprising:

(a) an initial threshold stimulation phase to initiate an almost instantaneous incapacitation, and sustain exhaustion; and (b) a second intermittent stimulation phase to pace or force the target subject's breathing at a natural rate while maintaining incapacitation, therefore increase the safety of the targeting subject and extend maximum incapacitation time.

An embodiment of the inventive method comprising the steps of:

(a) generating a continuous pulsed electric waveform; and (b) applying said continuous pulsed electric waveform to a subject at a first frequency and for a first time period sufficient to induce involuntary muscular contraction;

(c) generating an intermittent pulsed electric waveform; and (d) applying said second intermittent pulsed electric waveform to said subject at a second frequency and for a second time period sufficient to safely incapacitate the subject with forced breathing.

The application of the first continuous pulsed electric waveform aims to elicit almost instantaneous full incapacitation of the targeted subject upon the completion of the electrical circuit for a time period of approximately 30 seconds. This is followed by an application of a second intermittent pulsed electric waveform to the subject aims to safely maintain the incapacitation, which may last up to approximately 150 seconds. During this second phase of electromuscular stimulation, the pulsed electric waveform is applied to the target subject in an ON/OFF pattern, allowing the muscles time to relax between contractions and pace the subject's breathing. In one embodiment, the second pulsed electric waveform is cycled in a pattern of ON for 1-3 seconds, and OFF for 1 second. This intermittent application of pulsed electric waveform forces the subject to breath at a rate resembling the natural breathing cycle. For a safely incapacitated human, a breathing cycle of approximately 12 breaths/minutes allows the subject to sustain an acceptable oxygen level in blood.

The pulsed waveform may have same or different parameters in the continuous and intermittent phases of electrical stimulation. Pulse frequency (pulse repetition rate) may range from about 40 Hz to about 80 Hz. In one embodiment the pulse frequency is 40 Hz. This higher rate produces greater muscle tetany which limits the mobility of the target. Charge per pulse may be up to 50 micro-Coulombs. Simulations and scientific literature reviews suggests that pulses less that 100 microsecond in duration will require greater charge per pulse to produce a given effect, while pulses greater than 100 microsecond will produce an increasing risk to the target. Pulse shape may vary, possible waveform used for the inventive method include but not limited to: square pulse, Gaussian pulse, increasing exponential, and decreasing exponential pulses. An experimental comparison of pulse shapes (Example 1-4) showed that the defining characteristic of a pulse's effectiveness was its net charge. That is, biphasic components of a pulse tend to cancel each other out. Among waveforms the square wave pulse delivers the highest amount of charge at the least voltage. In an embodiment, square wave monophasic pulse with pulse duration of about 100-microsecond with a total charge of 50 micro-Coulombs per pulse was selected.

Figure 25:
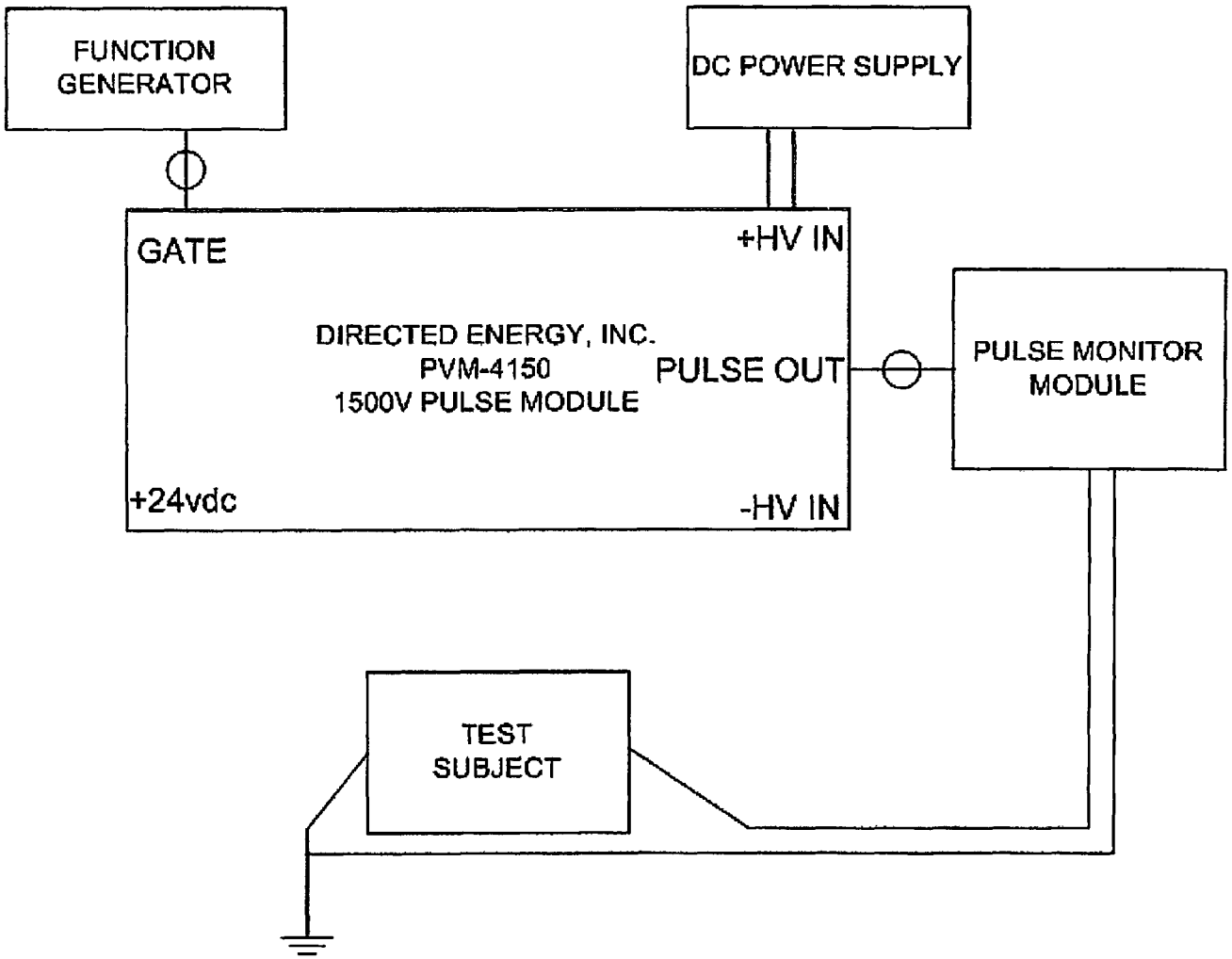
FIG. 25. Block diagram of the HEMI stimulation hardware.

An embodiment of the inventive device, comprising an electrical circuit, which is adapted to generate a continuous pulsed electric waveform for a period of time sufficient to induce almost instantaneous involuntary muscular contraction of the subject, and is adapted to generate an second intermittent pulsed electric waveform during the rest of incapacitation duration, sufficient to safely maintain exhaustion while forcing the subject to breath at a rate that resembles the natural breathing cycle. The embodiment device (FIG. 25) may further comprise a power source, such as a battery and a plurality of electrical contacts for delivering electric waveforms to a subject and a switch to selectively activate the electrical circuit. The contact may include but not limited to a pad, a button, a nub, a prong, a needle, and a hook, which may deliver the electric waveform subcutaneously or to the outer surface of the targeted subject. Alternatively, the contact may be a self-contained projectile that is not tethered to an electrical generator, and upon impact can apply the electrical charge and pulsing current to incapacitate the subject without causing unnecessary injuries. The device may further comprise a release mechanism for releasing the plurality of contacts from the device. Example of such release mechanism may include gunpowder or electrical propelled releasing mechanism. The inventive device may further comprise an elongate body having the contacts is located approximately at one end, and the switch is located on the other end.

The threshold (first) continuous pulsed electric waveform applied by the inventive device can last up to 30 seconds, followed by a period of application of intermittent pulsed waveform. In one embodiment, the device generates intermittent pulsed waveform with pulses (stimulation) cycling in an ON/OFF pattern. The pulse waveform is cycling ON for approximately 1-3 seconds and OFF for approximately 1 second, allowing the muscle time to relax between contractions. Thus forcing the incapacitated subject into a breathing cycle resembles natural breathing. This intermittent pulsed stimulation phase may last up to 150 seconds resulting in safe incapacitation of the subject for a total period up to 3 minutes. Although, lethality studies suggest that total time of incapacitation may be safely maintained beyond 3 minutes. Durations as much as 30 minutes have been survived by anesthetized swine.

In general, an embodiment of this invention have the following hardware: 1) a power source, typically a battery; 2) pulse forming circuitry; 3) a step-up transformer/capacitor which increases the voltage and decreases the current of the pulse; 4) two conductors with at least one contact point each to deliver the stimulating stimulus to the target. See FIG. 25.

Example 1-4

Pulse Waveform and Pulse Frequencies Studies

Four animal experiments were conducted to investigate the effectiveness of different pulse waveforms and pulse repetition frequencies in eliciting limb responses. Two experiments were conducted to examine the effectiveness of monophasic pulses of different waveforms and durations in eliciting limb responses. Threshold response was examined in the first experiment and equal peak response was examined in the second experiment. The threshold experiment examined two waveforms with positive and negative phases.

The third experiment compared single square pulses with paired square pulses of different polarities in eliciting equal peak responses. Polarity of monophasic pulses and initial pulses in biphasic pairs was either positive or negative. Two pulse durations were tested. In addition, different interphase delays in the biphasic pairs were tested.

A fourth experiment is conducted to compare the effectiveness of bursts of square monophasic pulses in eliciting equal responses. Both 10-pulse and 1-s trains of pulses were tested at four pulse repetition frequencies.

Common Materials and Methods

Animals

Yorkshire swine 41-69 kg were used. The animal was anesthetized.

An animal was placed in one of two positions during the experimental procedures. In the threshold pulse experiment, anesthetized animals were placed in ventral recumbency. In the monophasic pulse, biphasic pulse, and pulse burst experiments, animals were placed in dorsal recumbency.

A Vet/Ox G2 Digital Monitor (HESKA, Loveland, Colorado) was used to display arterial oxygen saturation ($SpO_2$), heart rate, respiration rate, and body temperature. The $SpO_2$ and heart rate were detected by an oximeter sensor (HESKA) placed over a labial artery. Respiratory air movement was detected by a thermistor-based Vet/Sensor (HESKA) attached to the end of the endotracheal tube. Body temperature was detected by a thermistor probe (HESKA) inserted into the rectum. Displayed values of the Vet/Ox monitor were monitored continuously and recorded at 15-min intervals.

Stimulus Generation and Application

Stimulus waveforms were programmed on an Agilent 33250A arbitrary waveform generator (AWG) (Agilent Technologies, Santa Clara, Calif.). The output of the AWG was connected to a voltage source specific to each experiment to produce the needed stimulus.

Similar stimulus controls were used in monophasic pulse, biphasic pulse, and pulse burst experiments. Experiment-specific LabVIEW software (v8.5, National Instruments, Austin, Tex.) was used to program waveform or pulse burst settings in the Agilent AWG. LabVIEW also sampled force signals at 1 kHz per channel (200 Hz, one animal in the biphasic experiment) and stored along with stimulus information in text files. LabVIEW displayed force responses versus time and the peak of the right front limb response as a single number to assist in selecting the next stimulus amplitude. In the threshold pulse experiment, LabVIEW (v7.0) was used for many of the same functions, and interacted with another data acquisition system described below. Stimulus was delivered through two electrodes consisting of darts supplied with TASER® X26 (TASER® International, Inc., Scottsdale, Arizona, USA) on the ventral surface of the animal. One dart location was 7.6 cm left of the umbilicus. The other dart location was 12.7 cm rostral and 5.1 cm right of the xiphoid, placing it near the right forelimb. The same electrode locations were used in all experiments. The barbed end of a dart was inserted through the skin such that its tip was subcutaneous, but not penetrating other tissue. Darts were inserted as soon as possible after placing the animal on a platform and were checked before application of stimuli. Stimulus polarity was defined as the voltage applied at the rostral electrode referenced to the caudal electrode.

Recorded Variables

Digital oscilloscopes were used to measure stimulus voltage and current, which were recorded. The oscilloscopes and their connections were specific to each experiment, but in all cases programs were written in C++ (GCC v 4.1.2, Free Software Foundation, Boston, Mass.) were used to convert oscilloscope data files to text files and to perform automated pulse measurements. Programmed phase durations were confirmed by measuring the time between the times of 50% peak phase voltage for square waveforms and 10% peak phase voltage for other waveforms. In all but the threshold pulse experiment, current resulting from the applied voltage pulse was measured with a Pearson Model 110 Current Monitor (Pearson Electronics, Palo Alto, Calif., USA), through which an electrode wire passed.

Forces at the limbs were detected by SSM AJ 150 force sensors (Interface Manufacturing, Scottsdale, Arizona). A nylon rope was used to connect each sensor to a strap securely fastened to the distal portion of a limb. In the threshold pulse experiment, connections to force sensors were adjusted to pull forelimbs backward and hindlimbs forward to achieve a steady background force of 0.7-2 N. Positive force was then detected for forelimbs in a rostral direction and for hindlimbs in a caudal direction. In the monophasic pulse, biphasic pulse, and pulse burst experiments, connections to the force sensors were adjusted to have a steady background force of 4-8 N on each limb. Positive force was detected for forelimbs in a caudal direction and for hindlimbs in a rostral direction.

Force sensors were calibrated in pounds before each experiment and measured forces were converted to newtons during data analysis. Regardless of the instruments used to record force response data, text files with force data were analyzed with programs written in R (v2.5.0, R Development Core Team, 2007).

Data Analysis

Additional stimulus parameters were computed from the stimulus voltage and current recorded by digital oscilloscopes using programs written in C++. Charge was calculated as the time integral of the current. Positive charge and negative charge were determined separately for each stimulus. The algebraic sum of positive and negative charge was designated as net charge; the sum of their absolute values, as total charge. Pulse energy was calculated as the time integral of the product of voltage and current. Excel® spreadsheets (Microsoft Corporation, Bellevue, Washington) were used to compile data summaries and to generate files for further analysis. In pilot analyses, net charge was found not to be a reliable stimulus measure and was not included in final analyses. Quantitative measures of stimulus parameters were plotted as mean±standard deviation (SD).

Processing of recorded forces was done with programs written in R. Forces were first converted from pounds to newtons and the start of the stimulus application was set as time 0. Data were further organized and analyzed using R programs and various versions of Excel spreadsheets.

Statistical testing was done using SAS (v9.1 SP2, SAS Institute, Cary, N.C.). Normality of data was examined using Shapiro-Wilk and Kolmogorov-Smirnov tests. Testing for a significance difference in an effective stimulus variable or a response variable between experimental conditions was done using a linear mixed model with the conditions as fixed effects and animal as a random effect. When appropriate, this testing was followed by pair-wise testing with Tukey-Kramer correction for multiple comparisons. P-values are provided in many cases. A p-value of less than 0.05 was considered to indicate a significant difference.

Stimulus and response data in the monophasic pulse, biphasic pulse, and pulse burst experiments were analyzed for a number of experimental conditions. In the course of determining equivalent responses, these data were collected multiple times for the same condition in a given animal subject. For analysis, these data were reduced to one sample per subject by using the average value for 3 equivalent responses for a given condition. This reduced data set was then graphed and used for analysis. Graphs of the full data sets appear quite similar to graphs of the respective reduced data sets. Data were included only from stimuli that were similar for a given condition and for responses that were also within two standard deviations of the mean for that condition over all animals. The advantages of using a reduced data set included equal weighting of animals in the analysis. The reduced data were also found to be more likely to be normally distributed, and thus more appropriate for testing with the linear model. The mixed model used on a reduced data set was also used on the corresponding full data set with similar results in all cases.

Example 1

Threshold Experiment

Seven Yorkshire swine weighing 41-63 kg (47.1±8.4 kg, mean±SD) were used in the threshold experiment. They were positioned in ventral recumbency. The Agilent AWG output was connected to a Model 7500 amplifier (Krohn-Hite, Avon, Massachusetts, USA) using DC input coupling and gain of 100. The amplifier output delivered stimuli to the animal with the positive terminal connected directly to the rostral electrode and the negative terminal connected to the caudal electrode through a 1-ohm resistor.

The Krohn-Hite amplifier output voltage was measured using a Model TDS7404 Digital Phosphor Oscilloscope (Tektronix, Beaverton, Oregon) with Tektronix Model TCA-1MEG High Impedance Buffer Amplifiers. A second 1-Me channel indicated current by being connected to the animal side of the 1-ohm resistor.

Figure 2:
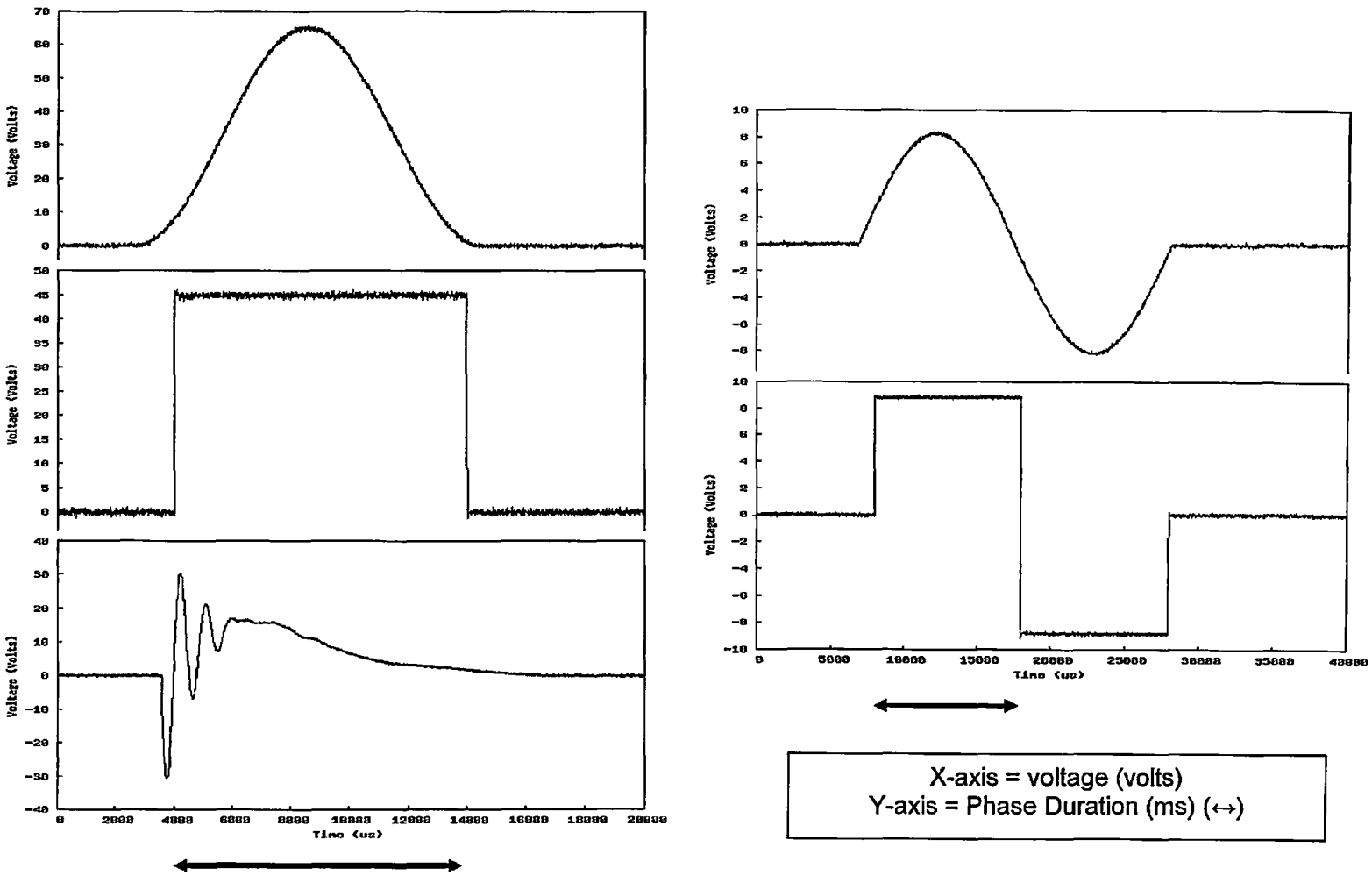
FIG. 2. Examples of pulse waveforms tested in the threshold experiment. From top to bottom, the left panels show a monophasic Gaussian pulse, a monophasic square pulse, and a polyphasic pulse. From top to bottom, the right panels show a biphasic sine pulse and a biphasic square pulse FIG. 3. Examples of response for the pulse waveforms tested Monophasic Pulse Experiment.

The five waveforms were tested including: monophasic Gaussian, a monophasic square pulse, a biphasic single-cycle sine, a biphasic square pulse, and a polyphasic pulse (FIG. 2). The polyphasic pulse waveform was modeled after a TASER® X26 pulse. The selection of waveforms was based on results of earlier experiments on frog muscles (Comeaux & Jauchem, 2008). Each pulse waveform was delivered with an initial, or only, positive phase at the three nominal durations of 30 μs, 100 μs, and 10 ms. Each waveform was tested at three durations with six amplitudes that were expected to be above and below the threshold for muscle stimulation. Thus, 90 different stimuli were used: 5 waveforms times 3 durations times 6 amplitudes.

A BIOPAC MP150 system (MP150 hardware and Acq-Knowledge v3.7.3 software, BIOPAC Systems, Santa Barbara, Calif., USA) was used to record signals. Each of the four force sensors was connected to a BIOPAC DA100C differential amplifier with gain 1000 and low-pass cutoff frequency 300 Hz and was sampled at either 312.5 or 1250 Hz in different animals. One channel recorded a signal derived from a second respiration sensor on the endotracheal tube with sampling at 312.5 Hz. One channel with sampling of 5000 Hz recorded a signal that indicated the trigger signal for the applied stimulus. Respiration and trigger signals were connected directly to the MP150.

The BIOPAC system initiated stimulus application and data acquisition every 30s. LabVIEW software (v7.0, National Instruments, Austin, Tex., USA) randomly selected and record, without redundancy, one of the 90 stimuli for the Agilent AWG to produce. The series of 90 applications was repeated 4 times, with separately randomized waveforms in each series, resulting in a total of 360 stimulus applications per animal. LabVIEW retrieved voltage and current waveforms for each stimulus application from the oscilloscope and stored them in files.

Monitored physiological variables remained within acceptable ranges throughout experimental procedures. The 15-min readings of the 7 animals showed heart rate 77-154 bpm (109.1±15.7 bpm, mean±SD), respiration rate 15-46 breaths/min (29.0±7.4 breaths/min, mean±SD), oxygen saturation 86-99% (96.8±1.8%, mean±SD), and rectal temperature 36.6-38.6° C. (37.3±0.5° C., mean±SD).

Figure 6:
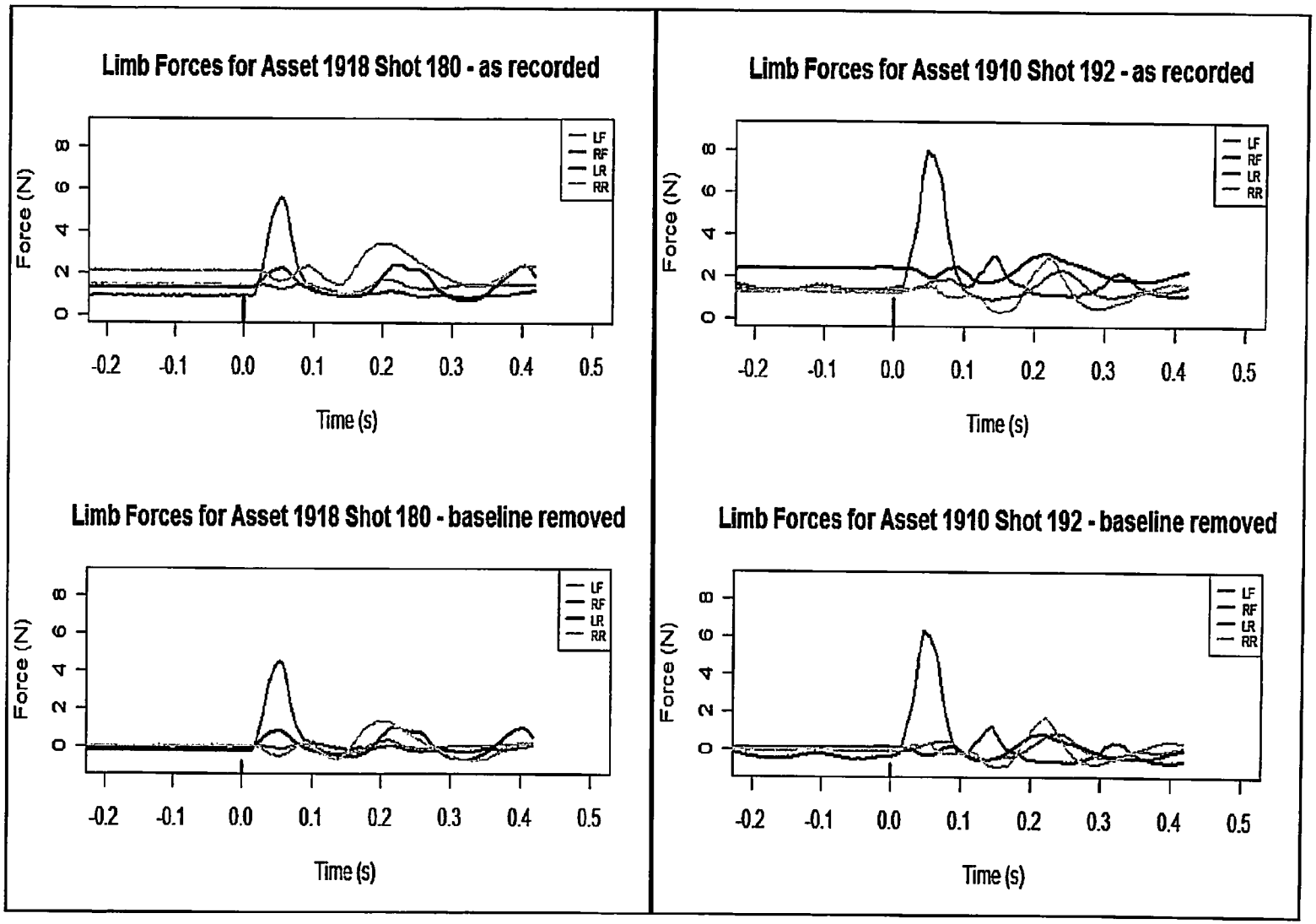
FIG. 6. Examples of responses measured in the threshold pulse experiment.

FIG. 6, shows examples of responses measured in the threshold pulse experiment. These examples illustrate the different response magnitudes and typical time courses. In each panel, forces of the four limbs are shown as they were recorded and the respective steady background forces were later subtracted. The tick mark at time zero marks the time of stimulus application. For animal 1918, stimulus 180 was a biphasic sine pulse with phase duration of 10 ms and a maximum of 88.9 V. For animal 1910, stimulus 192 was a biphasic sine pulse with phase duration of 10 ms and a maximum of 60.0 V.

Figure 7:
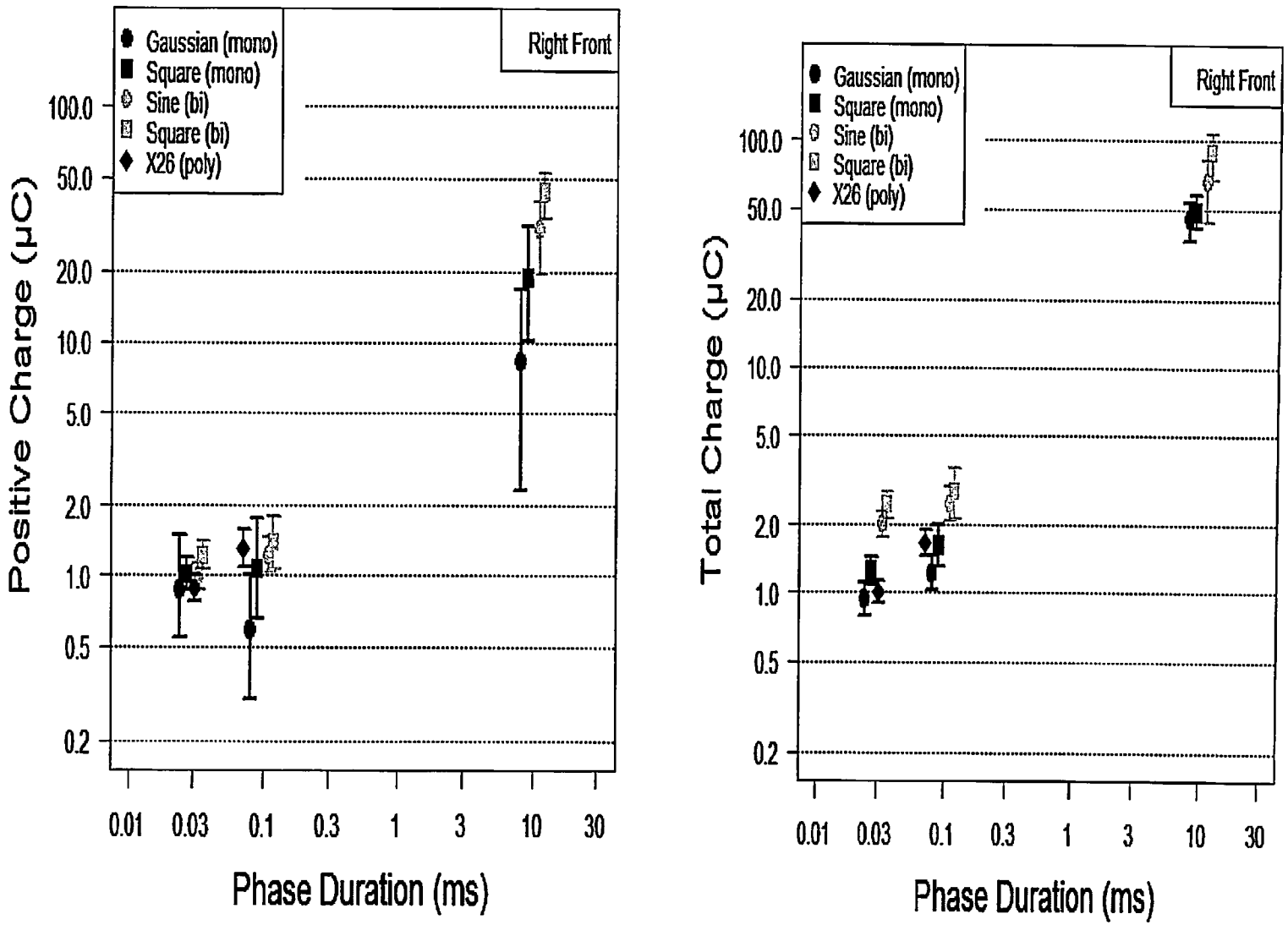
FIG. 7. Strength-duration relationships for the right front limb from the threshold pulse experiment for pulse positive charge, total charge, peak current, and energy. The $ED_{50}$'s with corresponding 95% fiducial limits are shown for each pulse waveform and phase duration tested. Results are not shown for the 10-ms polyphasic pulse for reasons explained in the text. For energy of the 10-ms sine pulse, the lower fiducial limit is 0.00017 mJ.
Figure 7:
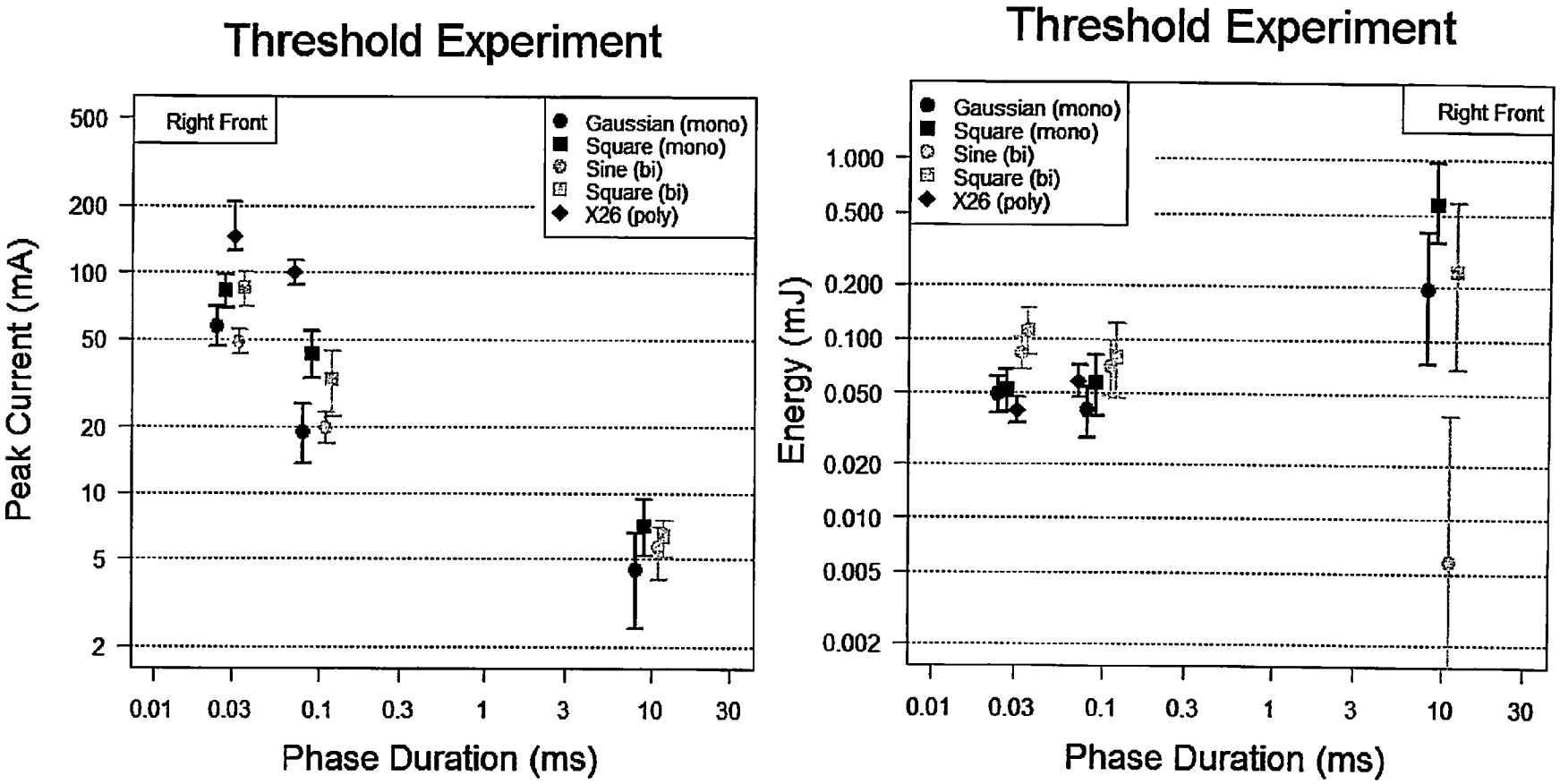

FIG. 7 presents the strength-duration relationships derived from four stimulus parameter $ED_{50}$'s ($ED_{50}$ is an estimate of the stimulus parameter amplitude with a 50% probability of producing a response). All waveform-duration combinations are represented except the 10 ms polyphasic pulse for which unreliable results were obtained. For 30-μs pulses, all estimated ED50's are near 1 μC and have overlapping fiducial limit ranges. For 100-μs pulses, ED50's are 1-1.4 μC except for the Gaussian, which was 0.59 μC. All pulses but the Gaussian has overlapping fiducial limit ranges. For 10-ms pulses, respective overlapping fiducial limit ranges are seen for Gaussian and monophasic square pulses, monophasic square and sine waveforms, and sine and biphasic square waveforms. The smallest to largest ED50 order for the 10-ms pulses is Gaussian, monophasic square, sine, and biphasic square, with values ranging from 8.3 to 43.5 μC. Positive charge increases as pulse duration increases. Positive charge of the 100-μs phase duration is 0.7-1.5 times of the 30-μs pulse duration, and the positive charge of 10-ms pulse duration are 9-36 times larger for the 10-ms pulse duration.

For ideal monophasic waveforms, one would expect total charge ED50's to be the same as the positive charge ED50's. In FIG. 7, this is observed for Gaussian and monophasic pulses for the 30-μs phase duration (i.e., about 1 μC). However, at 100-μs and 10-ms phase durations, the total charge ED50 is roughly 2-5 times larger than expected for these same pulses, most likely due to the non-ideal pulses used as stimuli. For ideal biphasic waveforms, one would expect total charge ED50's to be twice the positive charge ED50's based on a negative phase similar to the positive phase. In FIG. 7, this is seen to be the case for biphasic sine and square pulses at all three phase durations. The total charge polyphasic waveform ED50 is seen to be similar to the respective positive charge ED50: approximately 1 μC for the 30-μs phase duration and 1.3-1.7 μC for the 100-μs phase duration.

The peak current strength-duration graph based on ED50 in FIG. 7 was determined primarily for comparison with traditional strength-duration curves for pulsed stimulation of nerve and muscle. A similar trend of decreased ED50 is seen for waveform tested. The ED50's for the 30-μs phase duration are 56.7, 82.2, 48.3, 85.3, and 144.9 mA for the Gaussian, monophasic square, sine, biphasic square, and polyphasic waveforms, respectively.

The pulse energy ED50 in FIG. 7 was determined in order to make comparisons between waveforms as well as between phase durations. For the 30-μs pulse duration, the monophasic Gaussian and square pulses and the polyphasic waveform have overlapping fiducial limit ranges. The biphasic sine and square waveforms have overlapping fiducial limit ranges at 30 μs, with ED50's of 0.0833 and 0.1109 mJ (83.3 and 110.9 μJ), respectively, and their ED50's are larger than ED50's for the other three waveforms. For the 100-μs pulse duration, all five waveforms have overlapping fiducial limit ranges, an indication that their energy ED50's were not statistically different at this pulse duration. Note that for each waveform the ED50's for 30- and 100-μs phase durations have overlapping fiducial limit ranges, an indication that the ED50's were not different between the durations. For the 10-ms phase duration, fiducial limit ranges were considerably larger than for the shorter phase durations. The monophasic Gaussian and square pulses and the biphasic square waveform have overlapping fiducial limit ranges at the long duration and their ED50's range between 0.191 and 0.569 mJ (191 and 569 μJ).

Figure 8:
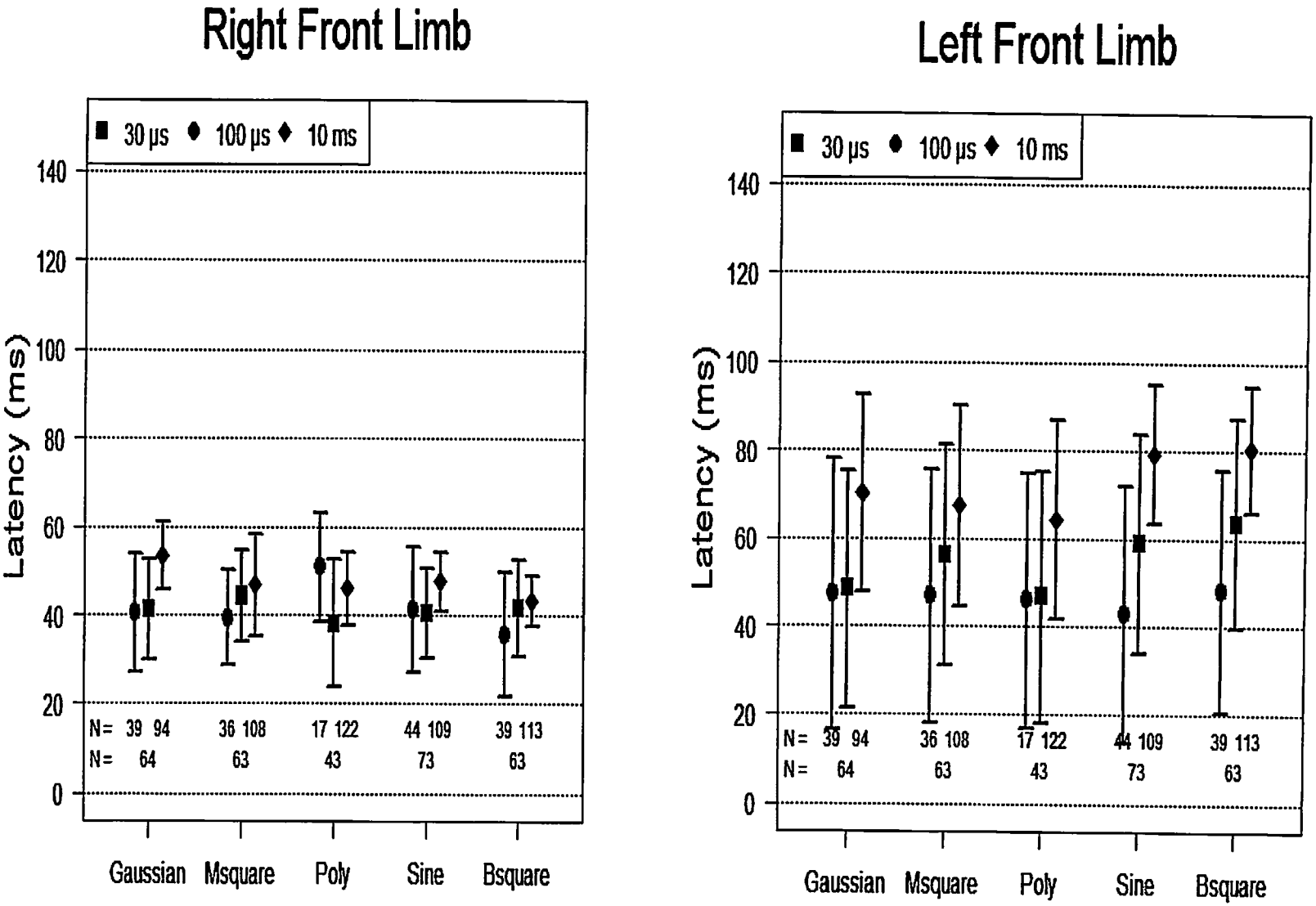
FIG. 8. Latencies to peak limb responses for different waveforms and phase durations tested in the threshold pulse experiment. These graphs utilize data from individual responses, the number of which is given at the bottom of each panel.
Figure 8:
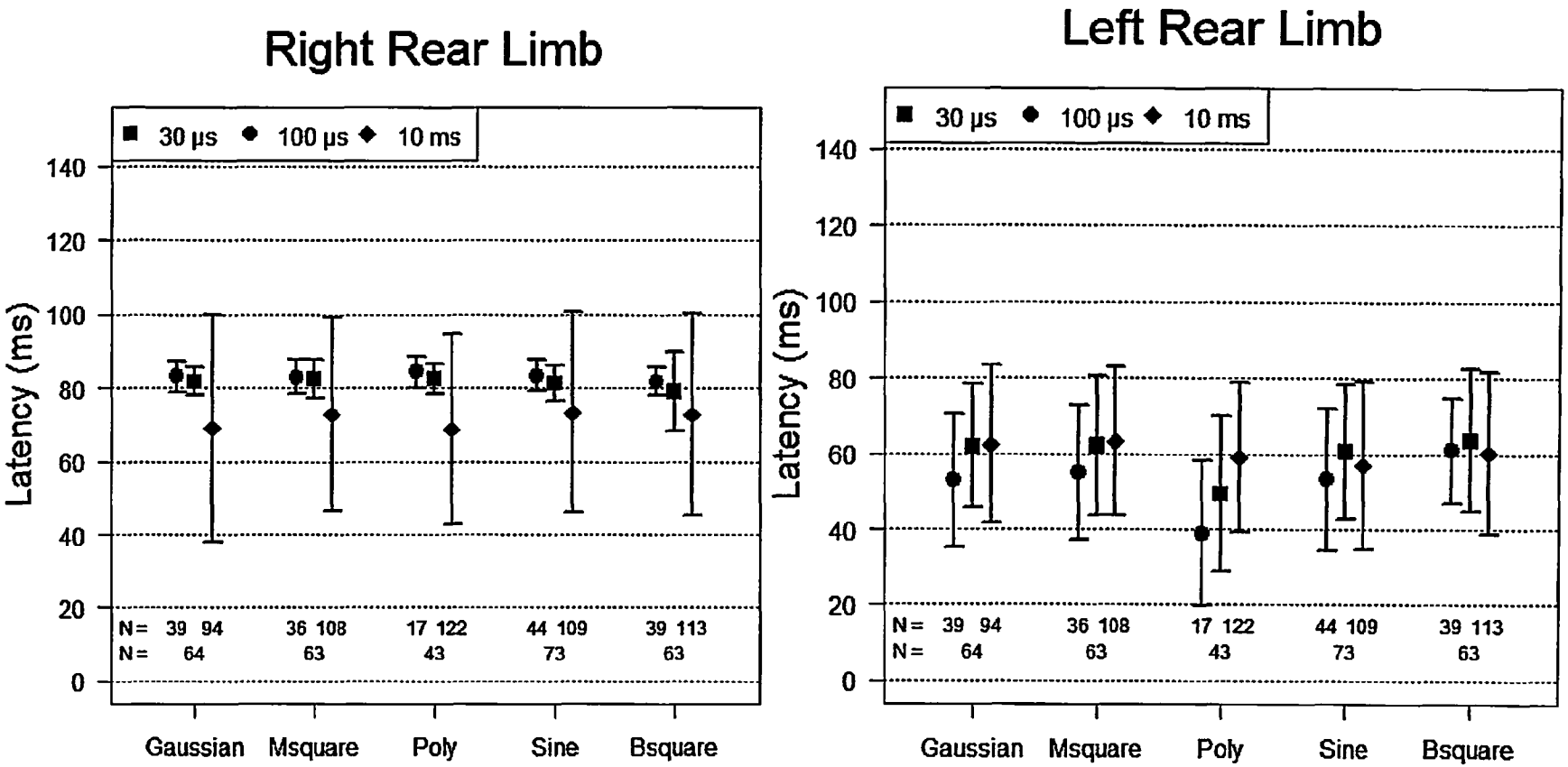

Latencies to peak of response for the threshold experiment are shown in FIG. 8 for each limb. Although these latencies are necessarily for suprathreshold responses in the experiment, they were quite variable resulting in large standard deviations. This variability is primarily due to the small responses and resulting uncertainty in identifying the response peak. For each limb, the latency is not obviously different across the five waveforms or the three phase durations.

Example 2

Monophasic Pulse Experiment

Four Yorkshire swine weighing 50-57 kg (53.0±3.6 kg, mean±SD) were used in the monophasic pulse experiment. They were positioned in dorsal recumbency. The Agilent AWG was used to drive a custom-made high voltage HEMI Stimulator fabricated by the James Franck Institute (University of Chicago, Chicago, Ill.) that was connected to the electrodes. The stimulator "output" terminal was connected to the rostral electrode with the wire passing through a Pearson current monitor. The stimulator "return" terminal was connected to the caudal electrode. The caudal electrode was grounded internally at the stimulator. Settings on the stimulator required manual adjustment each time the pulse waveform was changed. All pulses had a negative polarity (i.e., only a negative phase). The stimulator output was measured by a 1-MΩ channel of a TDS5104 Digital Phosphor Oscilloscope (Tektronix, Beaverton, Oregon, USA) using a Tektronix P5100 high voltage probe connected at the rostral electrode. A second 1-MΩ channel was connected to the Pearson current monitor.

Figure 3:
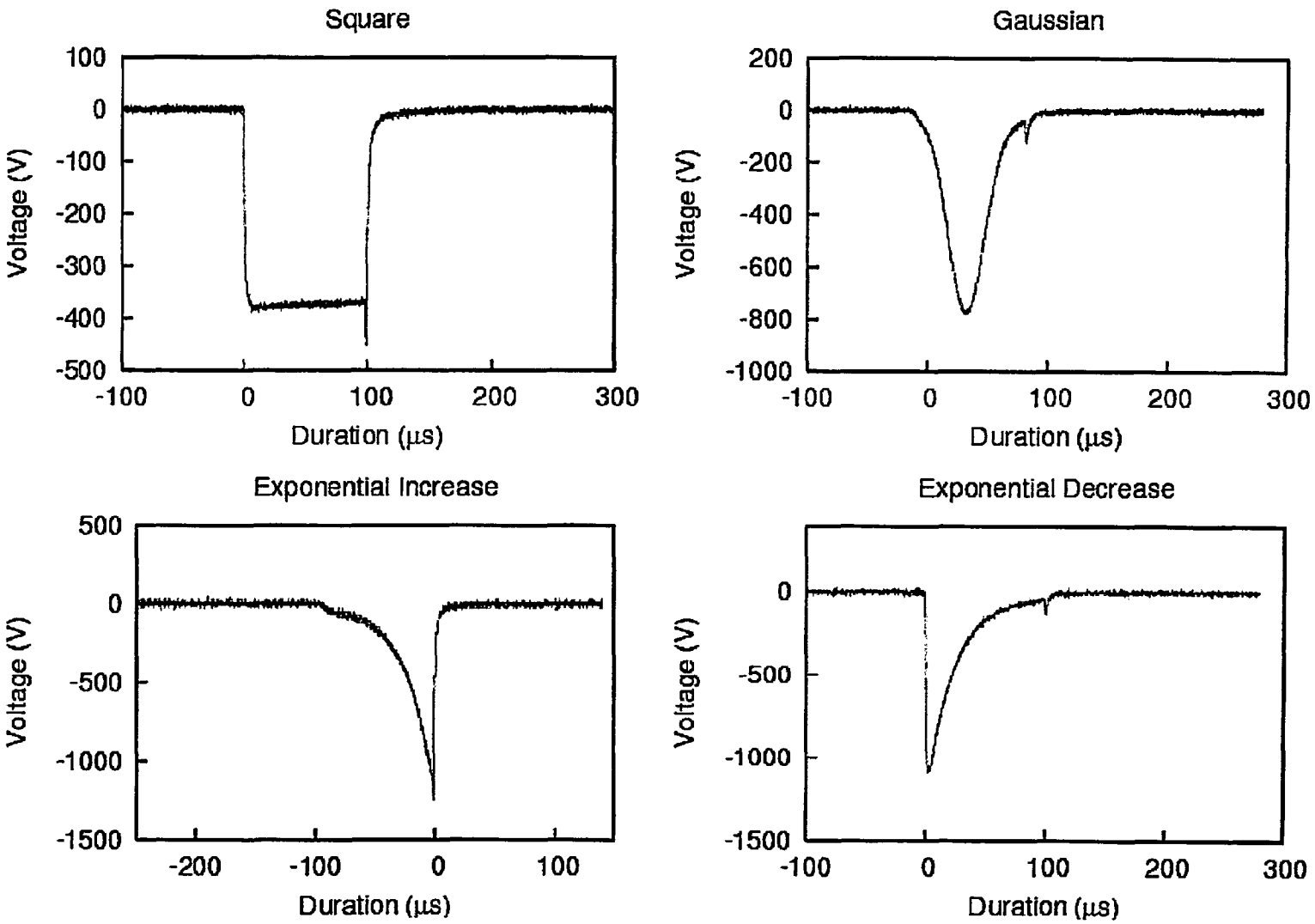

Four pulse waveforms were tested: square, Gaussian, increasing exponential, and decreasing exponential (FIG. 3). Durations of 20, 50, 100, and 250 μs were used for square and Gaussian pulses. Exponential pulses could be generated only for the 3 longest durations. Thus, 14 pulse waveforms were tested: 2 waveforms times 4 durations plus 2 waveforms times 3 durations. Under investigator control, the LabVIEW software written for this experiment selected programmed waveform settings in the Agilent AWG.

A suprathreshold square pulse, 100 μs and 405±65 V (mean±SEM), was applied to obtain a reference response. The average of peaks in 3 successive responses of the right front limb to this reference stimulus was considered a baseline peak to be matched in 2-3 subsequent series of stimuli. The baseline was determined before testing other waveforms and throughout testing to account for possible changes in responsiveness. The minimum time between successive stimulus applications was 90s.

A pulse waveform was tested for equivalence to the baseline by delivering it in a series of applications with different amplitudes. The peak of the right front limb response was scored as being either greater than or less than the baseline. A change in score between two successive applications was termed a crossing. Applications were repeated with amplitude adjusted to anticipate a crossing until 3-4 crossings were obtained. The stimulus parameter needed for a response equivalent to the preceding baseline was computed as the average of the parameter used in the last 3 crossings.

The criterion for a recorded force signal to be a response was a peak-to-peak force in a post-stimulus window of 100 ms greater than 2 times the peak-to-peak force in the 3 s preceding the stimulus. Programs written in R were used to determine which recorded waveforms met this criterion.

An estimate of the stimulus parameter amplitude with a 50% probability of producing a response ($ED_{50}$, ED=effective dose) was estimated by fitting response data with probit regression in SAS. Threshold of response is presented here for the right front limb, which shows the most reliable results (Seaman & Comeaux, 2007). $ED_{50}$ was determined for stimulus positive charge, total charge, peak current, and pulse energy.

Monitored physiological variables remained within acceptable ranges throughout experimental procedures. Over the 7 animals in the threshold pulse experiment the 15-min readings showed heart rate 77-154 bpm (109.1±15.7 bpm, mean±SD), respiration rate 15-46 breaths/min (29.0±7.4 breaths/min, mean±SD), oxygen saturation 86-99% (96.8±1.8%, mean±SD), and rectal temperature 36.6-38.6° C. (37.3±0.5° C., mean±SD).

Figure 9:
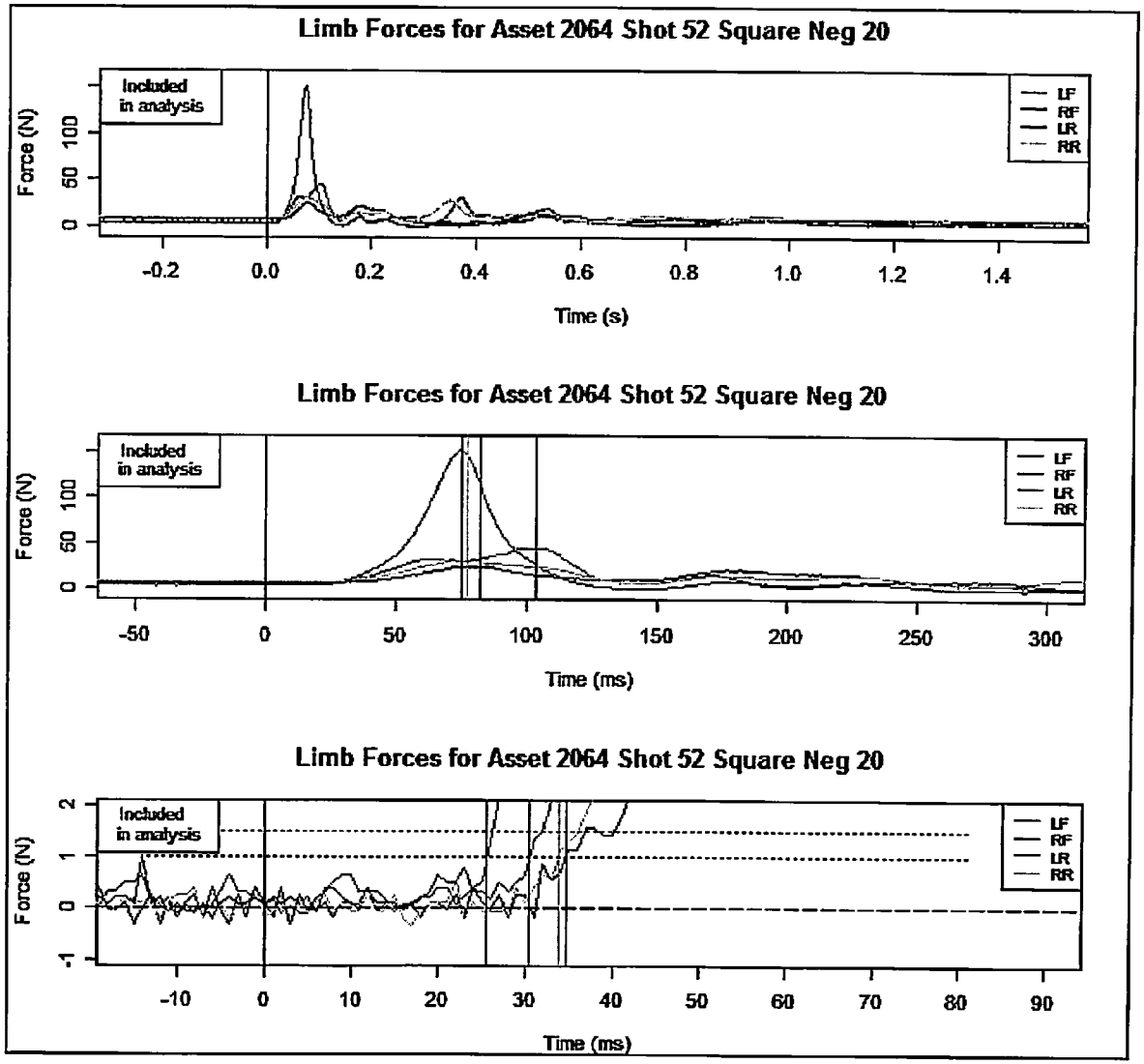
FIG. 9. Sample responses for monophasic square pulses of different durations. Stimulus application was at time 0. Each example has three graphs, each with a different time scale. The bottom graph in each panel includes threshold force and its multiple as well as a zero reference for the background-adjusted forces shown.

Sample responses to stimuli are shown in FIG. 9 to illustrate the range of amplitudes and temporal sequences observed in limb responses. In most cases, the right front limb provided the largest and seemingly earliest response and the left rear limb provided the next largest and next-to-earliest response. These limbs are located closest to the stimulating electrodes.

Figure 10:
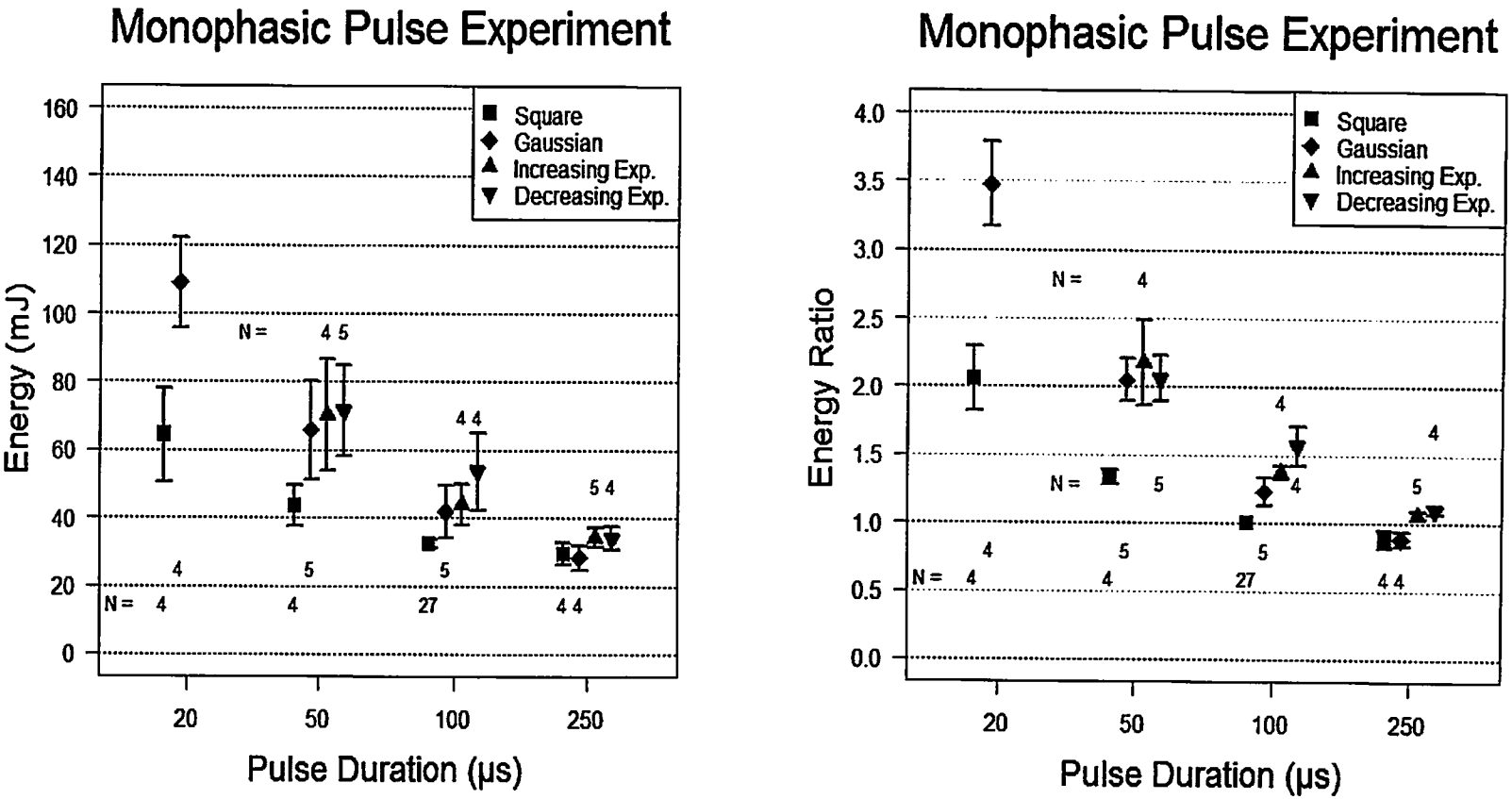
FIG. 10. Stimulus energy and total charge for the monophasic pulse experiment, including energy and energy normalized to the 100-μs pulse energy; charge and charge normalized to the 100-μs pulse charge. Mean±SEM.
Figure 10:
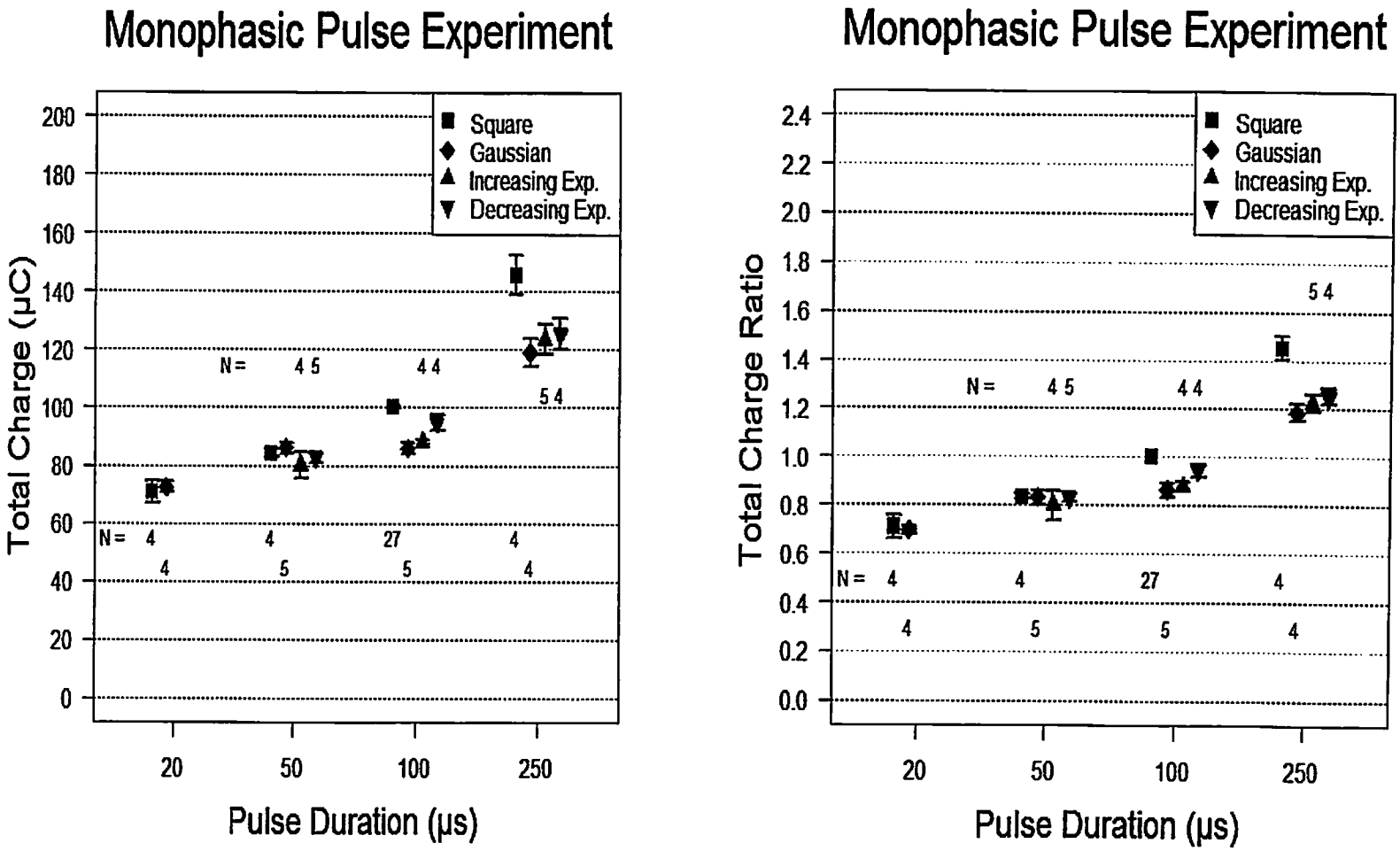

In FIG. 10, energy decreases with longer pulse duration for each pulse type. The square pulse has the lowest energy for 20-, 50-, and 100-μs durations and one of the lowest for the 250-μs duration. The Gaussian pulse has the same energy as the exponential pulses for 50- and 100-μs durations, but is somewhat smaller for the 250-μs duration. The linear mixed model used for testing had fixed effects of pulse type, pulse duration, and their interaction. Results of the mixed-model test indicated that pulse type and duration as well as their interaction were statistically significant (p's<0.001). No significant pair-wise difference was found for any pulse type between the 100- and 250-μs durations. At 250 μs, no pair-wise difference was found between energies of square and Gaussian pulses or between energies of increasing and decreasing exponential pulses. However, energies of square and Gaussian pulses were both smaller than both increasing and decreasing exponential pulses. These results also held for mixed-model testing of energy normalized to the energy of the 100-μs square pulse, with the exception that energies of the decreasing exponential pulse were all different from each other (i.e., a decrease with increasing duration).

In FIG. 9, pulse total charge increases with longer duration for each pulse type. Pulse types appear to have similar charge for each pulse duration, except that the charge of the square pulse is noticeably larger at 100- and 250-μs durations. Results of the mixed-model test indicated that pulse type, and duration as well as their interaction were significant (p's<0.001). Pulse type was not significant for 20- and 50-μs durations (i.e., total charge at each duration was not different among pulse types). At 100 μs and 250 μs, square pulse charge was larger than charge of the other three types of pulses.

Figure 11:
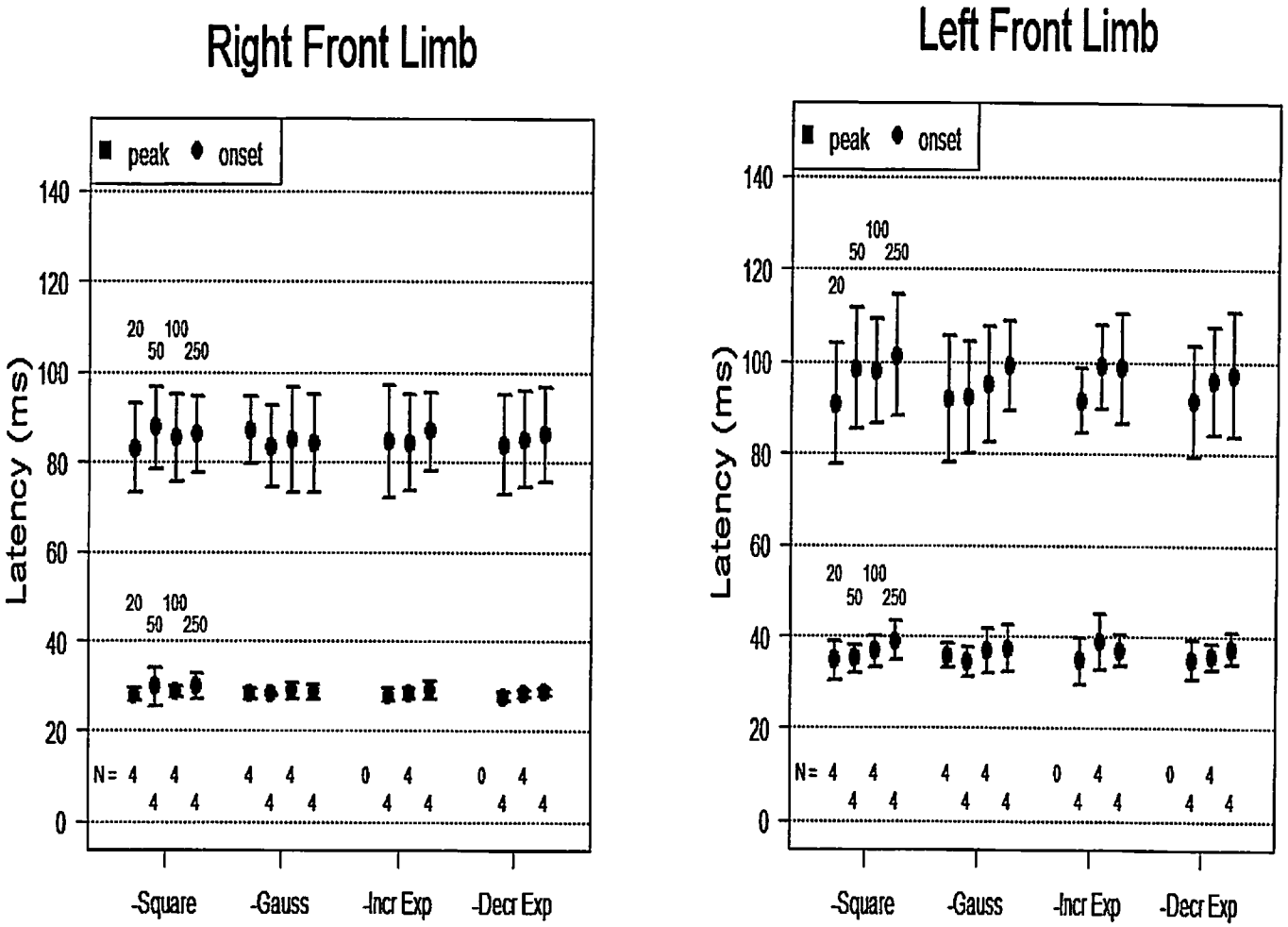
FIG. 11. Latencies to peak and latencies to onset for limb responses in the monophasic pulse experiment. These graphs represent one sample for each stimulus condition from each animal. Pulses had durations of 20, 50, 100, or 250 μs, the data for which appear in sequence for each pulse type. Pulse type is labeled with a negative sign as a reminder of the negative polarity of the stimuli. Increasing exponential and decreasing exponential pulses with 20-μs duration were not applied. Pounds of pull produced by each limb during stimulation with an X26. The right front limb (top line) is closest to the most anterior electrode.
Figure 11:
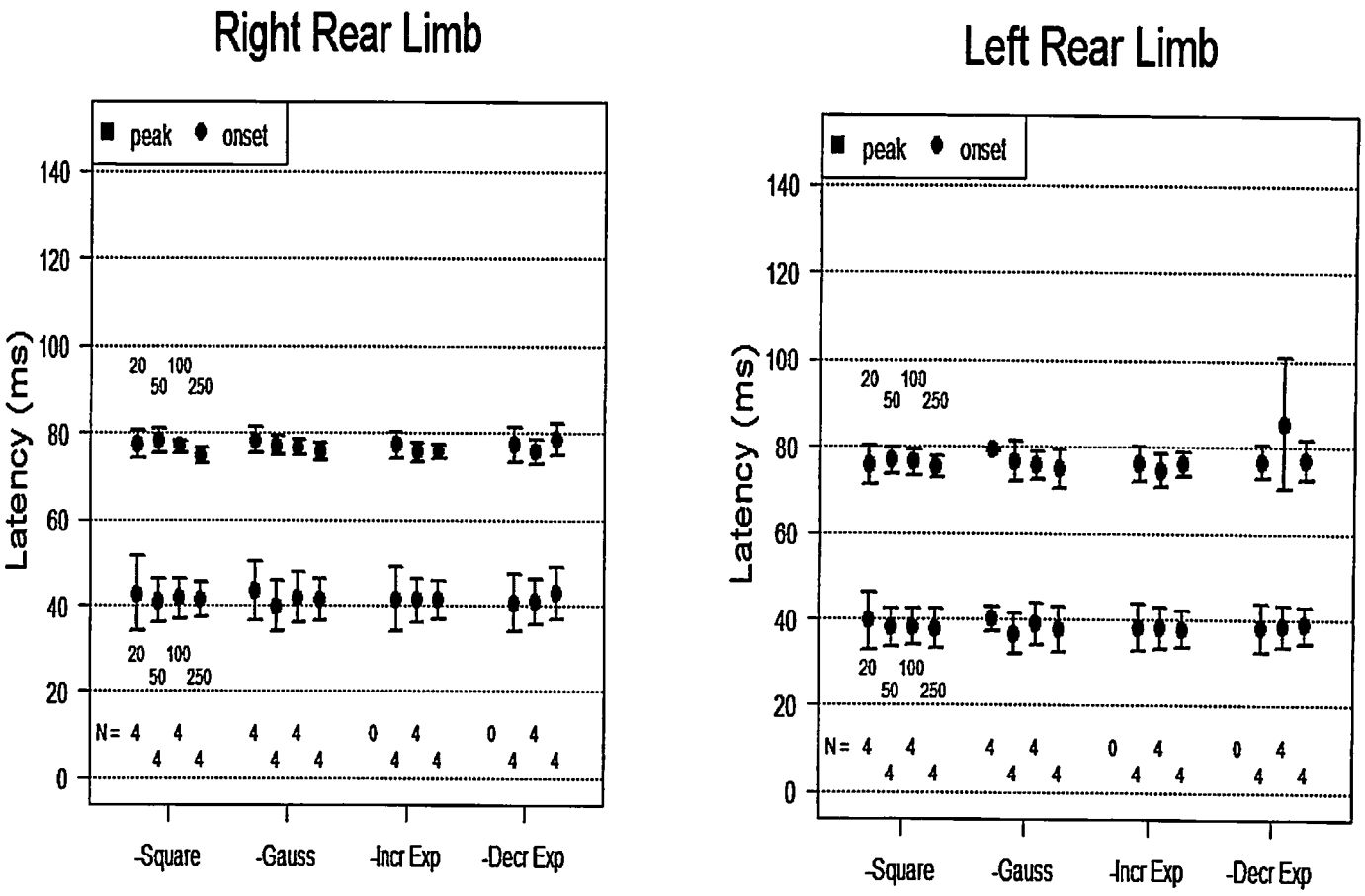

Latencies to onset and peak of the baseline response for the monophasic pulse experiment are shown in FIG. 11 for each limb. A latency sample was calculated as the average of latencies of the last three responses for each combination of pulse type and duration, which had peak right front limb responses near the baseline. Latency appears remarkably similar for each limb. Results of the mixed-model tests indicated pulse type and duration and their interaction were non-significant for latency for the right front, right rear, and left rear limbs.

Example 3

Biphasic Pulse Experiment

Five Yorkshire swine weighing 55-69 kg (59.8±5.5 kg, mean±SD) were used in the biphasic pulse experiment. They were positioned in dorsal recumbency. The Agilent AWG was used to drive a Model AWG188 high voltage source (North Star Power Engineering, Tucson, Ariz.). The output terminals of the transformer in the source were connected to the rostral and caudal electrodes such that a positive input from the Agilent AWG resulted in a positive voltage at the rostral electrode. The wire connected to the caudal electrode passed through a Pearson current monitor. The AWG188 output was measured by two 1-MΩ channels of a TDS5104 Digital Phosphor Oscilloscope (Tektronix, Beaverton, Oreg., USA) using two Tektronix P5100 high voltage probes, each connected to an output terminal. The differential voltage between these probes was considered the stimulus voltage. A third 1-MΩ channel was connected to the current monitor. There was no connection referencing the subject to ground.

Figure 4A:
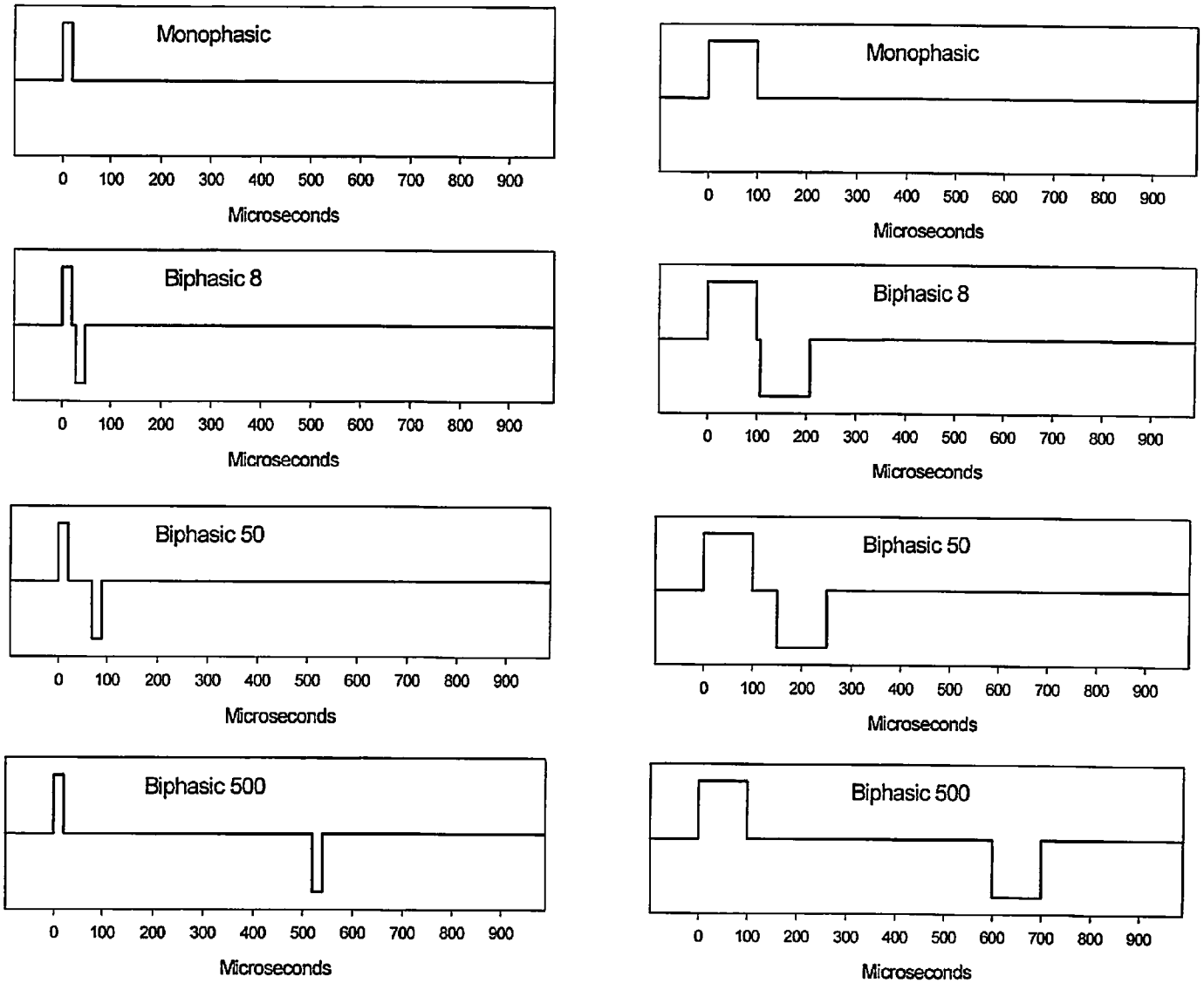
FIG. 4A. Pulse waveforms with positive initial phase tested in the biphasic pulse experiment. Top, left: Schematics of pulses with 20-μs phases and the indicated interphase delays. Top, right: Schematics of pulses with 100-μs phases and the indicated interphase delays. Bottom: An example of a current waveform from an oscilloscope recording for phase duration 20 μs and interphase delay of 50 μs. The 8-μs delay (second row) represented a minimum delay that was later measured to be closer to 6 μs.
Figure 4A:
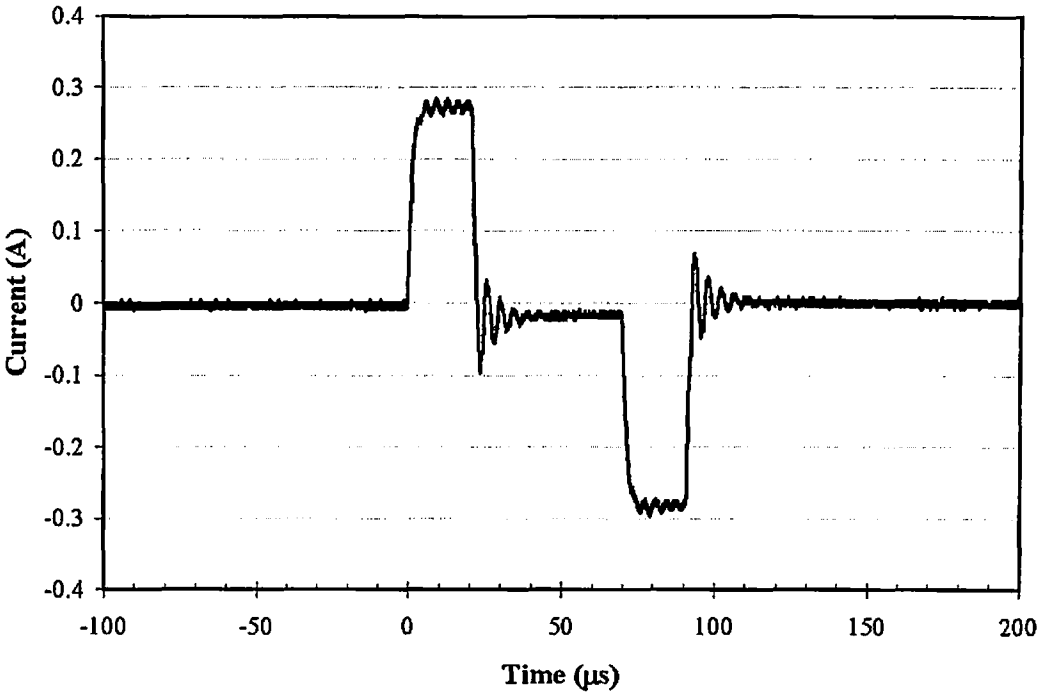
Figure 4B:
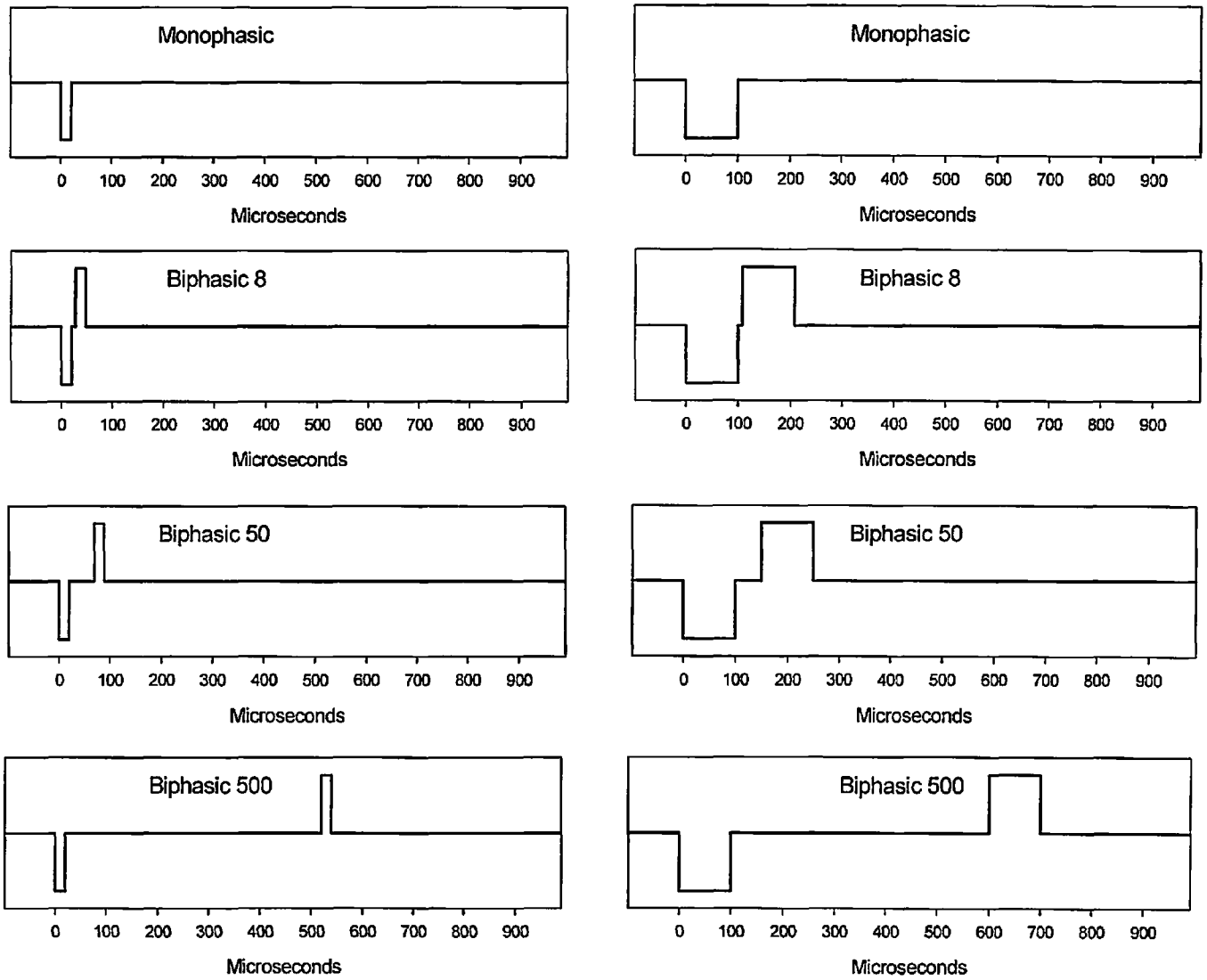
FIG. 4B. Pulse waveforms with negative initial phase tested in the biphasic pulse experiment. Top, left: Schematics of pulses with 20-μs phases and the indicated interphase delays. Top, right: Schematics of pulses with 100-μs phases and the indicated interphase delays. The 8-μs delay (second row) represented a minimum delay that was later measured to be closer to 6 μs.

Biphasic and monophasic waveforms with positive and negative polarities were tested (FIGS. 4A and 4B). Square pulses with durations of 20 and 100 μs were used as phases. Biphasic pulses had a leading phase consisting of a positive or negative pulse and a second phase consisting of a pulse with the same respective duration but opposite polarity. Interpulse, or interphase, delays of 0, 50, and 500 μs (off to onset) were used in biphasic pulses. The 0-μs phase delay actually measured about 6 μs at 50% peak amplitudes. Thus, 16 pulse waveforms were tested: 2 phase durations times 2 initial phase polarities times 4 patterns (monophasic, minimum delay, 50-μs delay, and 500-μs delay). Under investigator control, the LabVIEW software written for this experiment selected programmed stimulus waveform settings in the Agilent AWG.

A suprathreshold positive square pulse, 100 μs and 309±9V, (mean±SE) was applied to obtain a reference response. The average of 3 successive peaks of the right front limb response to this reference stimulus was considered a baseline peak to be used for 2-3 subsequent series of stimuli. The baseline was determined before testing other waveforms and throughout testing to account for possible changes in responsiveness. The minimum time between successive stimulus applications was 60 s.

An up-down method (Dixon, 1980) was used to determine the stimulus voltage corresponding to the comparable right front limb baseline response. The voltage was changed in a series of applications of a particular pulse waveform by 30 V for 100-μs pulses and 100 V for 20-μs pulses. The P50 value of the method was determined based on 5 stimulus applications, giving a standard error of about 0.61 times the step size.

Figure 12A:
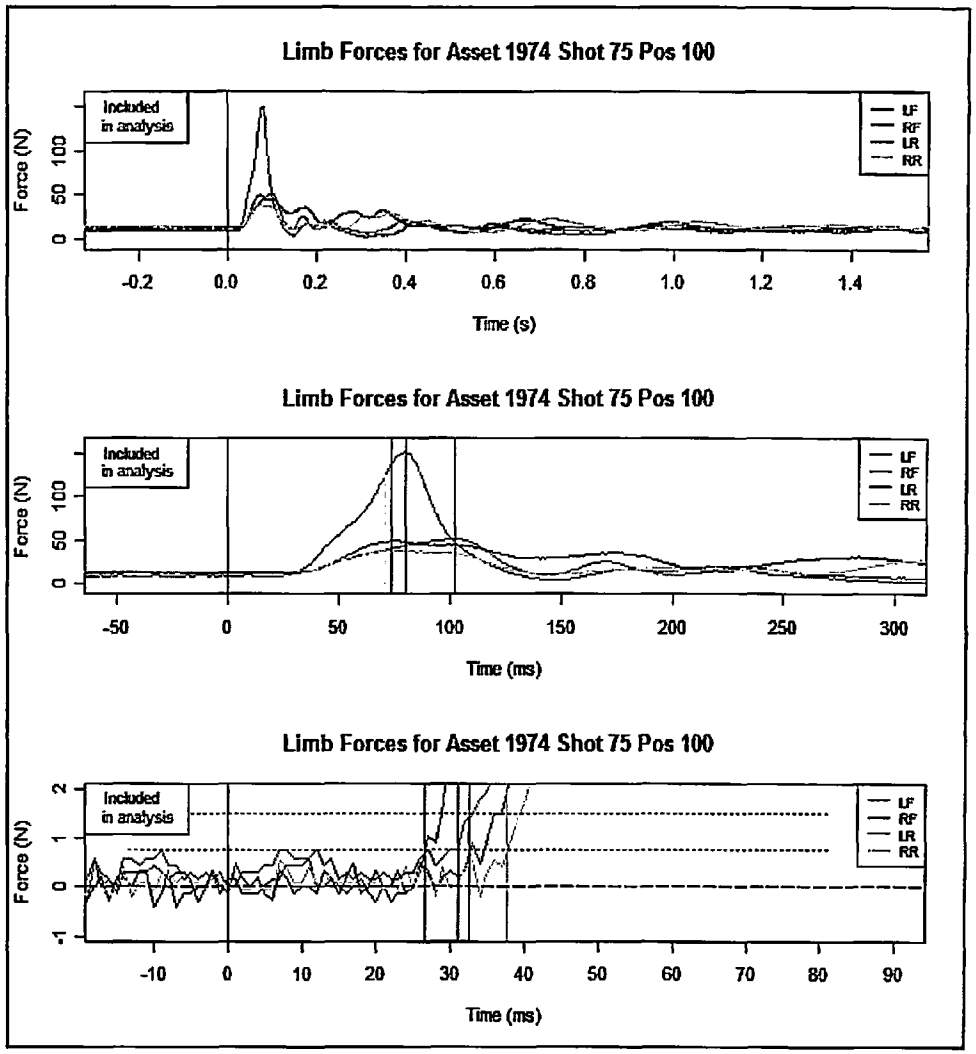
FIG. 12A. Sample responses from the biphasic pulse experiment shown at three different time scales. Stimulus application was at time zero.
Figure 12B:
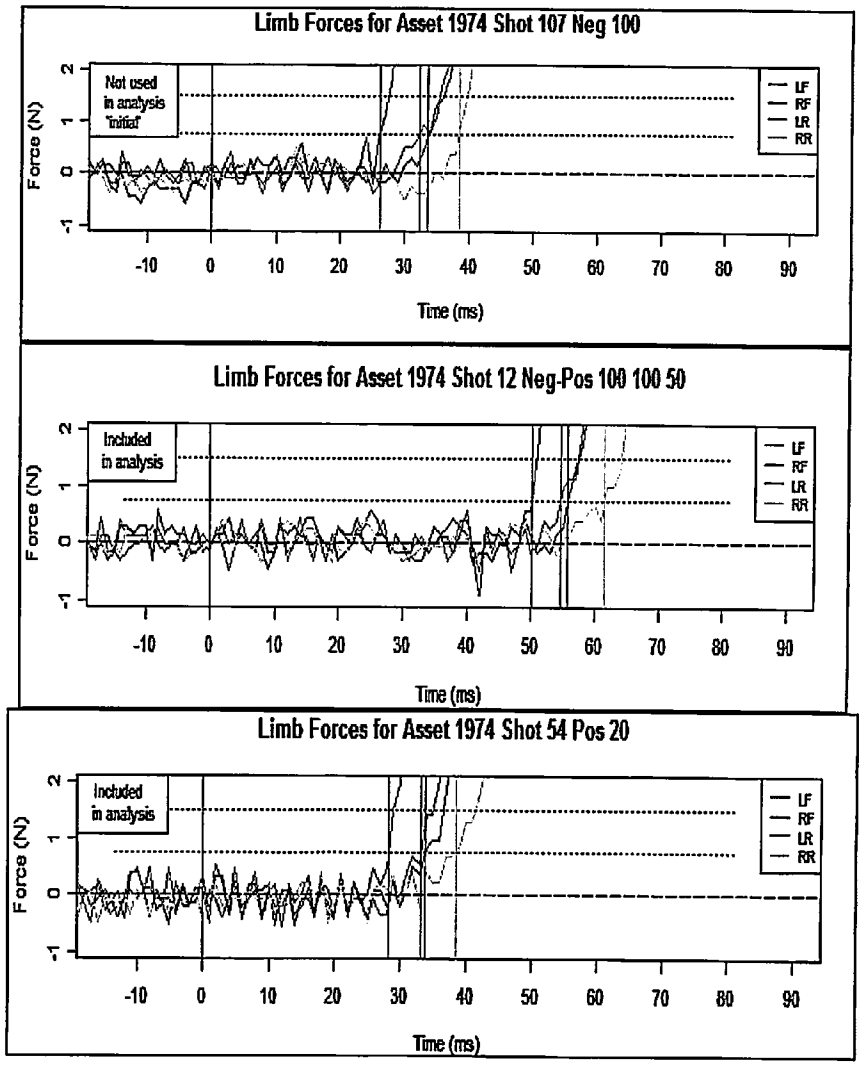
FIG. 12B. Shows latency differences for monophasic (top and bottom panels) versus biphasic pulses (middle panel).

Sample responses from the biphasic pulse experiment are shown in FIG. 12A-B. Because of the experimental design, peak right front force is nearly the same in all responses shown. These samples illustrate, in addition, that each response (4 limbs) has similar shape and time course (top panels) regardless of the stimulus waveform. However, consistent differences in latency appear between the monophasic stimuli and the biphasic stimuli. Longer onset latency and longer peak latency is observed for biphasic stimuli.

FIG. 12A-B shows sample response from the biophasic pulse experiments based on stimulus type (monophasic and biphasic with 3 interphase delays), phase duration, and initial phase polarity. FIG. 12A containing three graphs with different time scales, are responses to a monophasic pulse. FIG. 16B illustrates onset latencies to other monophasic pulses (left) and biphasic pulses (right). FIG. 12A shows threshold force and its multiple as well as a zero reference for the background-adjusted forces.

Figure 13:
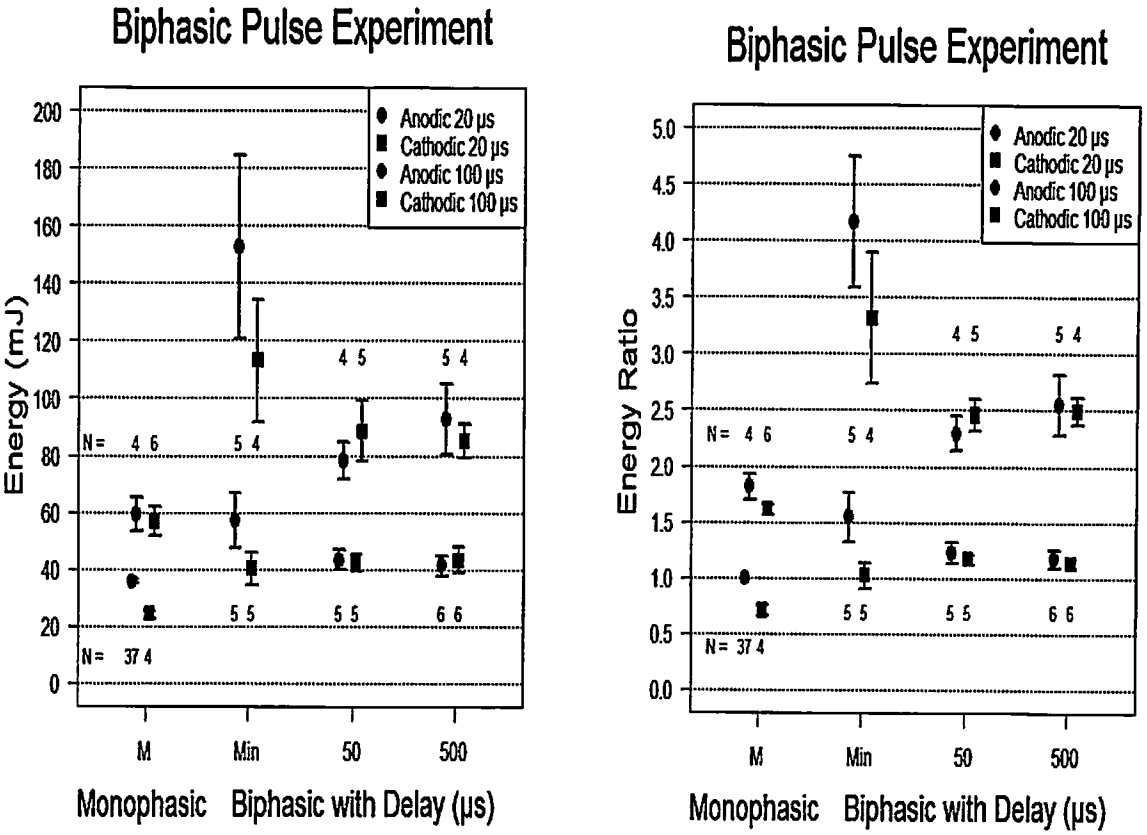
FIG. 13. Stimulus energy, energy ratio, total charge, and total charge ratio, (ratios were normalized to the results for a 100 μs monphanisc response), for the biphasic pulse experiment at three delays (labeled "Min, 50, and 500 μs) are compared to monophasic results (labeled "Monophasic" or "M"). Phase duration for both monophasic and biphasic results were 20 or 100 μs. Initial phase polarity was positive (anodic) or negative (cathodic).
Figure 13:
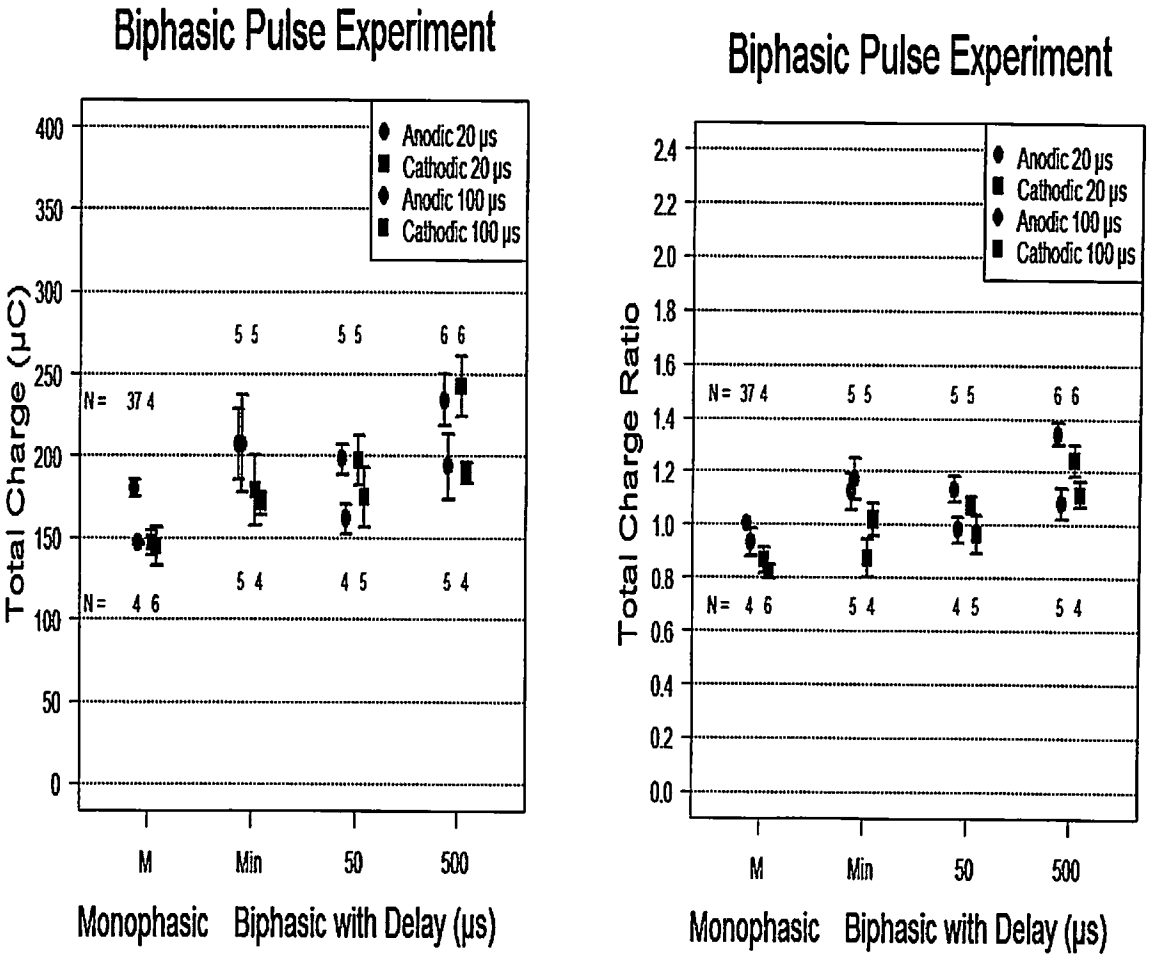

In FIG. 13, energy for the 100-μs phase duration (dark gray symbols) is smaller than for the 20-μs phase duration (black symbols). For each pulse duration, except for the monophasic 100-μs pulse, little difference is seen between positive and negative phase polarities. For all pulse duration, the monophasic pulse energy is smaller than energies of all biphasic pulses with the same phase duration.

The linear mixed model used for testing energy had fixed effects of initial pulse polarity, pulse duration, interphase delay, and their interactions. Results of the mixed-model test indicated that polarity ($p=0.033$), duration ($p<0.001$), and delay ($p<0.001$) were all significant. The polarity-delay interaction ($p=0.028$) and duration-delay interaction ($p<0.001$) were also significant. As already noted, the effects of duration and delay are evident in FIG. 13. Energy between positive and negative polarities was significantly different only for 100-μs monophasic pulses ($p<0.001$), with the negative pulse having lower energy.

Pair-wise comparisons for energy and energy ratio across pulse types generally reflected the differences seen in FIG. 13. The types are designated here by polarity and duration of monophasic and initial phase pulses. For positive 100-μs, energy for the minimum-delay biphasic pulse was larger than energy for the three other pulse types ($p\leq0.017$), which did not differ among them. For negative 100-μs, energy for the monophasic pulse was smaller than energy for the biphasic pulses ($p\leq0.025$). For positive and negative 20-μs, as for positive 100-μs, energy for the minimum-delay biphasic pulse was larger than energy for the three other pulse types ($p\leq0.005$ and $p=0.0052$, respectively), among which energy did not differ. For positive 100-μs, energy ratio had the same differences ($p\leq0.03$) as energy for 100-μs. For negative 100-μs, energy ratio for the monophasic pulse was smaller than energy ratio for biphasic pulses with interphase delays of 50 and 500 μs ($p\leq0.002$) but did not differ from the energy ratio for the minimum-delay biphasic pulse. For positive and negative 20-μs, as for positive 100-μs, energy ratio for the minimum-delay biphasic pulse was larger than energy ratio for the three other pulse types ($p\leq0.002$ and $p=0.0013$, respectively).

In FIG. 13, total charge seems to increase from monophasic to biphasic 500-μs delay for both phase durations, and the charge for 20-μs pulses (dark symbols) is the same as or smaller than charge for 100-μs pulses (grey symbols) of the same stimulus type. Polarity seems to influence the charge for 100-μs monophasic pulse.

Results of the mixed-model test indicated polarity ($p=0.020$), duration ($p<0.001$), and delay ($p<0.001$) were all significant. The polarity-delay interaction ($p=0.003$) and duration-delay interaction ($p<0.001$) were also significant.

Pair-wise comparisons for total charge and charge ratio across pulse types generally reflected the differences seen in FIG. 13. The types are designated here by polarity and duration of monophasic and initial phase pulses. For positive 100-μs, charge for the biphasic pulse with 500-μs interphase delay was larger than charge for any other pulse type ($p\leq0.048$), charge for the minimum-delay biphasic pulse was larger than charge for the monophasic pulse ($p=0.009$). For negative 100-μs, charge for the biphasic pulse with 500-μs interphase delay was larger than charge for any other pulse type (p's<0.001), charge for the biphasic pulse with 50-μs interphase delay was larger than charge for the monophasic pulse ($p=0.014$). For positive 20-μs, charge for the minimum-delay biphasic pulse was larger than charge for the monophasic pulse ($p=0.011$), but this was the only significant difference. For negative 20-μs, charge for the monophasic pulse was smaller than for the minimum-delay biphasic pulse. For positive 100-μs, except between the minimum-delay biphasic pulse and the biphasic pulse with 500-μs interphase delay, all pair-wise differences of charge ratio were significant ($p\leq0.030$), reflecting an increase from monophasic pulse to biphasic pulse with the longest interphase delay.

Figure 14:
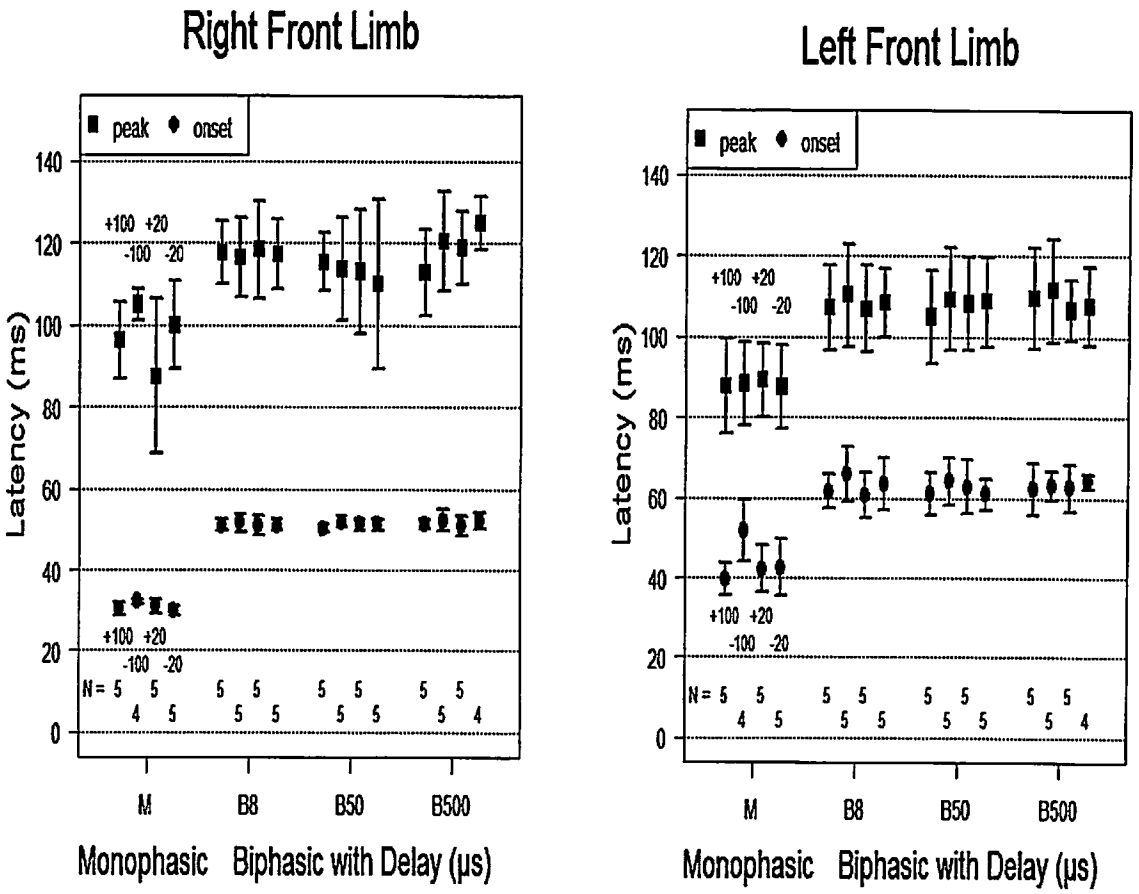
FIG. 14. Latencies to peak and latencies to onset for each limb responses in the biphasic pulse experiment. Monophasic results are shown for comparison in the left side of each panel. These graphs represent one sample for each stimulus condition from each animal. Stimuli were monophasic or biphasic with the indicated interphase delay. B8 refers to biphasic stimuli with minimum interphase delay. Stimuli had either 20- or 100-μs phase duration and either positive or negative initial FIG. 15. Sample responses from the pulse burst experiment. Application of each pulse is indicated by a tick near the time axis. The vertical lines demark the nominal burst duration. Examples are from one animal and are typical of responses of other animals. One time scale is used in all panels. The top two panels are represent responses to single pulses while the bottom two represent responses to bursts at 10 Hz and 20 Hz.
Figure 14:
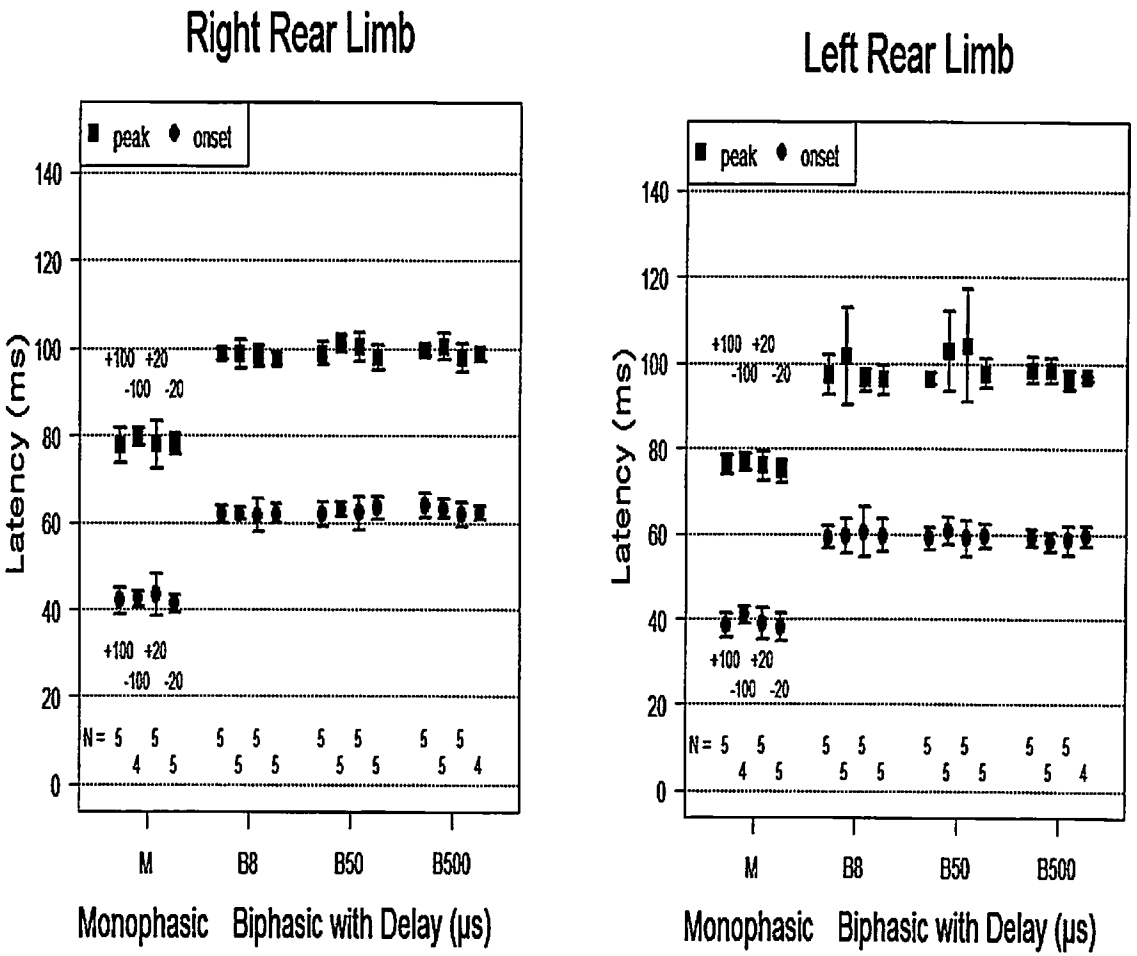

Latencies to onset and peak of the baseline response for the biphasic pulse experiment are shown in FIG. 14 for each limb. A latency sample was calculated as the average of latencies of the last three responses for a given combination of initial phase polarity, phase duration, and interphase delay, which had peak right front limb responses near the baseline. Graphs of the latencies to a larger number of selected responses in this experiment are in FIG. 14. A contributor to the variability in the peak latency of right front and left front limbs was the tendency for responses of these limbs to exhibit two peaks separated by 10's of milliseconds rather than a single peak. The larger of the two peaks would sometimes be the first peak and sometimes the second peak. In FIG. 14, both onset latency and peak latency of responses to monophasic stimuli are seen to be smaller than respective latencies of responses to biphasic stimuli for each limb. This is consistent with observations made on the sample responses in FIG. 12. These differences due to stimulus type seem to be considerably larger than any difference due to initial phase polarity or phase duration.

In pair-wise testing of onset latency differences for each limb, the monophasic pulse had a latency smaller than the latency of any biphasic pulse (p's<0.001). In addition, latencies of biphasic pulses did not differ among different interphase delays (p's>0.071).

Results of the linear mixed model tests on peak latency revealed that interphase delay (stimulus type) was a significant effect for all four limbs (p's<0.001). In pair-wise testing of peak latency differences for each limb, the monophasic pulse had a latency smaller than the latency of any biphasic pulse (p's<0.001).

Example 4

Pulse Burst Experiment

Four Yorkshire swine weighing 51-63 kg (55.3±5.7 kg, mean±SD) were used in the pulse burst experiment. They were positioned in dorsal recumbency. The Agilent AWG was used to activate a DEI Model PVM-4150 high voltage switch (Directed Energy, Inc, Fort Collins, Colorado, USA) powered by a Lambda Gen600 600 V power supply (Lambda Americas, Neptune, N.J., USA). The center conductor of the coaxial output of the switch was connected to the rostral electrode with the wire passing through a Pearson current monitor. The shield of the coaxial output, which was grounded within the DEI unit, was connected to the caudal electrode. All applied pulses had a positive polarity (i.e., only a positive phase). The DEI output was measured by a 1-MΩ channel of a TDS5104 Digital Phosphor Oscilloscope (Tektronix, Beaverton, Oreg., USA) using a Tektronix P5100 high voltage probe connected at the rostral electrode. A second 1-MΩ channel was connected to the current monitor.

Figure 5:
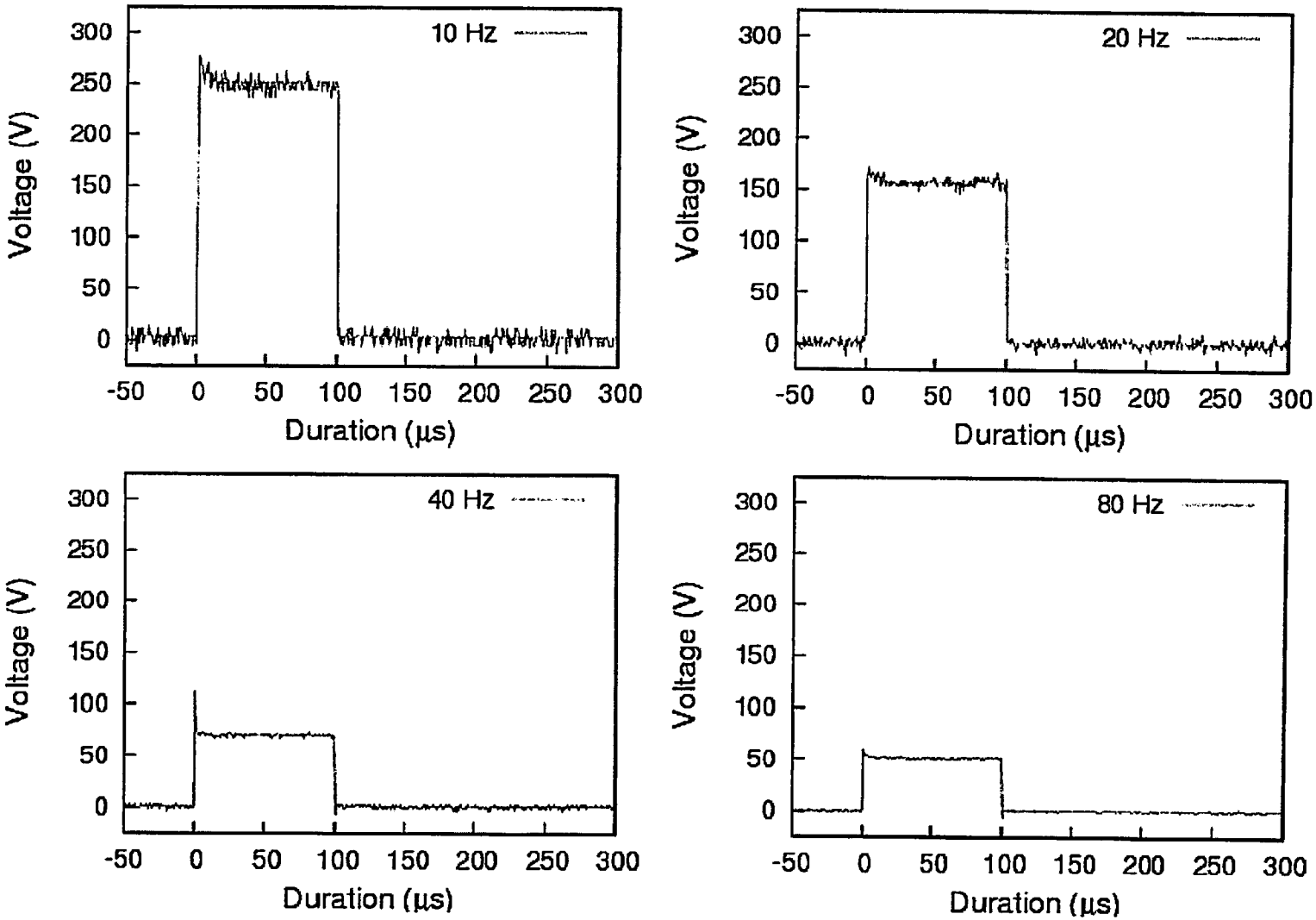
FIG. 5. Examples of pulse waveforms tested in the pulse burst experiment for different pulse repetition frequencies.

Only one pulse waveform (100 μs square) was used (FIG. 5). The waveform was applied individually at 100 μs and 285±0.3V (mean±SE) to obtain a reference baseline response. It was also applied at pulse repetition frequencies (PRFs) of 10, 20, 40, and 80 Hz in two types of bursts. In one type of burst, 10 pulses were applied, resulting in 4 different burst durations: 10/10=1 s, 10/20=0.5 s, 10/40=0.25 s, and 10/80=0.125 s, for PRFs of 10, 20, 40, and 80 Hz, respectively. In the other type of burst, the duration was set at 1 s and the number of pulses varied with the PRF. Thus, 9 types of pulsed stimuli were tested: single pulse, 4 bursts of 10 pulses at different PRFs, and 4 1-s bursts at different PRFs. The minimum time between successive stimulus applications was 90 s. Under investigator control, the LabVIEW software written for this experiment selected programmed stimulus burst settings in the Agilent AWG to apply to the DEI switch.

As in the monophasic experiment, a baseline response for comparison was determined as the average of peaks in 3 successive reference responses of the right front limb. The baseline was determined before testing other waveforms and throughout testing to account for possible changes in responsiveness. A burst was tested for equivalence to the preceding baseline as done in the monophasic experiment. This involved adjusting stimulus amplitude to obtain 3-4 crossings of response peak with the baseline. The stimulus parameter needed for a response equivalent to baseline was computed as the average of the parameter used in the last 3 crossings. Monitored physiological variables remained within acceptable ranges throughout experimental procedures. Over the 4 animals in the pulse burst experiment the 15-min readings showed heart rate 93-174 bpm (113.4±16.2 bpm, mean±SD), respiration rate 12-78 breaths/min (35.4±14.3 breaths/min, mean±SD), oxygen saturation 87-98% (95.0±3.5%, mean±SD), and rectal temperature 37.2-38.1° C. (37.6±0.2° C., mean±SD).

Figure 15:
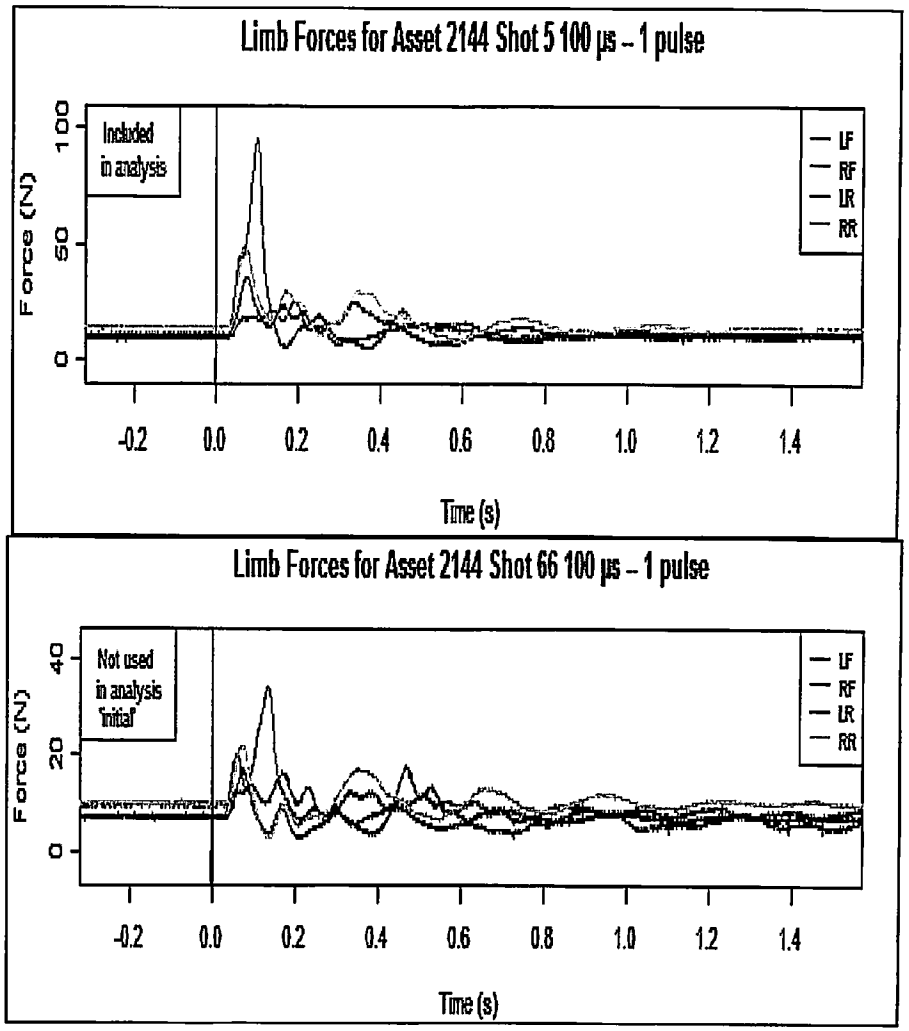
Figure 15:
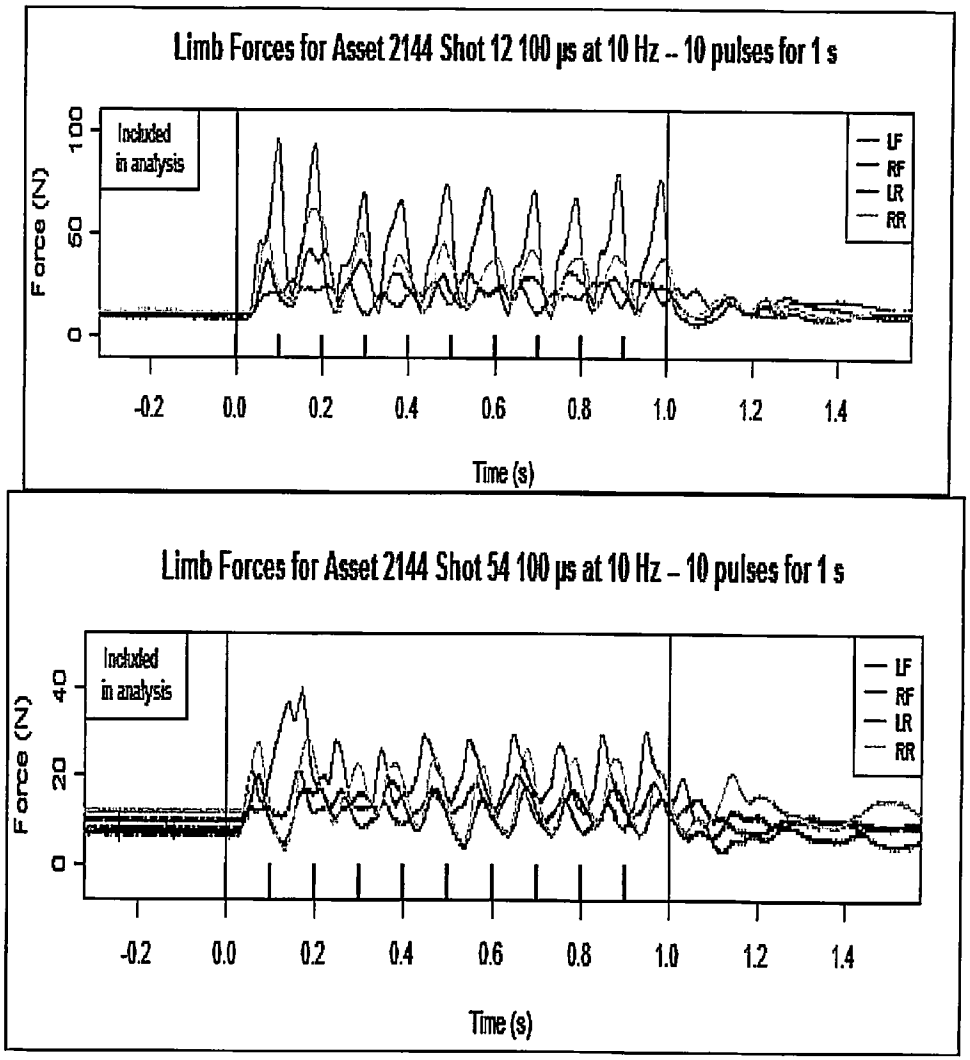

Sample responses from the pulse burst experiment are shown in FIG. 15. In this experiment, pulses were all 100-μs positive monophasic pulses and bursts contained multiple pulses.

Figure 16:
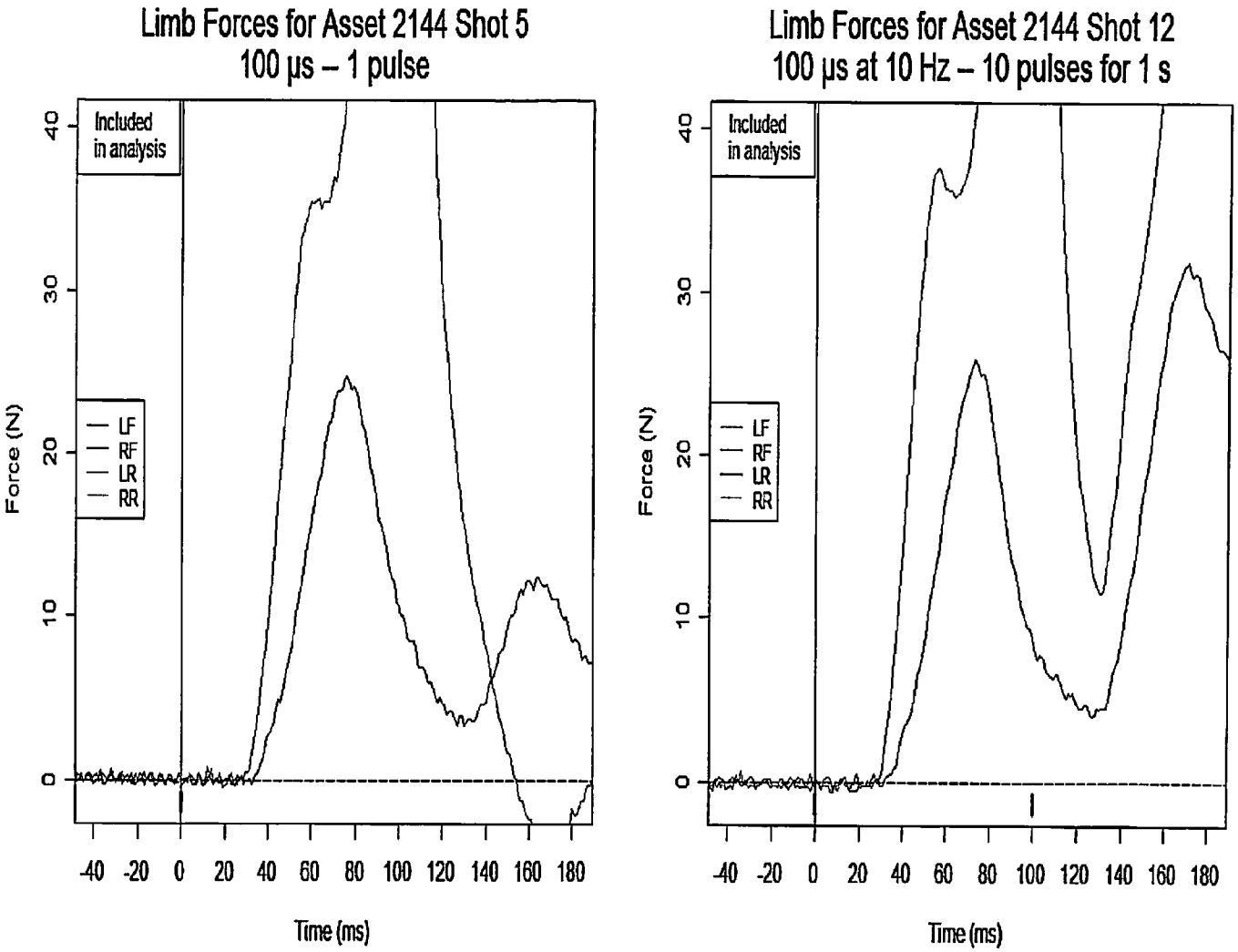
FIG. 16. Onsets of sample responses from the pulse burst experiment. These responses are the right front and left rear limb responses. The top panel shows the responses to a single pulse with subsequent panels showing the responses to 10 pulses presented at 10 Hz, 20 Hz, and 40 Hz.
Figure 16:
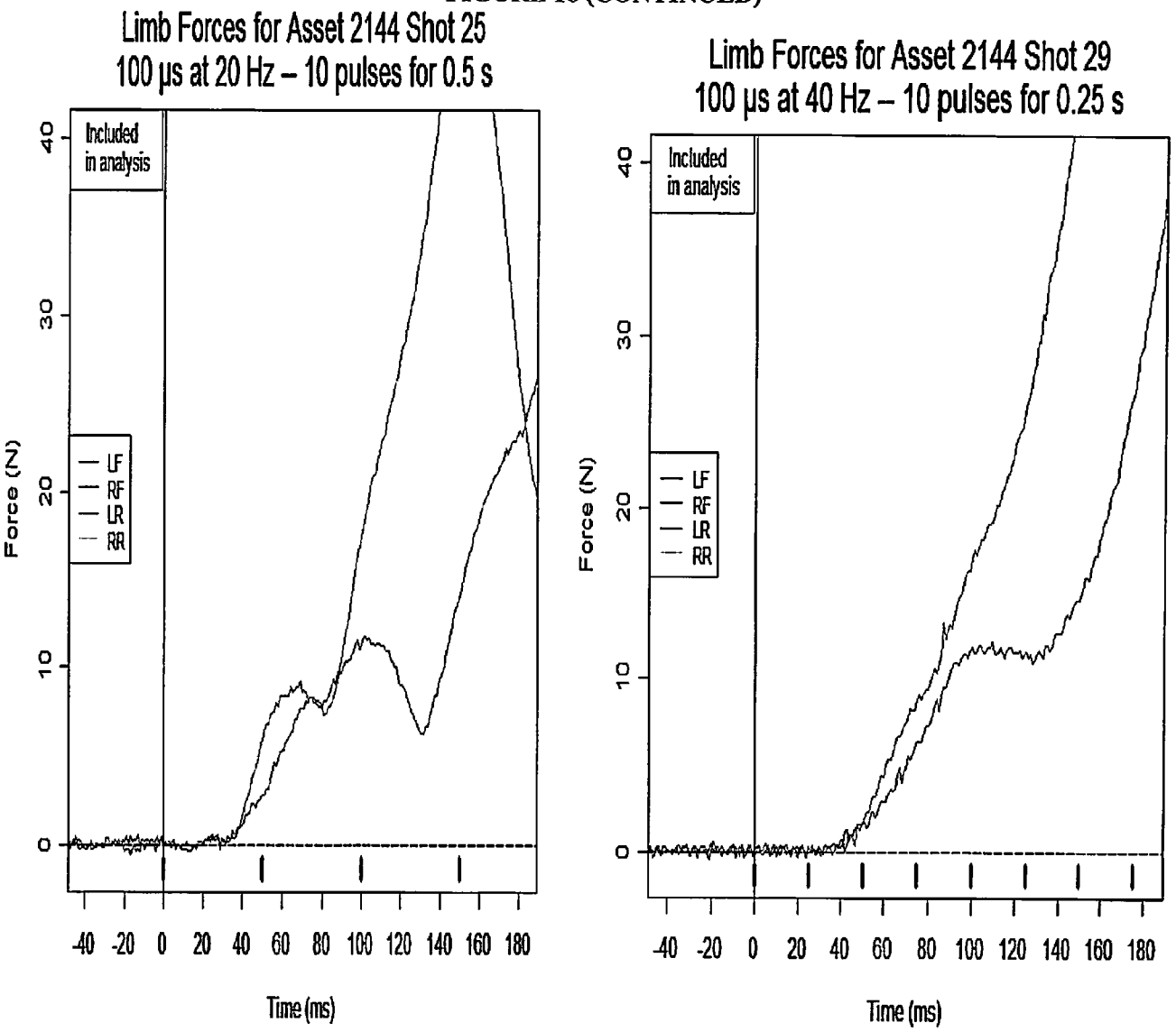

FIG. 16 shows the onsets of responses on an expanded time scale. These are the right front and left rear limb responses. The onsets of responses to the single pulse (top) and the 10-Hz burst (middle left) are nearly identical for about 120 ms after the pulse delivered at time 0. The response to the second pulse in the 10-Hz burst seems to initiate at around 130 ms, which is before the response to the first pulse has ended. The response to the second pulse in the 20-Hz burst is also evident, while the response to the next pulse might only be reflected in the change of response slope around 110 ms. Responses to the 40- and 80-Hz bursts (bottom) are similar in shape and time course with little or no indication of responses to individual pulses.

Figure 17A:
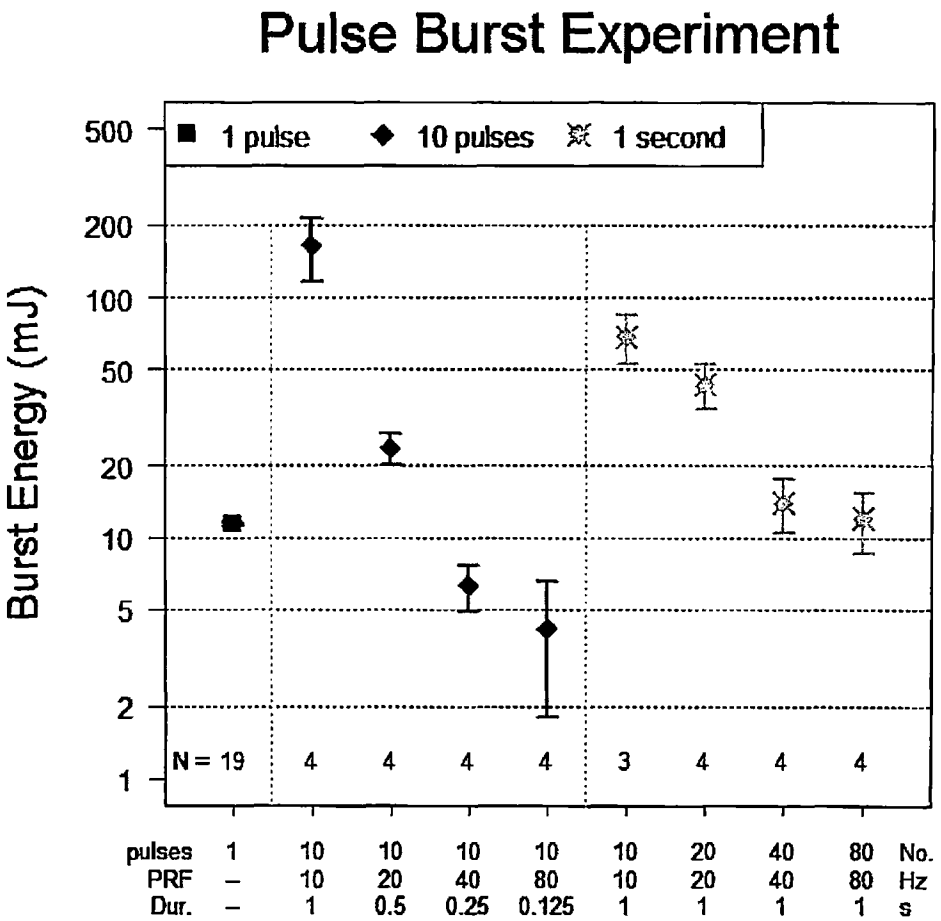
FIG. 17A. Stimulus energy for the pulse burst experiment. The vertical lines divide a graph by the type of stimulus applied: single pulse, 10 pulses, and 1-s. Top: Burst energy.
Figure 17B:
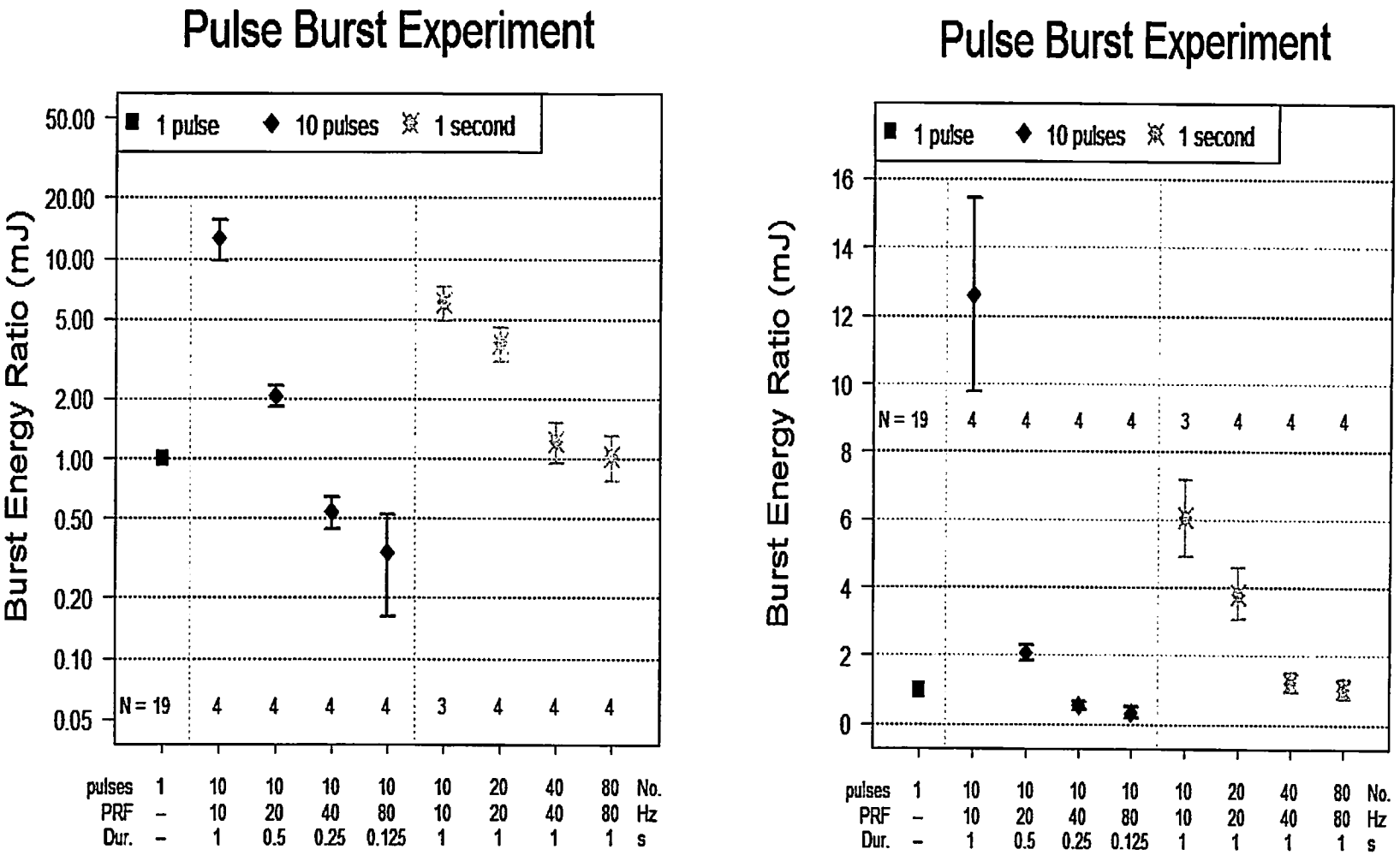
FIG. 17B. Burst energy normalized to energy of the single 100-μs pulse on a logarithmic scale (top) and a linear scale (bottom).
Figure 18A:
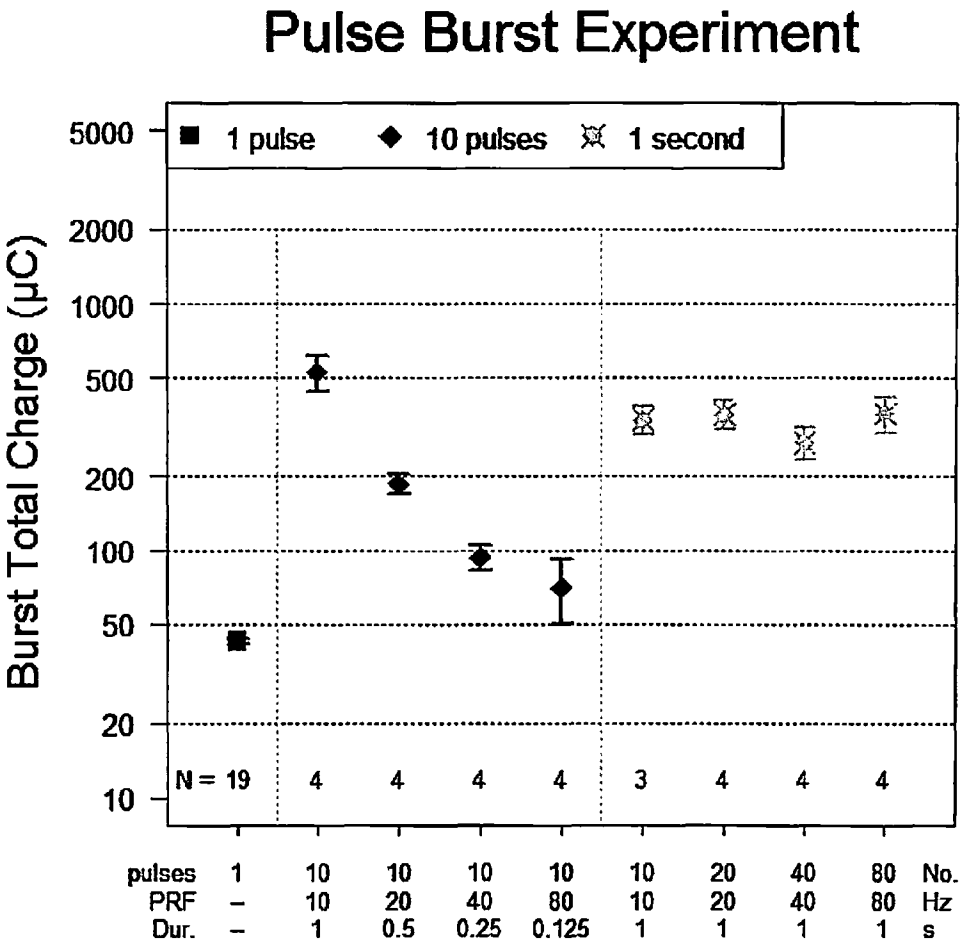
FIG. 18A. Stimulus total charge for the pulse burst experiment. The vertical lines divide a graph by the type of stimulus applied: single pulse, 10 pulses, and 1-s. Top: Burst Charge.
Figure 18B:
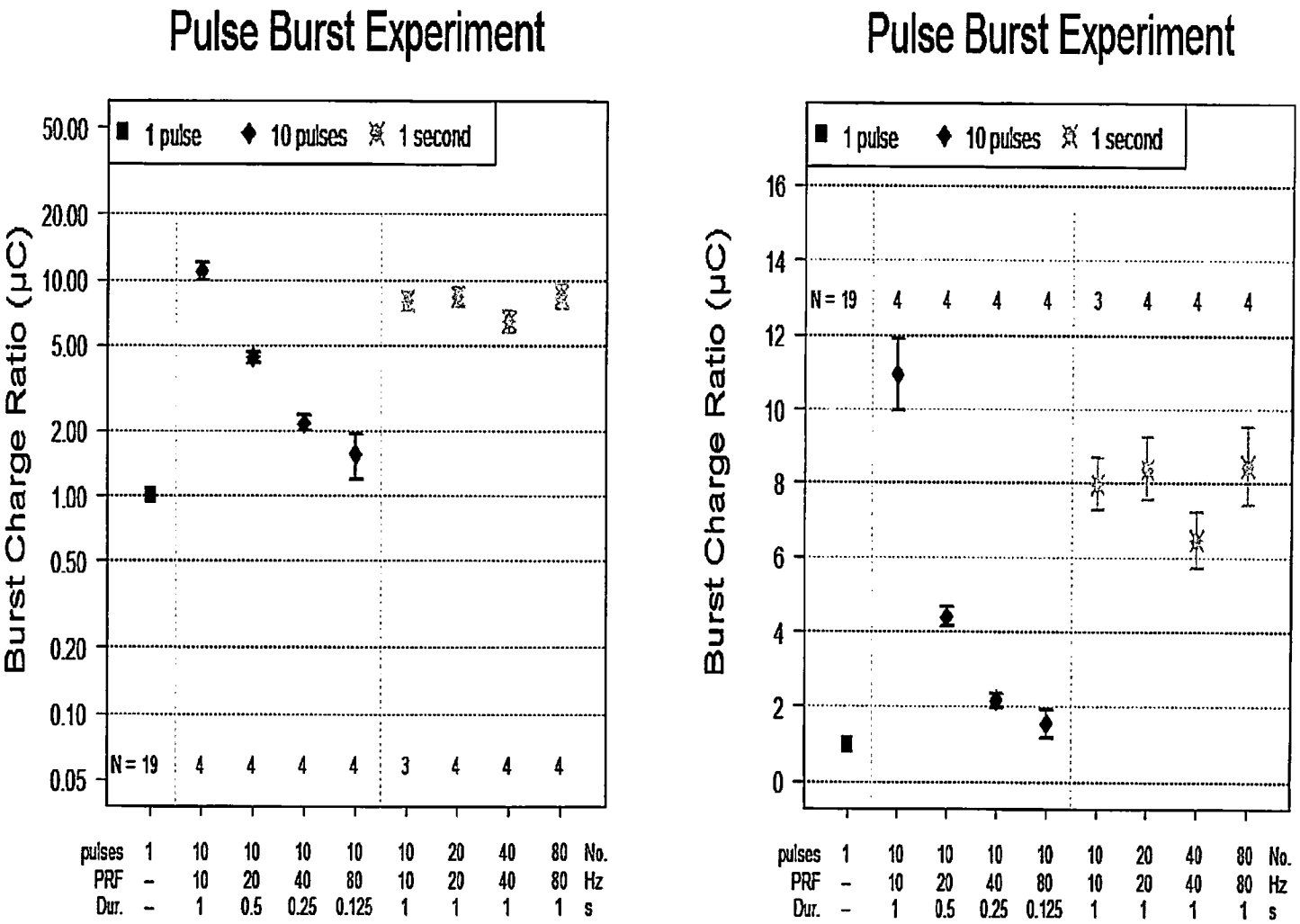
FIG. 18B. Top and Bottom: Burst charge normalized to charge of the single 100-μs pulse on a logarithmic scale and a linear scale, respectively.

FIGS. 17A-B and 18A-B show, respectively, energy and total charge eliciting the baseline peak response for the single pulse and pulse bursts in FIG. 17A/18A. The ratio of the measure in each burst type to the measure in the single pulse is shown in the FIG. 17B/18B using logarithmic and linear scales. These graphs and the analysis of stimulus data are based on 4-5 values for the single pulse and a single value for each burst type from each animal. A response to 10 Hz for 1 s was not obtained from one animal.

In FIG. 17, the energy for 10 pulses at 10 Hz was 12-13 times the energy of the single pulse. If responses to individual pulses with the same energy were completely separated, we could expect 10 times the single-pulse energy for a burst of 10 pulses. This is because if one pulse of the burst has the single-pulse energy sufficient to elicit the peak response, the other nine pulses would not affect the peak or have the same peak, resulting in 10 times the stimulus energy for the same peak response. The multiplying of energy by the number of pulses does not apply to responses that are not separated in time. This is the case for pulses at higher repetition frequencies, for which responses to individual pulses are additive to a degree depending on repetition frequency. At 20 Hz in this experiment, the responses to sequential pulses are evident and partially additive. At 40 and 80 Hz, the initial increases in response follow a similar time course and do not exhibit responses to individual pulses. This might indicate a saturation effect in summation of individual responses for repetition frequency between 20 and 80 Hz. The energy for 10 pulses at 20 Hz was about twice that of the single pulse. Energies for 10 pulses at 40 Hz and at 80 Hz were both smaller than the energy of the single pulse, about one-half and one-third, respectively. A trend for smaller energy at higher repetition frequencies was also found for the 1-s bursts.

Results from a linear mixed model with stimulus type (9 levels) as the fixed effect revealed that a significant difference was present (p<0.001). In pair-wise testing, only the two 10-pulse-10-Hz energies were significantly different from the single-pulse energy (p<0.001 and p=0.016). For the 10-pulse bursts, the 10-Hz burst energy was larger than for the higher frequencies, but energies for the 20-, 40-, and 80-Hz bursts were not different from one another. For the 1-s bursts, energies were not different from one another.

The pattern of differences was only slightly different for energy ratio. In pair-wise testing, the 1-s 20-Hz burst energy ratio was significantly different than the single-pulse ratio ($p=0.032$) in addition to the two 10-pulse-10-Hz ratios (p's<0.001). For 10-pulse bursts, the 10-Hz burst ratio was greater than for other repetition frequencies, but ratios of the 20-, 40- and 80-Hz bursts were not different from one another. For 1-s bursts, the energy ratio for the 10-Hz repetition frequency was greater than ratios for the 40- and 80-Hz frequencies ($p=0.003$ and $p=0.002$, respectively), but these were the only differences. The larger number of differences in energy ratio compared to the number found for energy might have been revealed by the normalizing nature of the ratio.

In FIG. 18, the patterns of stimulus total charge and charge ratio have many of the same characteristics of stimulus energy and its ratio in FIG. 17. However, in contrast to the pattern in energy, no burst charge is smaller than charge of the single pulse. For 1-s bursts, charge seems to be similar for all repetition frequencies and showed no obvious decline with increasing repetition frequency as did energy, and all charges were larger than the charge of the single pulse.

Results from a linear mixed model with stimulus type (9 levels) as the fixed effect revealed that a significant difference was present ($p<0.001$). In pair-wise testing, charge of all bursts was different than the charge of the single pulse (p's<0.001) except for charges of the 10-pulse bursts at 40 and 80 Hz. For the 10-pulse bursts, the 10-Hz burst charge was larger than for higher frequencies, but charges for the 20-, 40-, and 80-Hz bursts were not different from one another. For the 1-s bursts, charges were not different from one another.

For charge ratio, in pair-wise testing, the charge ratio of all bursts was different than the ratio of the single pulse (p's<0.001) except for ratios of the 10-pulse bursts at 40 and 80 Hz. For the 10-pulse bursts, the 10-Hz burst ratio was larger than for the higher frequencies (p's<0.001) and the 20-Hz burst ratio was larger than for the 40- and 80-Hz ratios ($p=0.009$ and $p<0.001$, respectively). For the 1-s bursts, the two significant differences were that the 40-Hz ratio was smaller than the 20- and 80-Hz ratios ($p=0.034$ and $p=0.025$, respectively). No charge ratio for bursts was smaller than 1, the charge ratio of the reference single pulse.

Figure 19:
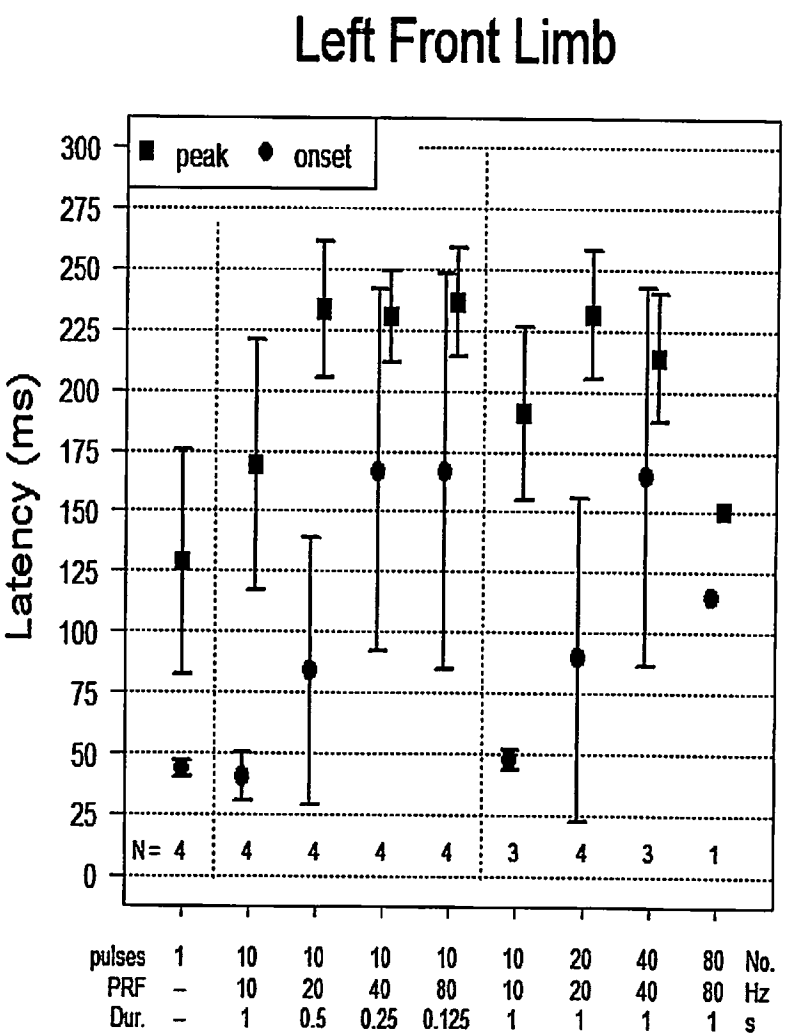
FIG. 19. Latencies to peak and latencies to onset for responses of each in the pulse burst experiment. The vertical lines divide a graph by the type of stimulus applied: single pulse, 10 pulses, and 1-s.
Figure 19:
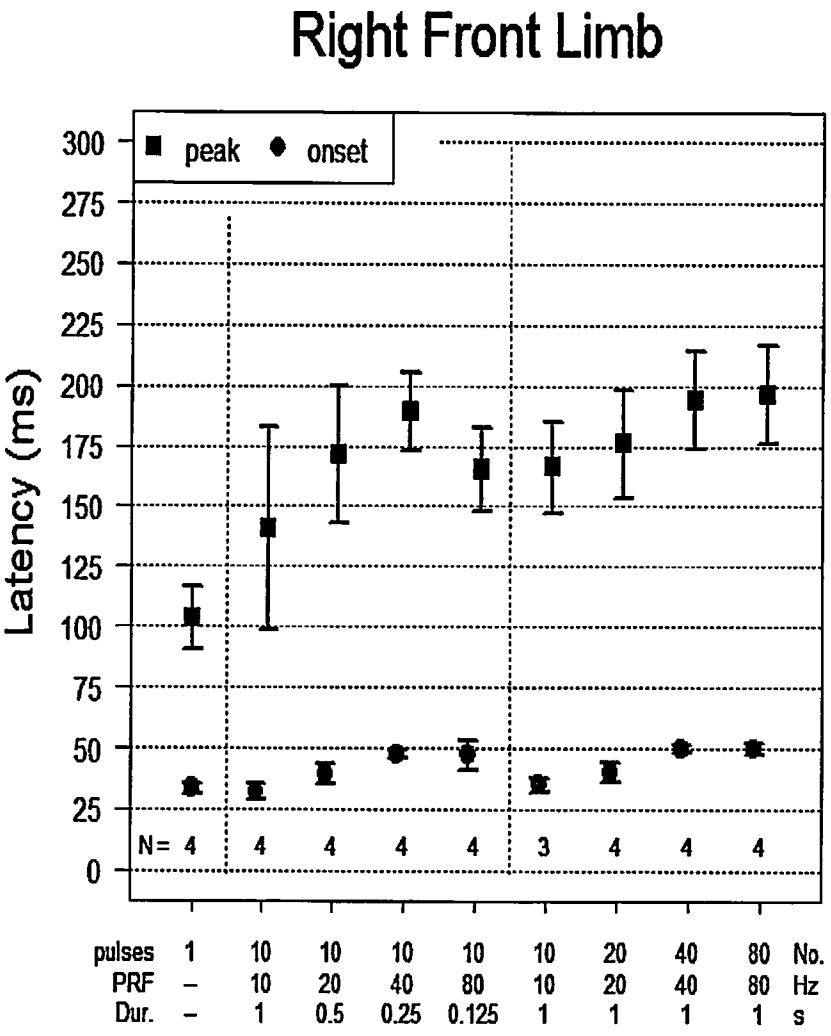
Figure 19:
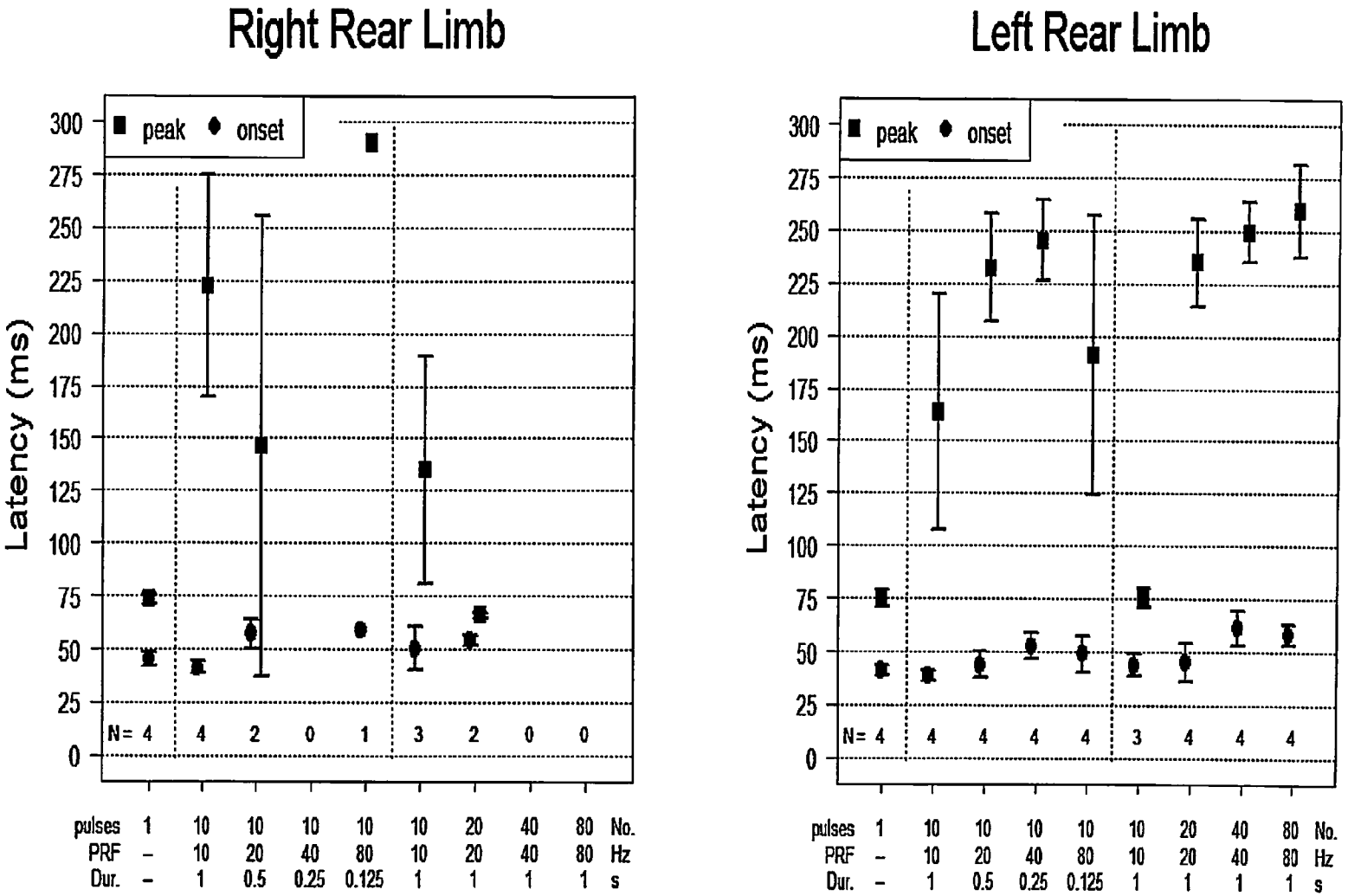

Latencies to onset and peak of the baseline response for the pulse burst experiment are shown in FIG. 19. A latency sample was calculated as the average of latencies of the last three responses for a given stimulus type: single pulse, 10-pulse bursts, and 1-s bursts, which had peak right front limb responses near the baseline force.

In FIG. 19, onset latency seems to follow a common pattern for the different limbs. For the 10-pulse bursts and for the 1-s bursts, the onset latency appears to increase for higher repetition frequency. Trends in peak latency are more difficult to identify because of the variability in the measured values. However, peak latencies for burst stimuli seem generally longer than the single-pulse latency, at least for the right front, left front, and left rear limbs.

For each limb, peak latency results from a linear mixed model with stimulus type (9 levels) as the fixed effect revealed that a significant difference was present (p's≤0.004). The peak force response of the right front limb was quite useful in evaluating relative effectiveness of different pulse waveforms and durations for single pulses. Responses in the threshold pulse, monophasic pulse, and biphasic pulse experiments were dominated by single peaks. However, for repetitive stimuli, response peak might not be the best metric for comparison. Because a longer response with a given effective force can be assumed to indicate a more effective incapacitation, peak force would not reflect the importance of stimulus duration.

An integrated response was used in order to compare limb force responses with different temporal profiles. The idea is that a prolonged response at some force level is a larger response than a shorter response of the same magnitude. Because responses were initially and primarily positive forces, only positive force is integrated. Computationally, this integration was accomplished by summing the positive force occurring during a designated time interval starting at the time of earliest stimulus application. Because responses were sampled at a rate of 1 kHz (once every 1 ms), which was faster than responses, the summation was a good approximation of the integral. A divisor of 1000 was used to account for the 1-ms sampling. The metric had units of newton-seconds (N-s) and corresponded to the area under a positive force curve.

Figure 20:
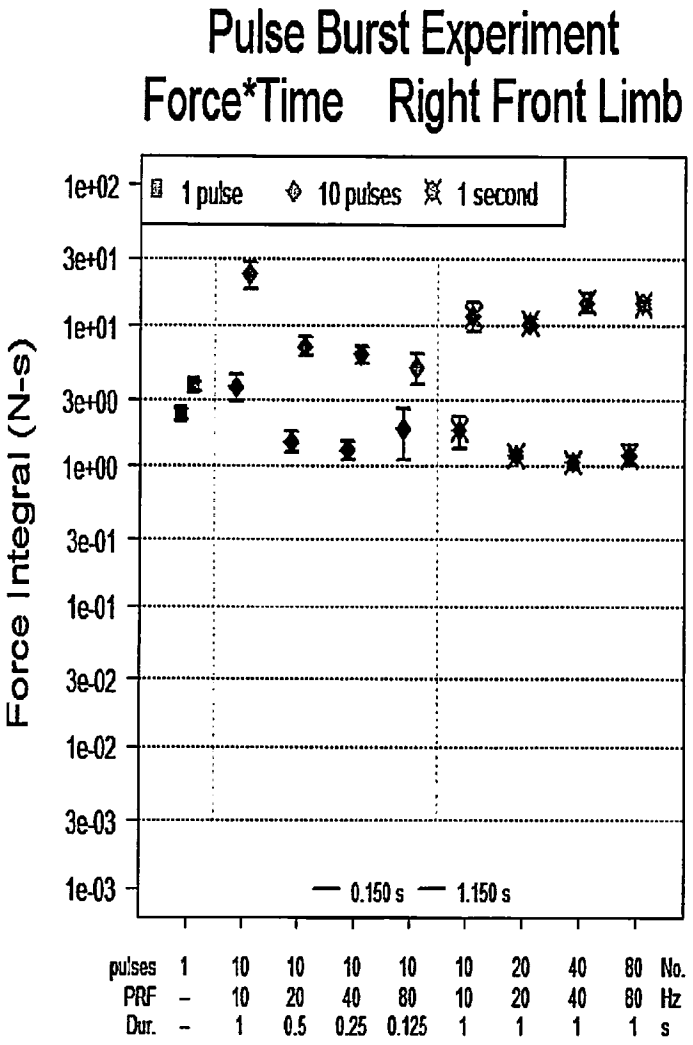
FIG. 20. Force integral of responses in the pulse burst experiment for different burst stimuli. Data are shown only for the 0.150- and 1.150-s integration periods for clarity. The vertical lines divide a graph by the type of stimulus applied: single pulse, 10 pulses, and 1 s.
Figure 20:
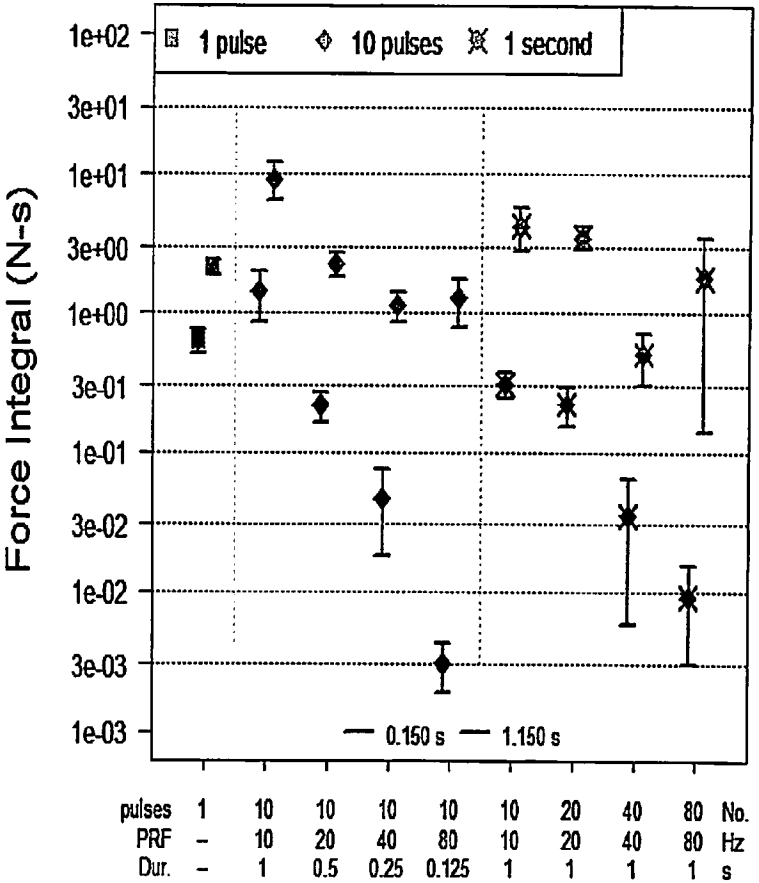
Figure 20:
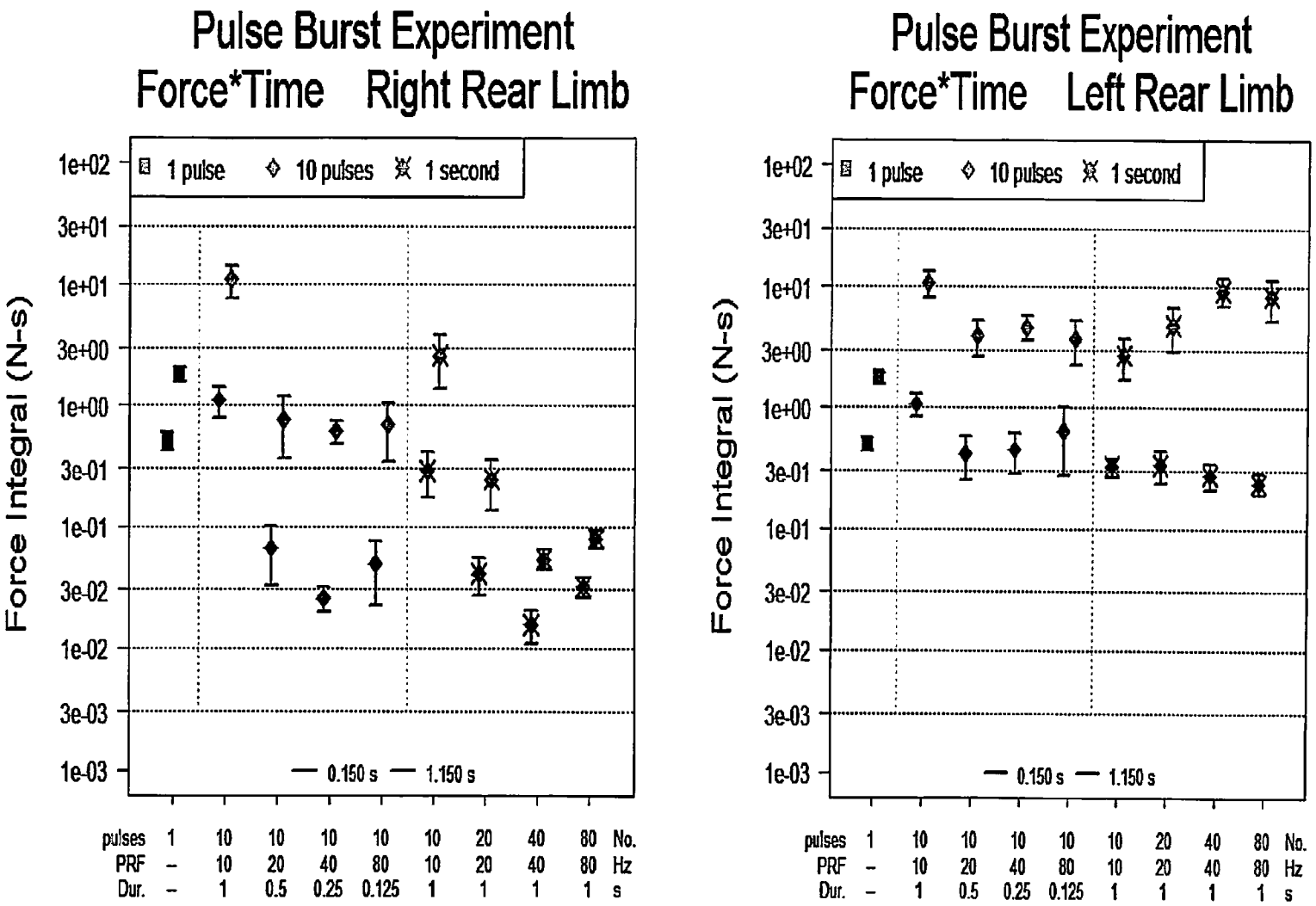

The force integral response is shown in FIG. 20 for each limb using response data from the pulse burst experiment, in which all responses had about the same peak response in the right front limb. For clarity, only the 0.150- and 1.150-s periods are shown in FIG. 21.

Figure 21:
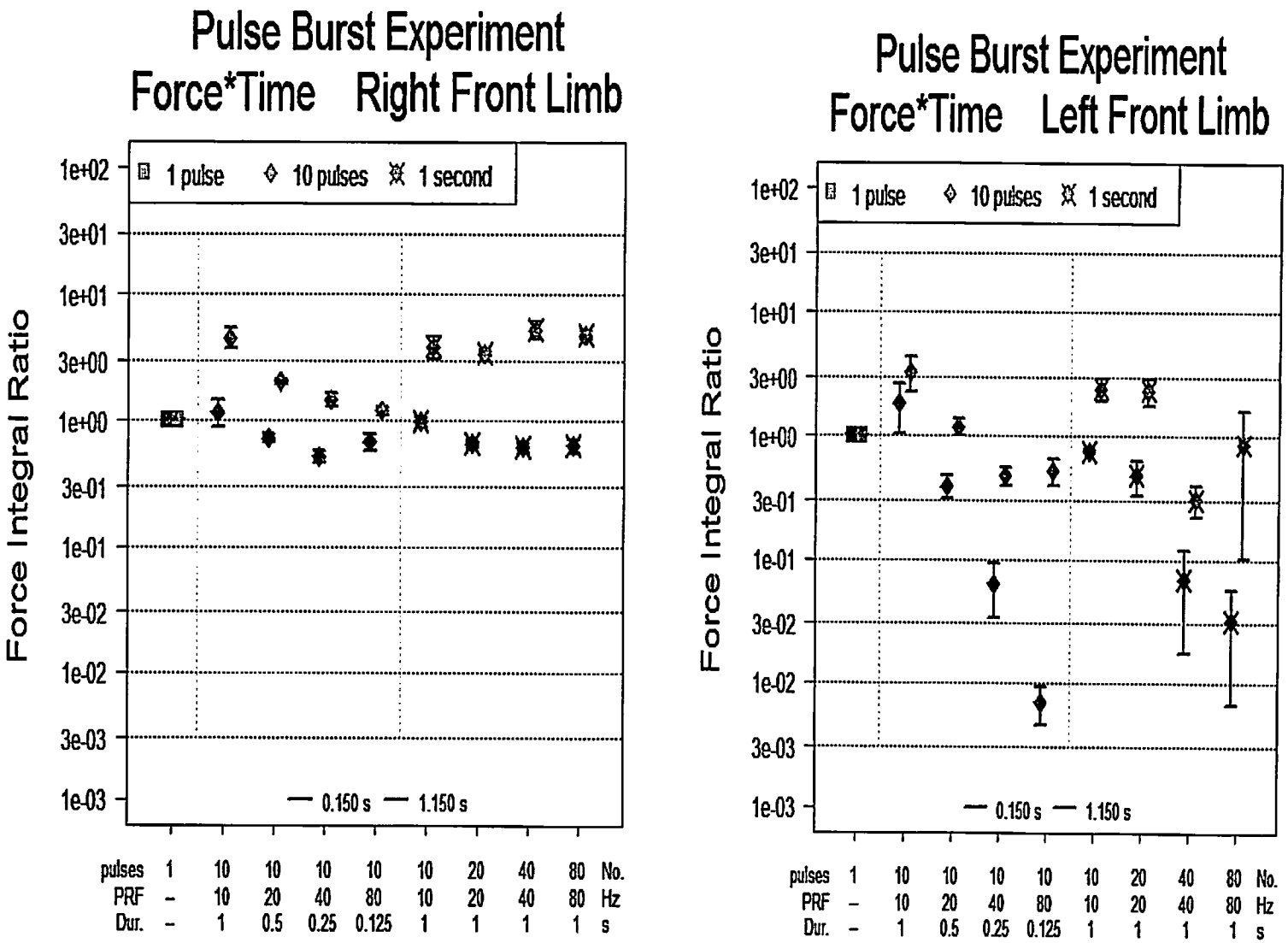
FIG. 21. Normalized force integral for the 0.150- and 1.150-s integration periods for different burst stimuli in the pulse burst experiment. Responses were normalized by dividing by the force integral of the single 100-μs pulse for respective limbs. The vertical lines divide a graph by the type of stimulus applied: single pulse, 10 pulses, and 1 s.
Figure 21:
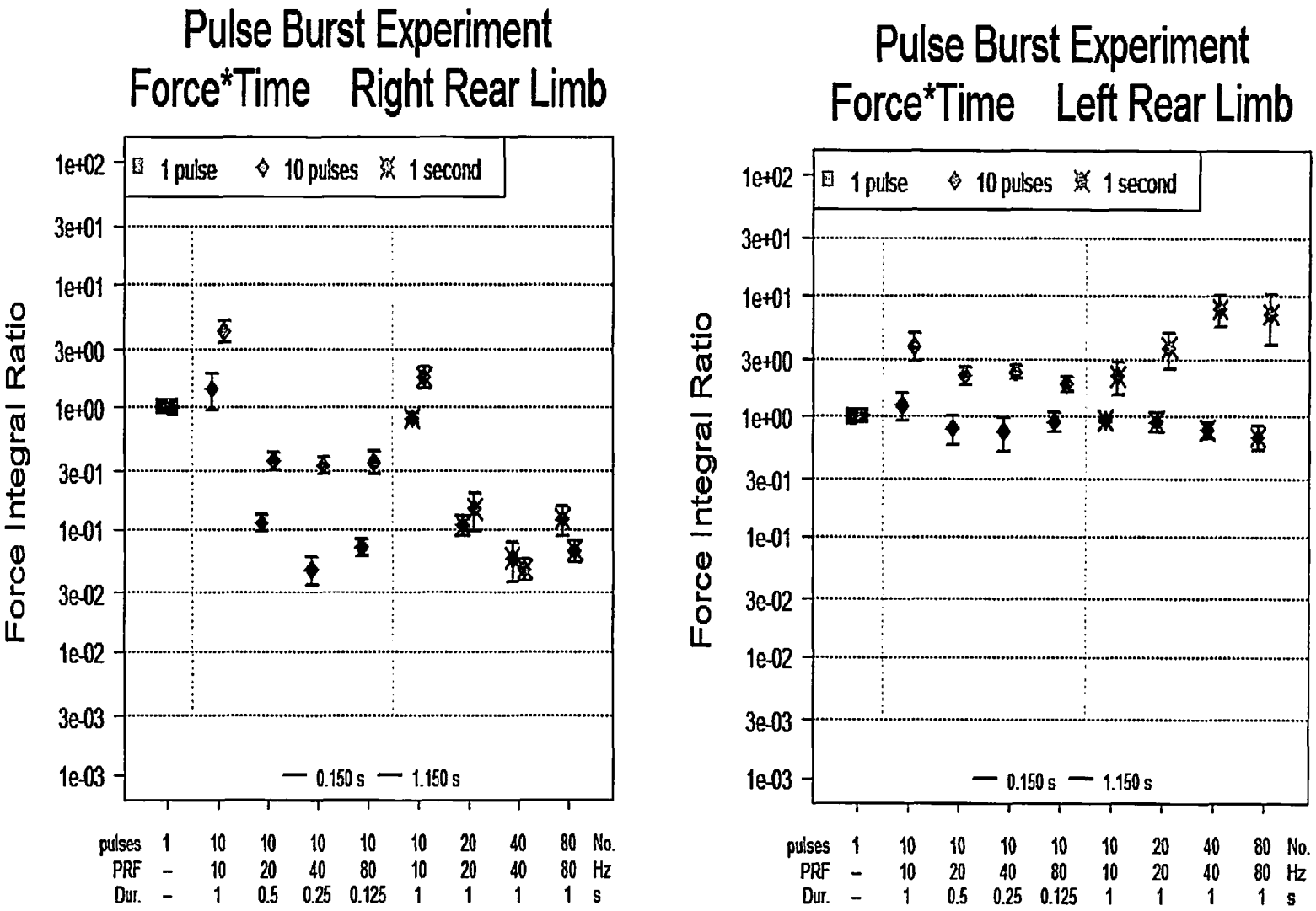

Several observations can be made about the force integral in FIG. 21. For repetition frequencies of 20, 40, and 80 Hz, smaller individual pulse amplitudes were needed to elicit the baseline force. The smaller amplitude pulses resulted in later onset and the area under the force response for the 0.150-s period was smaller than for the response to the single pulse. These longer onset latencies for the higher repetition frequencies are seen in FIG. 21.

Figure 22:
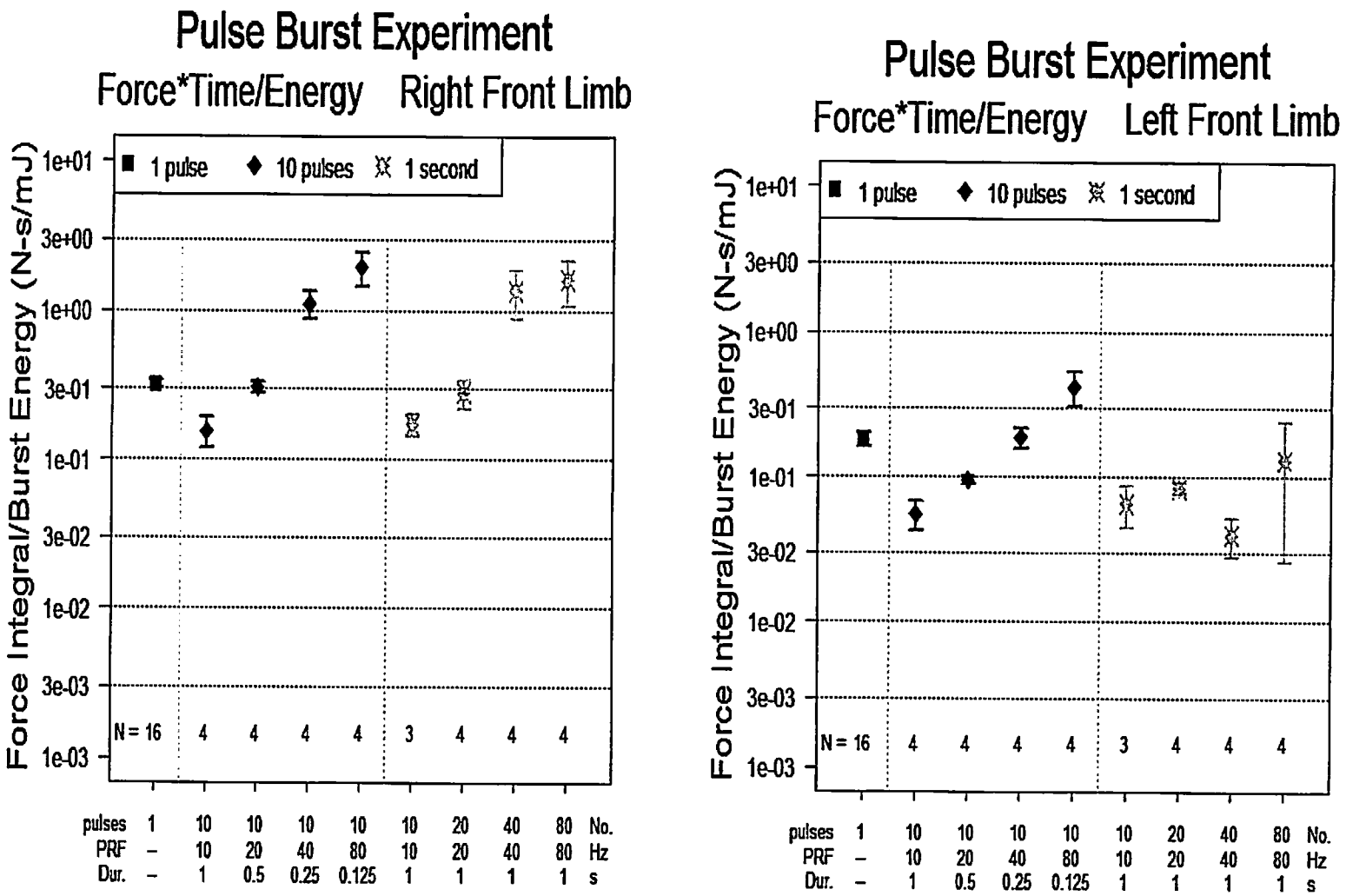
FIG. 22. Energy effectiveness, the ratio of force integral to pulse burst energy, for different stimuli in the pulse burst experiment. The vertical lines divide a graph by the type of stimulus applied: single pulse, 10 pulses, and 1 s.
Figure 22:
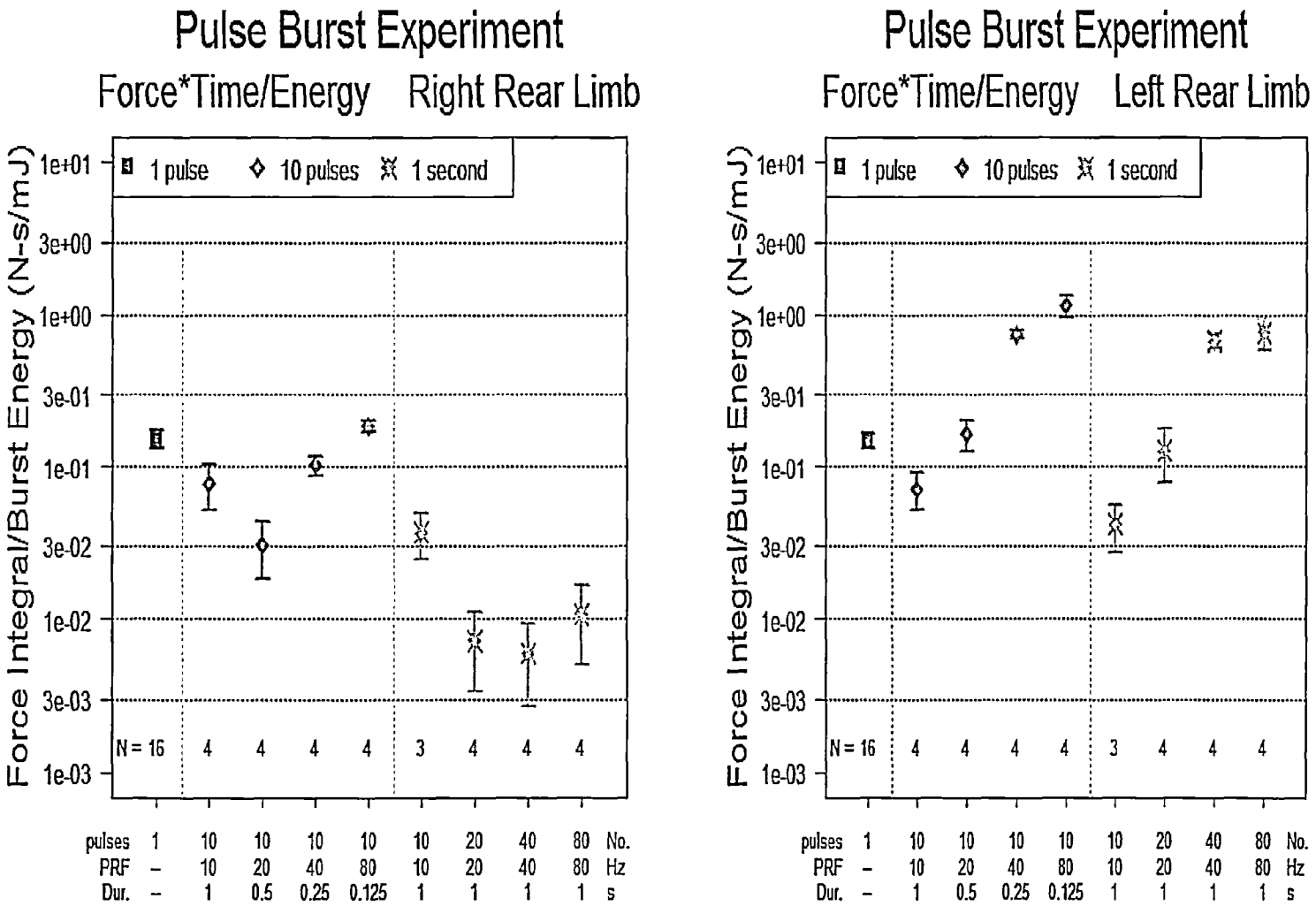
Figure 23:
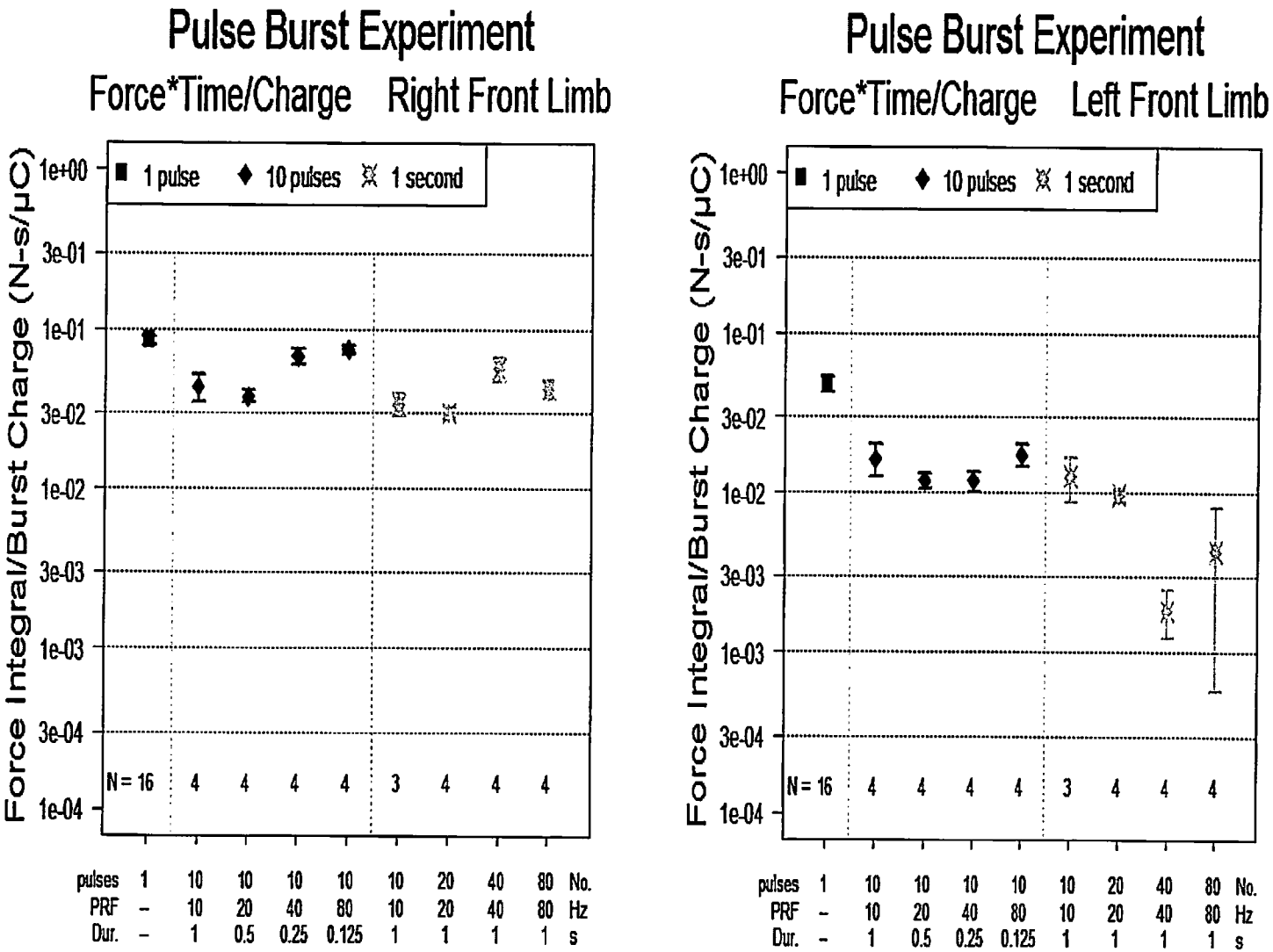
FIG. 23. Charge effectiveness, the ratio of force integral to pulse burst total charge, for different stimuli in the pulse burst experiment. The vertical lines divide a graph by the type of stimulus applied: single pulse, 10 pulses, and 1 s.
Figure 23:
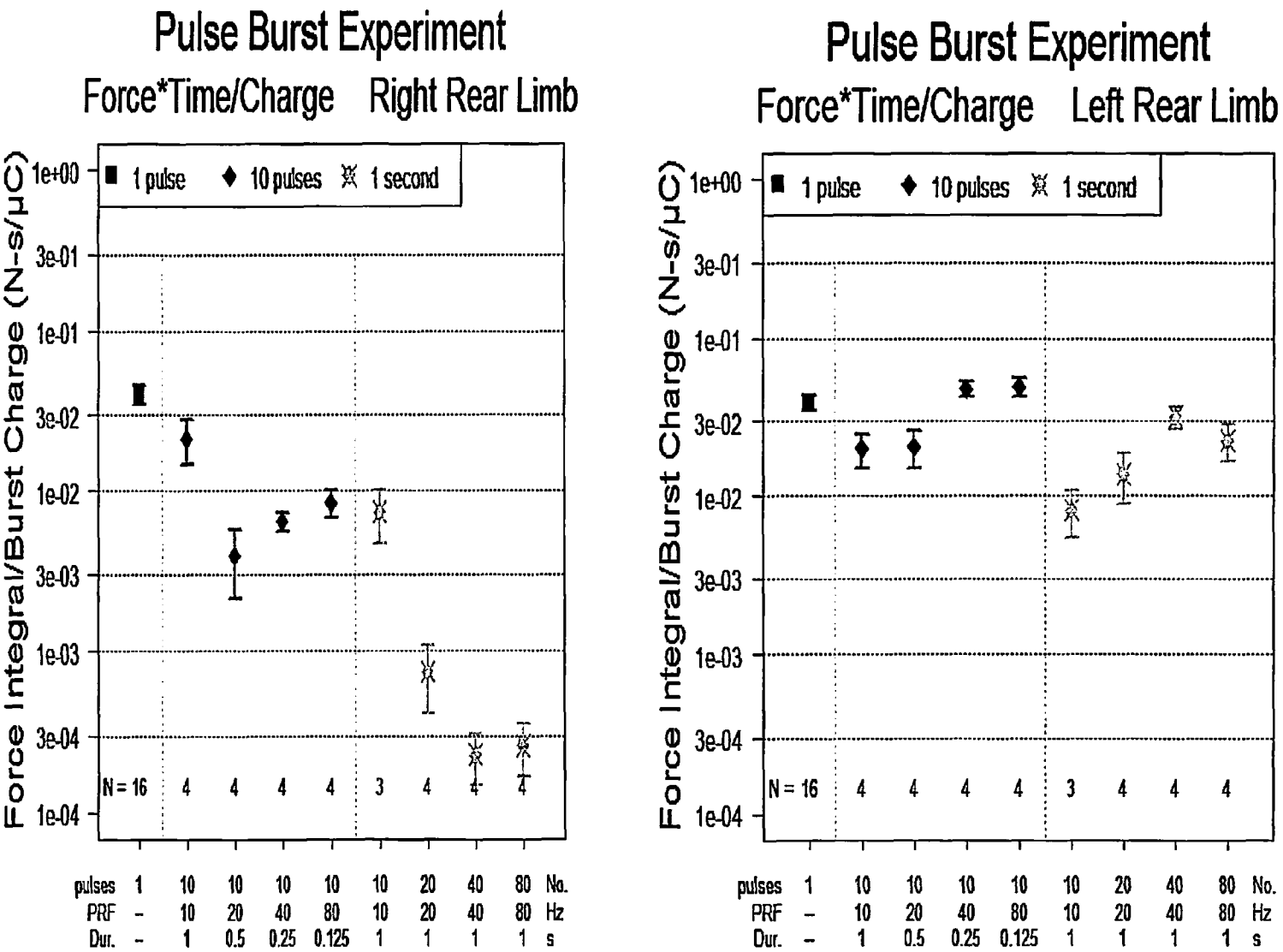

The force integral was used to compute measures of stimulus effectiveness for each animal. Effectiveness here was defined as the response magnitude divided by the stimulus magnitude. The force integral for the 1.150-s integration period was used as the measure of response magnitude and stimulus energy or total charge was used as the measure of stimulus magnitude. For stimulus energy, the effectiveness measure had units of N-s/mJ; and for stimulus total charge, N-s/μC. FIGS. 22 and 23 show energy effectiveness and charge effectiveness, respectively, for each limb. Note that the graphs are based on values computed for each animal and are not simply the data in FIG. 18 divided by the respective values in FIG. 15 or FIG. 16.

In FIG. 22, energy effectiveness of the single pulse was between 0.15 and 0.32 N-s/mJ across limbs. Patterns of energy effectiveness in FIG. 22 were similar for the right front, left front, and left rear limbs. For 10-pulse bursts, effectiveness increased with repetition frequency, with either the 20- or 40-Hz burst effectiveness similar to that of the single pulse in these limbs. For 1-s bursts, effectiveness also increased with repetition frequency for the right front and left rear limbs, but appears relatively constant for the left front limb. For the right rear limb, effectiveness appears smaller than the single-pulse effectiveness for all but the 10-pulse 80-Hz burst. For each limb, results from a linear mixed model with stimulus type (9 levels) as the fixed effect revealed that a significant difference was present (p's<0.001).

In FIG. 23, charge effectiveness of the single pulse is seen to be between 0.040 and 0.085 N-s/μC across limbs. Except for two instances for the left rear limb, the single-pulse effectiveness appears larger than for all bursts in all limbs. Patterns of charge effectiveness in FIG. 23 are similar for the right front and left rear limbs. For 10-pulse bursts, effectiveness for bursts at 10 and 20 Hz is similar and smaller than effectiveness for bursts at 40 and 80 Hz, which also have similar effectiveness in these two limbs. The same pattern also occurs for effectiveness of 1-s bursts. Patterns of charge effectiveness are somewhat similar for the left front and right rear limbs with small effectiveness for 10-pulse bursts with the 10-Hz burst effectiveness appearing possibly largest. For these limbs, effectiveness for 1-s bursts is small and seems to decline with increasing repetition frequency. For each limb, results from a linear mixed model with stimulus type (9 levels) as the fixed effect revealed that a significant difference was present (p's<0.001).

Example 5

ON/OFF Pulse Pattern and Forced Breathing Experiment

Figure 26:
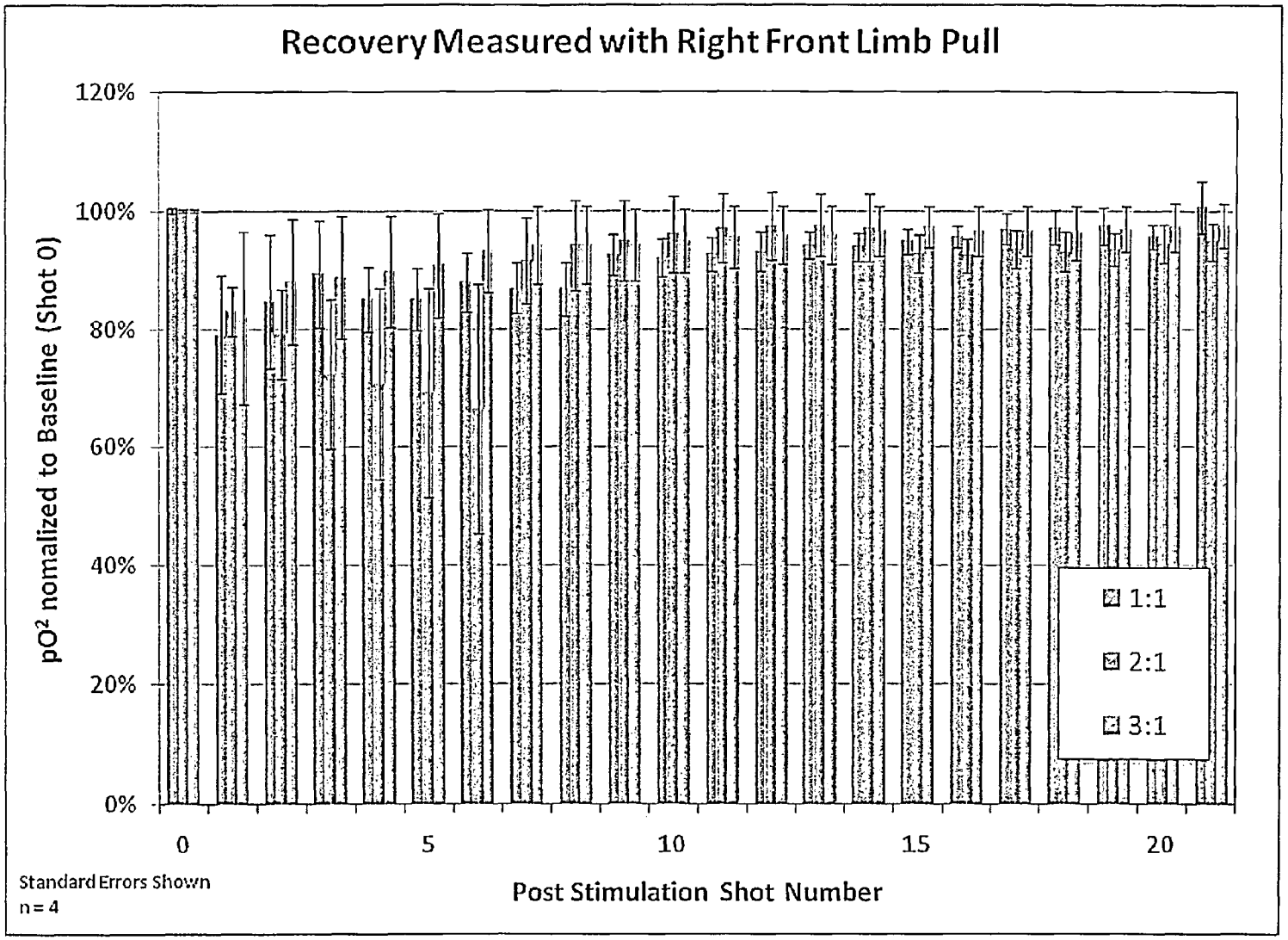
FIG. 26. Normalized $pO_2$ measured after single pulse stimulation every 15 s. Shot number 0 is the average baseline pull from shots occurring before 1:1, 2:1, or 3:1 cycled stimulation. Shot 1 occurred 0.5 s after the conclusion of the test stimulation. Shot 2 occurred 18.3 s later and each proceeding shot occurred every 15 seconds.

Three patterns of electro-muscular stimulation for either one, two, or three seconds respectfully followed by a one second off period were tested using swine model. To emphasize differences between the three parameters, exposures continued the ON/Off cycling for 15 minutes. Experiment procedure follows the common material and procedures described in Example 2-5. All three of these stimulation patterns produced a single breath for each ON/OFF cycle. FIG. 26 show the partial pressure of oxygen (pO2) prior to exposure, the first set of bars, and at 15 s intervals after the 15 minute exposure. The worst recovery was the two second ON one second OFF (The center bars labeled 2:1 in the figure) While the other two patterns, one second ON/ one second OFF (1:1 and the left bars in the figure) and the three second ON and one second OFF (3:1 and the right bars in the figure) recovered more quickly. The one and three second ON times seem to better match the breathing cycle of the subjects. The optimal pattern for humans will likely require some adjustment, but the principal of forced breathing during incapacitation by cycling the stimulus remains can be used to extend the duration of stimulation, saving precious battery power, and increasing safety.

Figure 27:
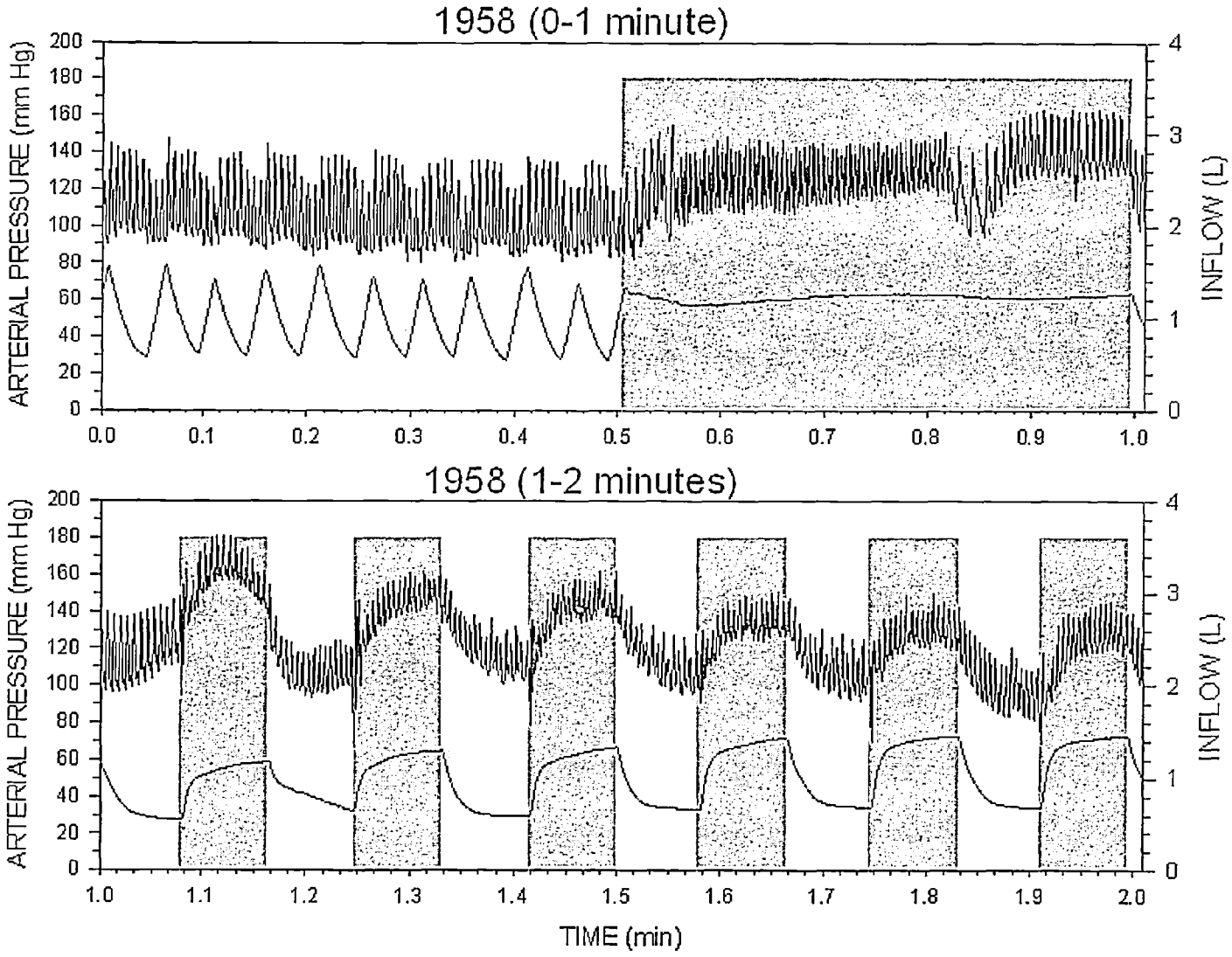

The ability of a HEMI device to drive breathing is dependant on the ON/OFF pattern. The FIG. 27 is an early example using a TASER X26 as the source, but controlling the ON/OFF pattern. Notice the initial 30 second ON period suppresses breathing (grey line), but that the subsequent 5 second ON 5 second OFF pattern controls the subject's breathing. This pattern is less than optimal which is why the experiment above was done, to develop patterns which were safer for the target.

Example 6

Comparison of Electric Pulses Produced by the Inventive Device and Commercial Available Devices (X26)

Figure 24:
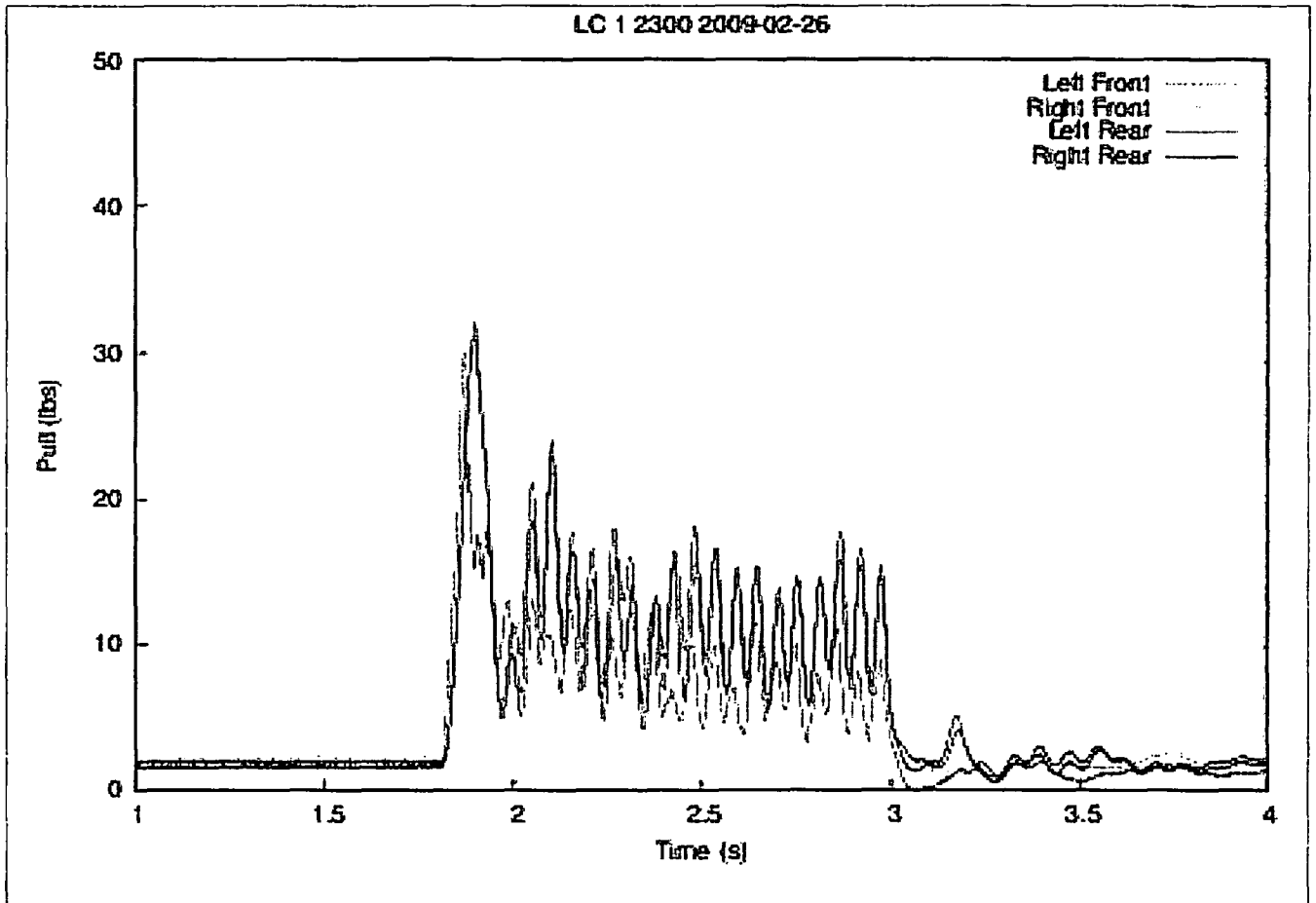
FIG. 24(A-B). Force on each limb in pounds of pull during the course of a thress second stimulation with either a TASER X26 (top panel) or the HEMI stimulus parameters (bottom panel).
Figure 24:
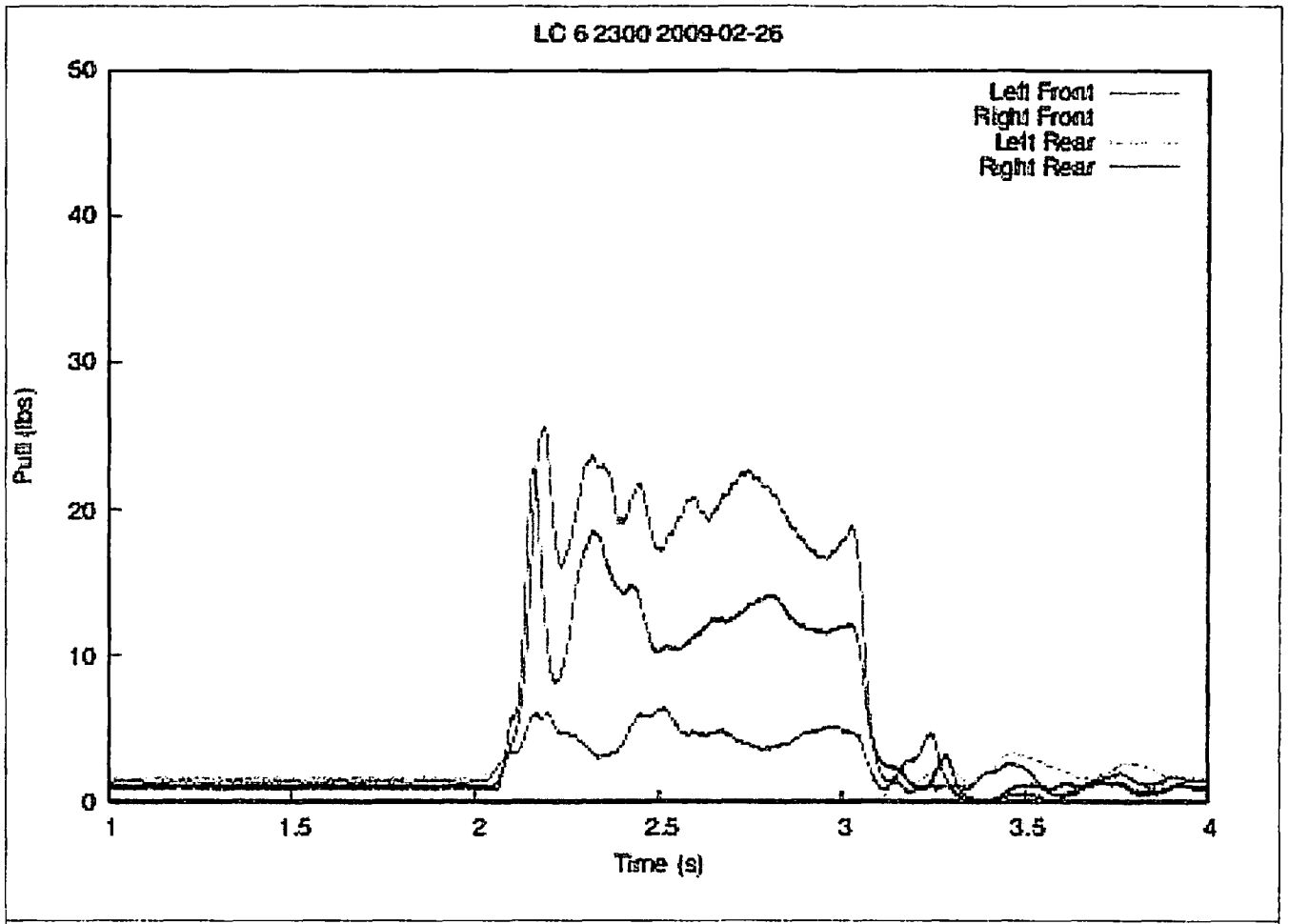

FIGS. 24 A and B show the number of pounds of pull exerted by each limb during a brief exposure of X26 stimulation (A) and during a typical stimulation of the inventive device (B). Considering the responses of the right front limb (the top lines in both Figures), each stimulation starts with a high peak probably representing inertia built up while the movement of the swine took up the slack in the lines connecting the animal to the load cells and in the body of the animal itself. Subsequently, it is clear that the 19 Hz stimulation produces an oscillating level of force as the muscles contract, and relax, whereas the force produced by the 40 Hz stimulation under the inventive method is much more continuous and consistent from pulse to pulse. In other words, the muscles do not have time to relax as they do at 19 Hz stimulation.

The total work produced by the stimulation that is the area under each of these curves. The 37 micro-Coulombs per pulse produced by the inventive method is the same response as X26 stimulation. Because this measure includes the lows of the oscillations which occur between the X26 pulses, it underestimates the response produced by the X26 when the electrical pulses are applied.

When the average value of the inventive stimulus versus the average of only the peak stimulate of the X26, the results suggest an inventive stimulus of 52 micro-Coulombs is equivalent to that of an X26.

The data also suggest that by incorporating the response of all four limbs into a single measure, variability, seen as deviations from the regression lines, has been reduced in the two panels on the left while retaining the excellent fits of the data for the two animals on the right. By this analysis the inventive stimulus with 44 micro-Coulombs per pulse is equivalent to an X26 (Reported by Taser International as between 110-135 micro-Coulombs per pulse in tissue).

CONCLUSION

Given the limitations of these experiments, the following conclusions can be made based on results obtained:

(a) Monophasic pulses with the same energy, or charge, are equally effective in eliciting threshold responses independent of pulse shape.

(b) Longer pulses are more energy-efficient up to at least 250 μs.

(c) Shorter pulses are more charge-efficient down to at most 20 μs.

(d) Monophasic pulses are more efficient than biphasic pulses.

(e) Repetition frequencies of 40 and 80 Hz are more effective than 10 and 20 Hz in bursts.

REFERENCES

1. Reilly, J. P., A. M. Diamant, and J. Comeaux (2009). Dosimetry considerations for electrical stun devices. Physics in Medicine & Biology, 54: 1319-1335.
2. Reilly J P. 2007. "Are Electrical Stun Weapons lethal?" Presentation at 14th Annual Michaelson Conference, Portsouth New Hampshire, Aug. 3-7, 2007.
3. R. N. Kornblum and s. K. Reddy, "Effects of the TASER in Fatalities Involving Police Confrontations," *Journal of Forensic Science,* 1981, 36(2), pp. 434-8.
4. Ho J D, Dawes D M, Bultman L L, Thacker J L, Skinner L D, Bahr J M, Johnson M A, Miner J R. 2006. Respiratory effect of prolonged electrical weapon application on human volunteers. Acad Emerg Med 13:589-595.
5. Ho J D, Dawes D M, Bultman L L, Thacker J L, Skinner L D, Bahr J M, Johnson M A, Miner J R. 2007. Respiratory effect of prolonged electrical weapon application on human volunteers. Acad Emerg Med 114:197-201.
6. J. P. Reilly, *Applied Bioelectriciry, Springer, New York,* 1998.
7. Alex Berenson, "As Police Use of TASERs Rises, Questions over Safety Increase," New York Times, Jul. 18, 2004.
8. Taser International TASER Electronic control Devices Electrical Characteristics—X26. Taser International. Feb. 1, 2009. http://www.ecdlaw.info/outlines/EC_02-01-09_%20×26_Elec_Char.pdf

The invention claimed is:

1. An apparatus for incapacitating a subject, the apparatus comprising:

(a) an electric circuitry for (i) generating a first continuous pulsed electric waveform having a first frequency and over a first time period sufficient to induce involuntary muscular contraction, and (ii) generating a second intermittent pulsed electric waveform having a second frequency over a second time period sufficient to safely maintain incapacitation of the subject with forced breathing cycle;

(b) a plurality of electrical contacts for delivering electric waveforms to a subject; and (c) a switch to selectively activate said circuit.

2. The apparatus of claim 1, wherein said electrical contact is a pad, a button, a nub, a prong, a needle, or a hook.

3. The apparatus of claim 1, further comprising a release mechanism for releasing said electrical contacts from the apparatus.

4. The apparatus of claim 1, wherein the electrical contacts deliver the electric waveform to a subject subcutaneously.

5. The apparatus of claim 1, wherein the electrical contacts deliver the waveform to an outer surface of a subject.

6. The apparatus of claim 1, further comprising an elongate body having a first end and a second end, wherein the electrical contacts are located proximately on the first end and the switch is located proximately on the second end.

7. The apparatus of claim 1, wherein said first time period is 15-45 seconds.

8. The apparatus of claim 1, wherein said second intermittent pulsed electric waveform follows the first continuous pulsed electric waveform.

9. The apparatus of claim 8, wherein said second time period is about 60-150 seconds.

10. The apparatus of claim 1, wherein said second intermittent pulsed electric waveform switch on and off during the second time period.

11. The apparatus of claim 10, wherein said second intermittent pulsed electric waveform is on for approximately 1-3 seconds.

12. The apparatus of claim 10, wherein said second intermittent pulsed electric waveform is off for approximately 1 second.

13. The apparatus of claim 1, wherein said first and second pulsed electric waveforms are the same.

14. The apparatus of claim 1, wherein an electrical charge of a pulse of said first and second electric pulsed waveform is approximately 40 to 80 micro-Coulombs.

15. The apparatus of claim 1, wherein said first and second has a pulse frequency of approximately 40 Hz to about 80 Hz.

16. The apparatus of claim 1, wherein duration of said first and second electric pulsed waveform is approximately 100 microseconds.

17. The apparatus of claim 1, wherein said first and second pulsed electric waveform is a square wave.

18. A method for temporarily incapacitating a subject, comprising:

(a) generating a continuous pulsed electric waveform; and (b) applying said continuous pulsed electric waveform to a subject at a first frequency and over a first time period sufficient to induce involuntary muscular contraction;

(c) generating an intermittent pulsed electric waveform, which is on for 1-3 seconds and off for approximately 1 second; and (d) applying said second intermittent pulsed electric waveform to said subject at a second frequency and over a second time period sufficient to safely maintain incapacitation of the subject with forced breathing cycle.

19. The method of claim 18, wherein said first time period is 15 to 45 seconds.

20. The method of claim 18, wherein said intermittent pulsed electric waveform follows the continuous pulsed electric waveform.

21. The method of claim 18, wherein said second time period is 60 to 150 seconds.

22. The method of claim 18, wherein the continuous and intermittent pulsed electric waveform are the same.

23. The method of claim 18, wherein said first and second frequency-are about 40 Hz to about 80 Hz.

24. The method of claim 18, wherein the charge of a pulse of said continuous and intermittent pulsed electric waveforms is approximately 40 to 80 micro-Coulombs.

25. The method of claim 18, wherein duration of said continuous and intermittent pulsed electric waveforms is approximately 100 microseconds.

* * * * *